US010236578B2

(12) United States Patent
Nysen et al.

(10) Patent No.: US 10,236,578 B2
(45) Date of Patent: Mar. 19, 2019

(54) ANTENNA STRUCTURES AND ASSOCIATED METHODS FOR CONSTRUCTION AND USE

(71) Applicant: NETGEAR, INC., San Jose, CA (US)

(72) Inventors: Paul Nysen, San Jose, CA (US); Chia-Wei Liu, Cupertino, CA (US); Joseph Amalan Arul Emmanuel, Cupertino, CA (US)

(73) Assignee: NETGEAR, INC., San Jose, CA (US)

( * ) Notice: Subject to any disclaimer, the term of this patent is extended or adjusted under 35 U.S.C. 154(b) by 0 days.

(21) Appl. No.: 15/853,636

(22) Filed: Dec. 22, 2017

(65) Prior Publication Data

US 2018/0138595 A1 May 17, 2018

Related U.S. Application Data

(63) Continuation-in-part of application No. 15/043,470, filed on Feb. 12, 2016.

(51) Int. Cl.

| | |
|---|---|
| ***H01Q 5/335*** | (2015.01) |
| ***H01Q 9/28*** | (2006.01) |
| ***H01Q 1/24*** | (2006.01) |
| ***H01Q 1/38*** | (2006.01) |
| ***H01Q 5/15*** | (2015.01) |
| *H01Q 1/52* | (2006.01) |

(52) U.S. Cl.

CPC ..... *H01Q 5/335* (2015.01); *H01Q 1/243* (2013.01); *H01Q 1/246* (2013.01); *H01Q 1/38* (2013.01); *H01Q 5/15* (2015.01); *H01Q 9/28* (2013.01); *H01Q 1/523* (2013.01)

(58) Field of Classification Search

CPC ..... H01Q 9/28; H01Q 5/15; H01Q 5/335; H01Q 1/243; H01Q 1/38

USPC ..... 343/795, 713, 792

See application file for complete search history.

(56) References Cited

U.S. PATENT DOCUMENTS

| | | | | |
|---|---|---|---|---|
| 2,486,597 A | | 11/1949 | Greene | |
| 4,205,319 A | | 5/1980 | Gasparaitis et al. | |
| 4,746,925 A | * | 5/1988 | Toriyama | H01Q 1/1271 343/700 MS |
| 4,998,895 A | | 3/1991 | Forney et al. | |

(Continued)

*Primary Examiner* — Hai V Tran

(74) *Attorney, Agent, or Firm* — Perkins Coie LLP

(57) ABSTRACT

Disclosed are improved antenna structures, systems, and methods of manufacturing. In an embodiment, low-cost internal 2G/5G antennas have flat metal dipole construction, which can include a stiffener. External embodiments include quad dipole antenna structures, with broadside or corner arrays. Isolated multi-band center or end-fed dipole antennas can include single-sided PCB or metal-only structures, for operation with at least two distinct frequencies, and can provide RF isolation, such as with an RF trap or a Balun system. Embodiments of non-DC path or pass-through dual band antennas feature trap structures, along with discrete or distributed matching, and can provide a DC feed path for LEDs. Low profile and flat vertically polarized omni-directional antennas, such as for operation at 915 MHz, include an open slot driven cavity. Stacked 2G/5G antenna structures provide axial symmetry between quadrants. Improved construction methods and antenna structures include enhanced thin metal components and low cost, crimp-only construction methods.

22 Claims, 81 Drawing Sheets

(56) References Cited

U.S. PATENT DOCUMENTS

| | | | | |
|---|---|---|---|---|
| 5,173,715 | A * | 12/1992 | Rodal | H01Q 21/205 343/795 |
| 6,339,405 | B1 * | 1/2002 | Gleener | H01Q 1/243 343/700 MS |
| 2012/0194401 | A1 * | 8/2012 | McLean | H01Q 9/22 343/792 |
| 2014/0313087 | A1 * | 10/2014 | Jiang | H01Q 3/22 343/745 |
| 2015/0244075 | A1 | 8/2015 | Platt | |

* cited by examiner

| Slope | Frequency | S11 | S12 | S13 | S14 | Peak Gain | Delta Z |
|---|---|---|---|---|---|---|---|
| | | | (224mm) | (340mm) | (255mm) | | (0mm) |
| Degrees | GHz | dB | dB | dB | dB | dBi | |
| 0 | 2.40 | -12.7 | -22.5 | -27.5 | -23.9 | 5.3 | |
| 0 | 2.49 | -11.0 | -23.0 | -28.0 | -24.3 | 6.2 | |
| | | | | | | | |
| 0 | 4.90 | -11.1 | -39.0 | -29.5 | -41.7 | 7.1 | |
| 0 | 5.30 | -32.0 | -30.0 | -34.9 | -30.8 | 5.6 | |
| 0 | 5.70 | -23.8 | -31.7 | -43.2 | -31.4 | 5.4 | |
| 0 | 5.90 | -17.0 | -32.1 | -35.6 | -33.9 | 5.3 | |

220

*FIG. 15*

| Slope | Frequency | S11 | S12 | S13 | S14 | Peak Gain | Delta Z |
|---|---|---|---|---|---|---|---|
| | | | (224mm) | (340mm) | (255mm) | | (37mm) |
| Degrees | GHz | dB | dB | dB | dB | dBi | |
| 10 | 2.40 | -13.8 | -23.8 | -28.3 | -25.1 | 4.8 | |
| 10 | 2.49 | -11.6 | -24.5 | -29.3 | -25.8 | 5.7 | |
| | | | | | | | |
| 10 | 4.90 | -11.2 | -47.2 | -30.5 | -36.6 | 6.3 | |
| 10 | 5.30 | -33.6 | -29.4 | -34.1 | -30.8 | 6.8 | |
| 10 | 5.70 | -22.9 | -31.2 | -33.3 | -30.6 | 5.6 | |
| 10 | 5.90 | -16.8 | -32.0 | 34.0 | 31.9 | 5.6 | |

260

*FIG. 19*

| Slope | Frequency | S11 | S12 | S13 | S14 | Peak Gain | Delta Z |
|---|---|---|---|---|---|---|---|
| | | | (216mm) | (334mm) | (255mm) | | (59mm) |
| Degrees | GHz | dB | dB | dB | dB | dBi | |
| 15 | 2.40 | -13.9 | -25.1 | -29.0 | -25.2 | 4.4 | |
| 15 | 2.49 | -11.5 | -30.3 | -30.2 | -25.9 | 5.4 | |
| | | | | | | | |
| 15 | 4.90 | -11.3 | -42.1 | -31.4 | -35.8 | 6.1 | |
| 15 | 5.30 | -36.2 | -30.6 | -33.8 | -30.0 | 7.0 | |
| 15 | 5.70 | -22.9 | -32.4 | -32.8 | -30.8 | 6.0 | |
| 15 | 5.90 | -16.9 | -33.3 | -33.7 | 31.9 | 5.4 | |

294

*FIG. 23*

| Name | Freq | Ang | Mag | RX | GB |
|---|---|---|---|---|---|
| m1 | 2.4000 | -91.5157 | 0.2595 | 0.8627 + 0.4800i | 0.8852 + 0.4925i |
| m2 | 2.4900 | 145.7221 | 0.2821 | 0.5954 + 0.2056i | 1.5006 + 0.5181i |
| m3 | 4.9000 | -145.2894 | 0.2262 | 0.6668 + 0.1810i | 1.3968 + 0.3793i |
| m4 | 5.3000 | 42.0000 | 0.2908 | 1.4033 + 0.5967i | 0.6035 + 0.2566i |

690

| Name | Freq | Ang | Mag | RX | GB |
|---|---|---|---|---|---|
| m1 | 2.4000 | -61.4719 | 0.2523 | 1.1382 - 0.5389i | 0.7177 + 0.3398i |
| m2 | 2.4900 | 62.6401 | 0.3307 | 1.1058 + 0.7295i | 0.6301 - 0.4157i |
| m3 | 4.9000 | -28.6268 | 0.3259 | 1.6734 - 0.5846i | 0.5326 + 0.1861i |
| m4 | 5.3000 | 115.0219 | 0.1056 | 0.8986 + 0.1739i | 1.0727 - 0.2076i |

| Name | X | Y |
|---|---|---|
| m1 | 2.4000 | -9.1852 |
| m2 | 2.5000 | -10.0033 |
| m3 | 4.9000 | -9.4989 |
| m4 | 5.9000 | -11.2802 |

| Name | X | Y |
|---|---|---|
| m1 | 2.4000 | -12.7963 |
| m2 | 2.4500 | -15.1928 |
| m3 | 2.4900 | -17.1704 |
| m4 | 4.9000 | -10.6390 |
| m5 | 5.3000 | -14.4751 |
| m6 | 5.7000 | -18.3865 |
| m7 | 5.9000 | -17.4803 |

| Name | Freq | Ang | Mag |
|---|---|---|---|
| m1 | 2.4000 | -165.1596 | 0.2292 |
| m2 | 2.4450 | -177.8830 | 0.1842 |
| m3 | 2.4900 | 160.1921 | 0.1385 |
| m4 | 4.9000 | 40.9142 | 0.2938 |
| m5 | 5.3000 | 28.1789 | 0.1889 |
| m6 | 5.7000 | 52.4922 | 0.1204 |
| m7 | 5.9000 | 76.1842 | 0.1337 |

| Name | Freq | Ang | Mag | RX |
|---|---|---|---|---|
| m1 | 0.8600 | 80.6747 | 0.2996 | 0.9170 + 0.5956i |
| m2 | 0.9300 | -83.7259 | 0.2738 | 0.9113 - 0.5362i |

ANTENNA STRUCTURES AND ASSOCIATED METHODS FOR CONSTRUCTION AND USE

CROSS REFERENCE TO RELATED APPLICATIONS

This Application is a Continuation in Part of U.S. application Ser. No. 15/043,470, filed 12 Feb. 2016, which is incorporated herein in its entirety by this reference thereto.

FIELD OF THE INVENTION

At least one embodiment of the present invention pertains to antenna structures for wireless devices. At least one specific embodiment of the present invention pertains to antenna structures that provide reduced complexity and manufacturing cost.

BACKGROUND

Wi-Fi devices are increasingly used within a variety of residential, commercial, educational, business and industrial environments, for both indoor and outdoor applications. As such, the demand to provide single band and multiband wireless connectivity has significantly increased.

While there is an ever increasing demand to provide such wireless connectivity, the high manufacturing cost and complexity of many current wireless antennas, such as configured for 2G and/or 5G operation, is prohibitive.

As well, many commonly used wireless antennas do not provide acceptable isolation and/or gain characteristics.

Coax feeds are commonly used to feed signals into dipole antenna structures to provide for 2G and/or 5G operation, in which the outer shield of the coax feed is simply connected to half of the dipole, while the central conductor of the coax feed is connected to the other half of the dipole structure. Such connections commonly result in a loss of isolation.

BRIEF DESCRIPTION OF THE DRAWINGS

One or more embodiments of the present invention are illustrated by way of example and not limitation in the figures of the accompanying drawings, in which like references indicate similar elements.

FIG. 15 is a table that summarizes test results for the illustrative quad dipole 2G/5G corner array having a PCB ground slope of 0 degrees, as seen in FIG. 7.

FIG. 19 is a table that provides a matrix of test results for the illustrative 2G/5G corner array seen in FIG. 16, as configured with a PCB ground slope of 10 degrees.

FIG. 23 is a table showing test results for the illustrative 2G/5G corner antenna array shown in FIG. 20, which has a PCB ground slope of 15 degrees.

DETAILED DESCRIPTION

References in this description to "an embodiment", "one embodiment", or the like, mean that the particular feature, function, structure or characteristic being described is included in at least one embodiment of the present invention. Occurrences of such phrases in this specification do not necessarily all refer to the same embodiment. On the other hand, the embodiments referred to also are not necessarily mutually exclusive.

Introduced here are techniques for improved antenna structures, systems, and methods, including corresponding methods of manufacturing.

In an embodiment, 2G/5G antennas are disclosed, including low-cost internal antennas having flat metal dipole construction, which can include a stiffener to support and tune the antenna structure. In some embodiments, external embodiments include quad dipole antenna structures, with broadside or corner arrays.

In another embodiment, isolated multi-band center or end-fed dipole antennas are disclosed, having single-sided PCB or metal-only structures, for operation with at least two distinct frequencies, and can provide RF isolation, such as with an RF trap on the coax cable, or a Balun system.

In a further embodiment, non-DC path or pass-through 2G/5G antennas are also disclosed, which feature 5G traps and either 2G or dual 2G/5G traps, along with discrete matching or distributed matching, and can also provide a DC feed path for LEDs placed at the end of the antenna.

Low profile, flat, and combined dipole and flat antenna vertically polarized omni-directional antennas are disclosed, such as for operation at 915 MHz, which include an open slot driven cavity. Improved construction methods and antenna structures include enhanced thin metal components and low cost, crimp-only construction methods.

In other embodiments, stacked dual and tri-band antennas are also disclosed, including a stacked 2G/5G antenna with axial symmetry between quadrants.

Figure 1:
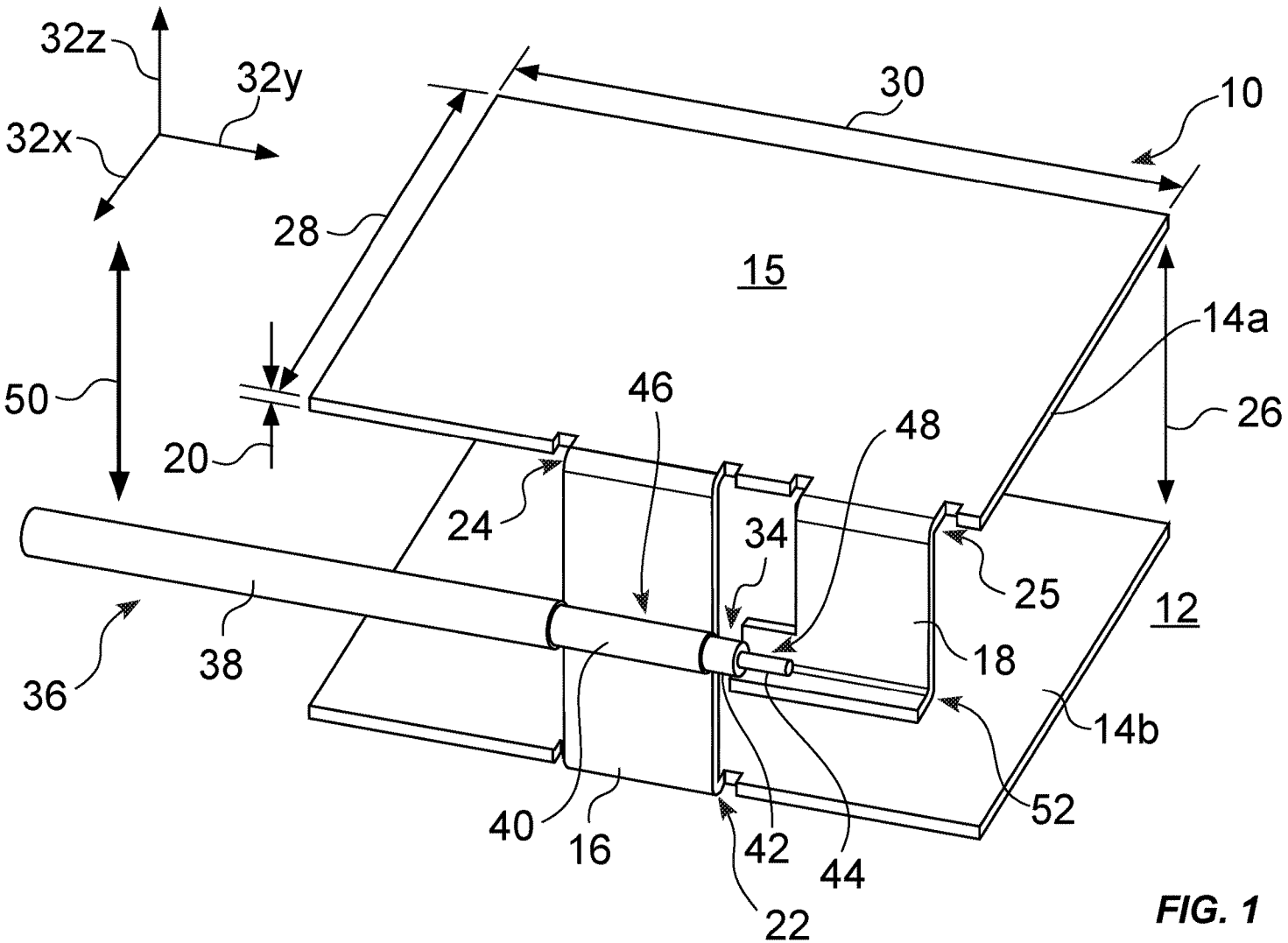
FIG. 1 is a schematic view of an illustrative internal antenna structure for 2G or 5G operation, which can be fabricated from a single metal sheet.

FIG. 1 is a schematic view 10 of an illustrative internal antenna structure 12, such as with respect to orthogonal axes, e.g., an X axis 32*x*, a Y axis 32*y*, and a Z axis 32*z*. The illustrative antenna structure 12 seen in FIG. 1 includes two similarly shaped and sized dipole elements 14*a*,14*b*, such as having a corresponding depth 28 and width 30, which are separated by a distance or height 26. The illustrative antenna structure 12 seen in FIG. 1 can be fabricated from a single metallic sheet 15, e.g., such as comprising copper, in which the dipole elements 14*a* and 14*b* are separated by a central connective region 16. The illustrative antenna structure 12 seen in FIG. 1 also includes an integral feed path 18 that extends from the first dipole element 14*a*, in which the feed path 18 can include bend 25, such as to form a solder pad with which to accurately locate and solder 48 a coaxial cable 36, such as 1.37 mm mini coax cable, available through Taoglas Antenna Solutions.

When fabricated to form the antenna structure 12, the sheet 15 is formed to define a bend 22 between the second dipole element 14*b* and the central region 16, bend 24 between the first dipole element 14*a* and the central region 16 and bend 25 between the first dipole element 14*a* and the feed path 18. The illustrative bends 24 and 25 seen in FIG. 1 are generally aligned to each other, and as such, can simultaneous be formed as a single manufacturing step. As further seen in FIG. 1, a gap 34 is defined between the central region 16 and the feed path 18.

An illustrative embodiment of the antenna structure 12 comprises a planar central region 16 extending vertically, e.g., along the Z-axis 32*z*, from a first end to a second end, a first planar dipole element 14*a* extending orthogonally, e.g., along the X-axis 32*x*, from the first end of the central region 16, and a second planar dipole element 14*b* extending orthogonally from the second end of the central region 16, wherein the first dipole planar element 14*a* and the second planar dipole element 14*b* are coplanar to each other and separated by a separation distance 26, a feed path element 18 that extends orthogonally from any of the first planar dipole element 14*a* or the second planar dipole element 14*b* toward the other of the planar dipole elements (14*a*,14*b*), wherein a feed gap 34 is defined between feed path element 18 and the central region 16, and wherein the antenna structure 12 is formed from a single electrically conductive metallic sheet 15.

The illustrative antenna structure 12 seen in FIG. 1 is configured to be solderably connected to a coaxial cable 36 as shown, which includes outer insulation 38, an outer conductive shield 40, inner insulation 42, and an inner, i.e., central, conductor 44. The illustrative coaxial cable 36 extends longitudinally, e.g., along the Y axis 32*y*, wherein when the coaxial cable 36 is properly prepared to be attached to the antenna structure 12, the conductors 40 and 44 can simultaneously be positioned in respective contact with the central region 16 and with the feed path 18, and can then be respectively soldered at solder points 46 and 48.

In some embodiments, the illustrative antenna structure 12 can provide low profile top loaded dipoles or slots. In some embodiments, the antenna structure 12 can be configured to provide band coverage of 2.40 GHz to 2.49 GHz, 4.9 GHz to 5.3 GHz, or 5.7 GHz to 5.9 GHz.

In some embodiments, total cost to manufacture the illustrative antenna structure 12 can be very low. For instance, the antenna structure 12 can be fabricated from a single preformed sheet 15, which can then be formed to simultaneously define the desired geometry, such as including opposing coplanar dipole elements 14*a*,14*b*, feed path 18, gap 34, and pad 70 (FIG. 3) for locating a central conductor 44.

In some embodiments, the illustrative antenna structure 12 seen in FIG. 1 is fabricated from a metallic sheet 15 having a thickness 20 of 0.40 mm, to form opposing rectangular dipole elements 14*a*,14*b*, each having depths 28 of 19.00 mm and widths 30 of 20.20 mm, in which the central region 16 is formed to define a height 26 of 10.80 mm between the rectangular dipole elements 14*a* and 14*b*. In such a configuration, the illustrative internal antenna structure 12 can provide band coverage of 2.40 GHz to 2.49 GHz, such as to be rated at 2.45 GHz, and can meet the required frequency coverage with a voltage standing wave ratio (VSWR) of less than 2:1, to improve the matching of the antenna 12 to the transmission line, and to maximize power delivery to the antenna, i.e., minimizing reflection from the antenna 12.

Figure 2:
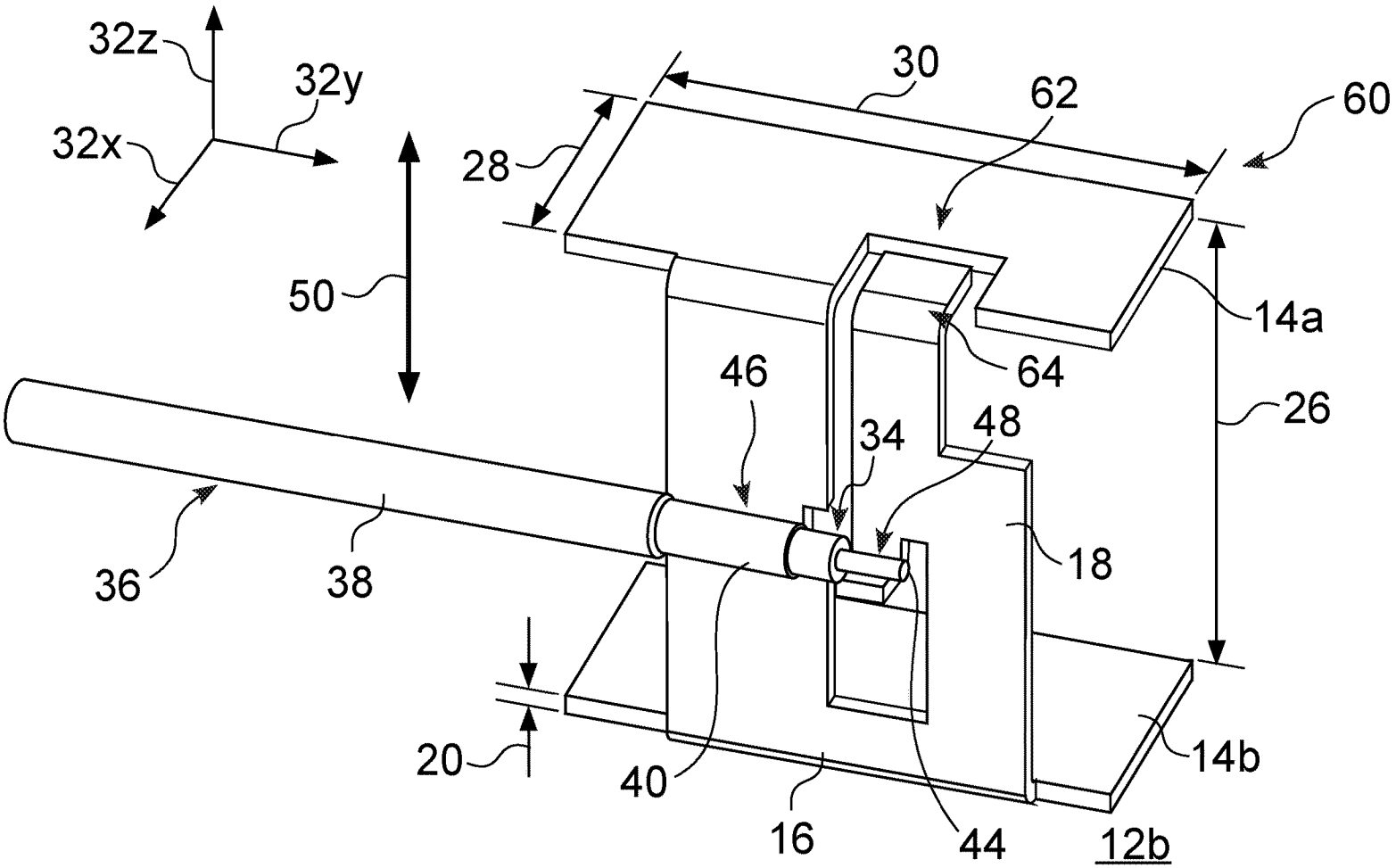
FIG. 2 is a schematic view of an alternate illustrative internal antenna structure for 5G operation that can be fabricated from sheet metal, and provides an integrated shunt capacitor and corresponding inductor.

FIG. 2 is a schematic view 60 of an alternate illustrative internal antenna structure 12*b*, which additionally provides a shunt capacitor 62 structure and a corresponding inductor 64 that are formed during fabrication, such as to increase the operational bandwidth of the internal antenna structure 12*b*.

In some embodiments, the illustrative antenna structure 12*b* seen in FIG. 2 is fabricated from a metallic sheet 15 having a thickness 20 of 0.40 mm, to form opposing rectangular dipole elements 14*a*,14*b*, each having depths 28 of 6.60 mm and a widths 30 of 11.00 mm, in which the central region 16 is formed to define a height 26 of 10.80 mm between the rectangular dipole elements 14*a* and 14*b*. In such a configuration, the illustrative internal antenna structure 12*b* can provide band coverage of 4.9 GHz to 5.3 GHz, or nominally rated at 5.1 GHz. In such an embodiment of the illustrative internal antenna structure 12*b* that includes a shunt capacitor 62 structure and a corresponding inductor as shown, the bandwidth of the internal antenna structure 12*b* can be increased by about 500 MHz, such as to provide band coverage of 4.9 GHz to 5.9 GHz, or to be nominally rated at 5.4 GHz.

Figure 3:
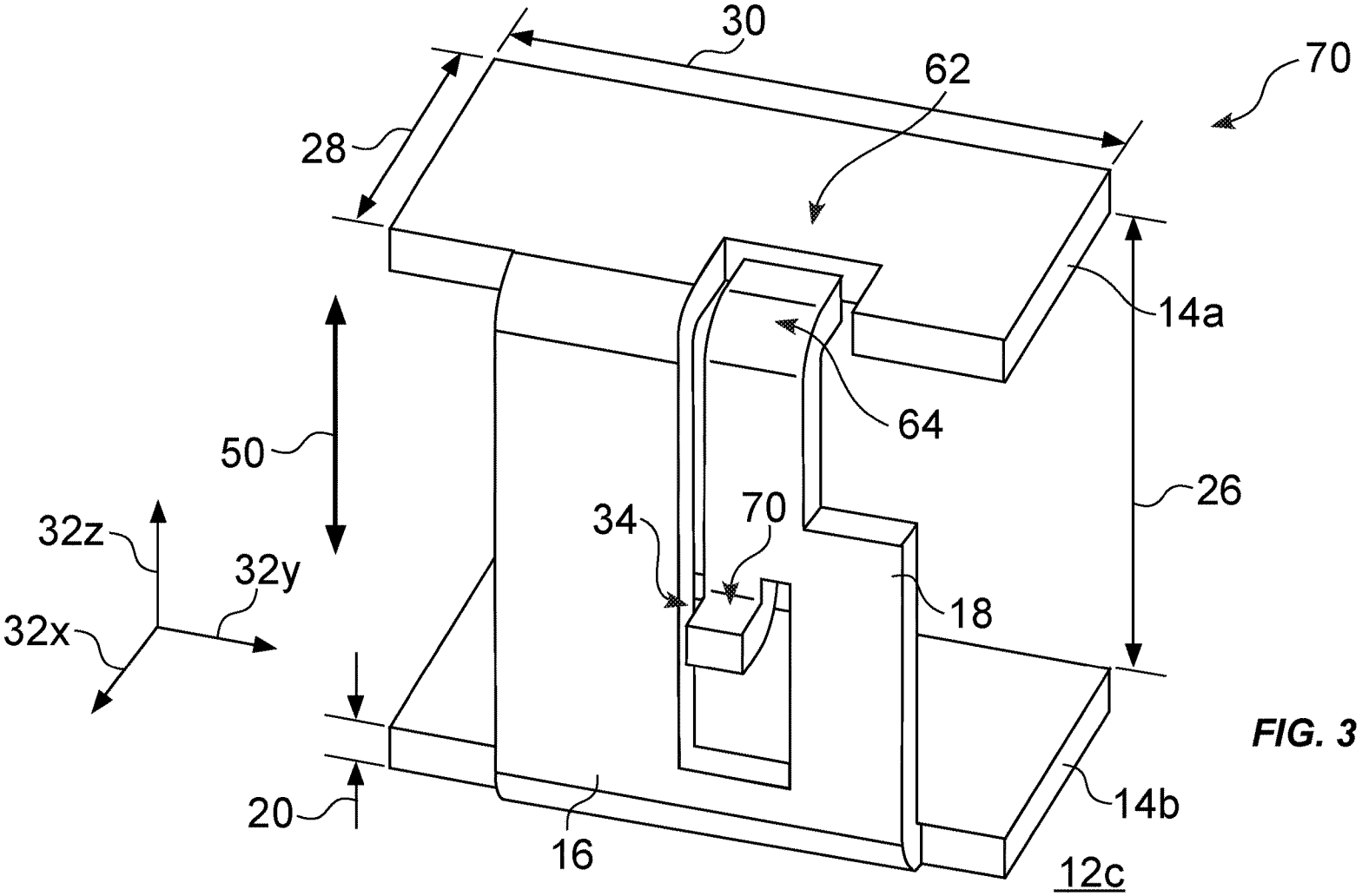
FIG. 3 is a schematic view of a further illustrative internal antenna structure for 5G operation that can be fabricated from a single metal sheet, and provides an integrated shunt capacitor and corresponding inductor.

FIG. 3 is a schematic view 70 of a further illustrative internal antenna structure 12*c*, which provides a shunt capacitor 62 structure and a corresponding inductor 64 that can increase the operational bandwidth of the internal antenna structure 12*c*.

In some embodiments, the illustrative antenna structure 12*c* seen in FIG. 3 is fabricated from a metallic sheet 15 having a thickness 20 of 0.80 mm, to form opposing rectangular dipole elements 14*a*,14*b*, each having depths 28 of 7.60 mm and widths 30 of 11.00 mm, in which the central region 16 is formed to define a height 26 of 10.80 mm between the rectangular dipole elements 14*a* and 14*b*. In such an embodiment 12*c*, which also includes a shunt capacitor 62 structure and a corresponding inductor 64 as shown, the bandwidth of the antenna structure 12*b* can nominally be rated at 5.4 GHz.

For embodiments of the internal antenna structure 12*b* and 12*c* as seen in FIG. 2 and FIG. 3, that are nominally rated at 5.4 GHz, the antennas 12*b* and 12*c* can include both bands of the frequency coverage with a voltage standing wave ratio (VSWR) of less than 2:1.

As seen in FIG. 2 and FIG. 3, increasing the thickness 20 of the 5G antennas 12, from a thickness 20 of 0.40 mm for the internal antenna 12*b*, to a thickness 20 of 0.80 mm for the internal antenna 12*c*, only requires increasing the depth 28 from 6.60 mm to 7.60 mm, while the VSWR can remain at less than 2:1.

The internal antenna structures 12, 12*b* and 12*c* seen in FIGS. 1-3 are readily accurately fabricated from single sheets of metal 15, such as by stamping and forming, whereby the antennas can readily meet low cost goals and requirements for manufacturability. As well, the overall size of the antenna structures 12 allows them to be meet the size constraints for a wide variety of wireless devices.

Four Element Array Design and Performance.

Figure 4:
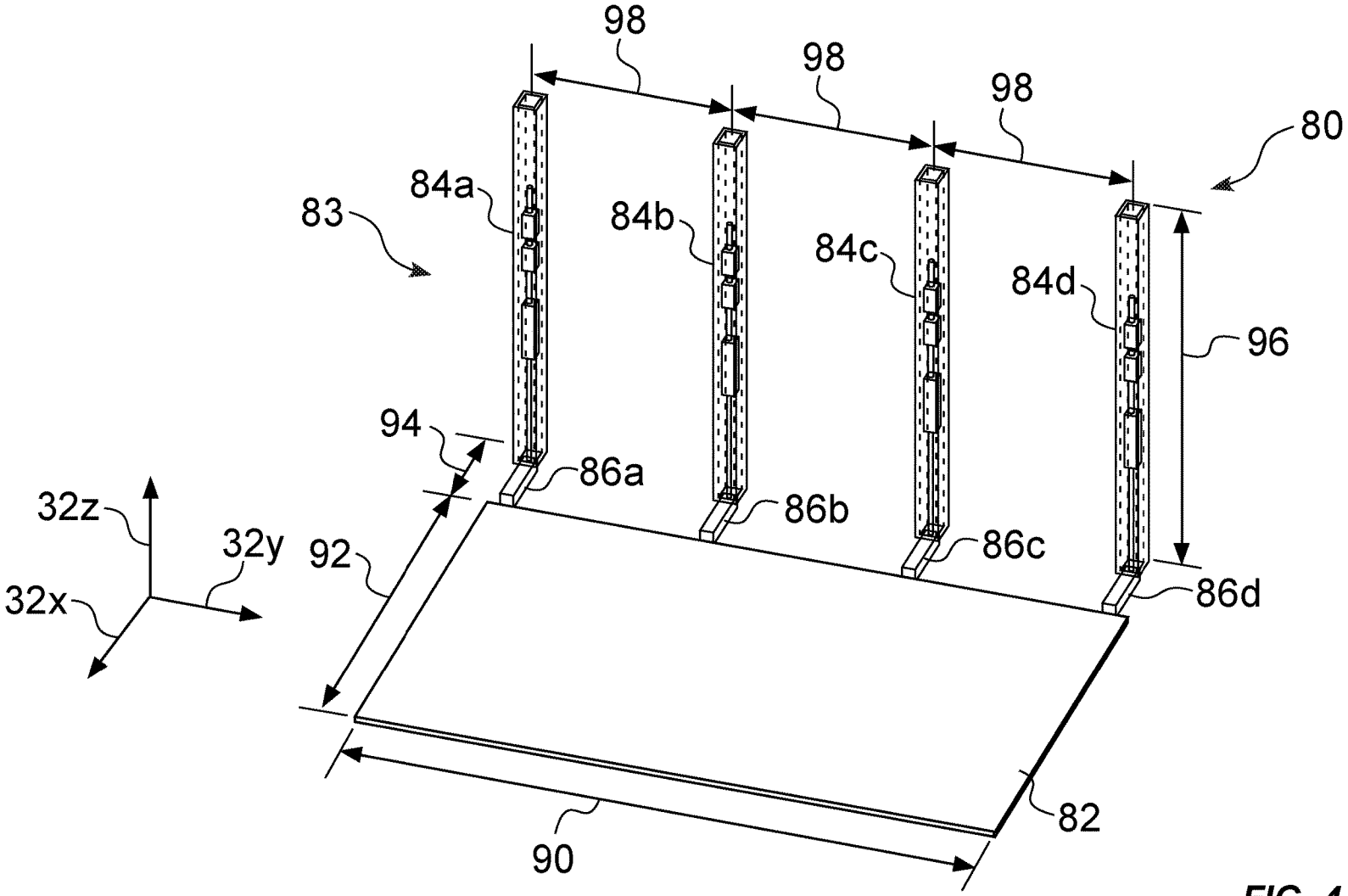
FIG. 4 shows an illustrative embodiment of a four dipole broadside 2G/5G antenna array, which in some embodiments can be configured for a 2G/5G antenna system, while providing signal isolation between each of the antenna elements.

FIG. 4 shows an illustrative embodiment of a four dipole broadside 2G/5G antenna array 80, which in some embodiments can be configured for a 2G/5G antenna system, while providing signal isolation between each of the antenna elements 84*a*-84*d*. The illustrative four dipole broadside 2G/5G antenna array 80 seen in FIG. 4 includes a rectangular printed circuit board (PCB) 82, such as coplanar with respect a plane defined by the X axis 32*x* and the Y axis 32*y*.

An illustrative embodiment of the four dipole broadside dual-band antenna structure 80 comprises a generally rectangular printed circuit board (PCB) 82 having a longitudinal side 90 corresponding thereto, and an antenna array 83 including four antennas 84 that are respectively connected to and extending vertically, e.g., along Z-axis 32*z*, by a height 96 from the longitudinal side of the PCB 82, wherein the four antennas 84 include a first antenna 84*a*, a second antenna 84*b*, a third antenna 84*c* and a fourth antenna 84*d*, wherein the antennas are arranged in a linear broadside sequence, wherein each of the antennas 84 is separated from neighboring antennas 84 by a separation distance 98, and wherein the dual band includes a 2 GHz frequency band and a 5 GHz frequency band.

In the illustrative four dipole broadside 2G/5G antenna array 80 seen in FIG. 4, the PCB 82 has a width 90, e.g., 271 mm, and a depth 92, e.g., 170 mm. The illustrative antenna elements 84*a*-84*d* seen in FIG. 4 extend vertically to a height 96, e.g., 170 mm, and are connected to the PCB 82 by respective conductors 86*a*-86*d* that extend, such as along axis 32*x*, by a distance 94, e.g., 30 mm. In an illustrative embodiment, the antenna elements 84 are separated from neighboring elements by a distance 98, e.g., 85 mm.

Figure 5:
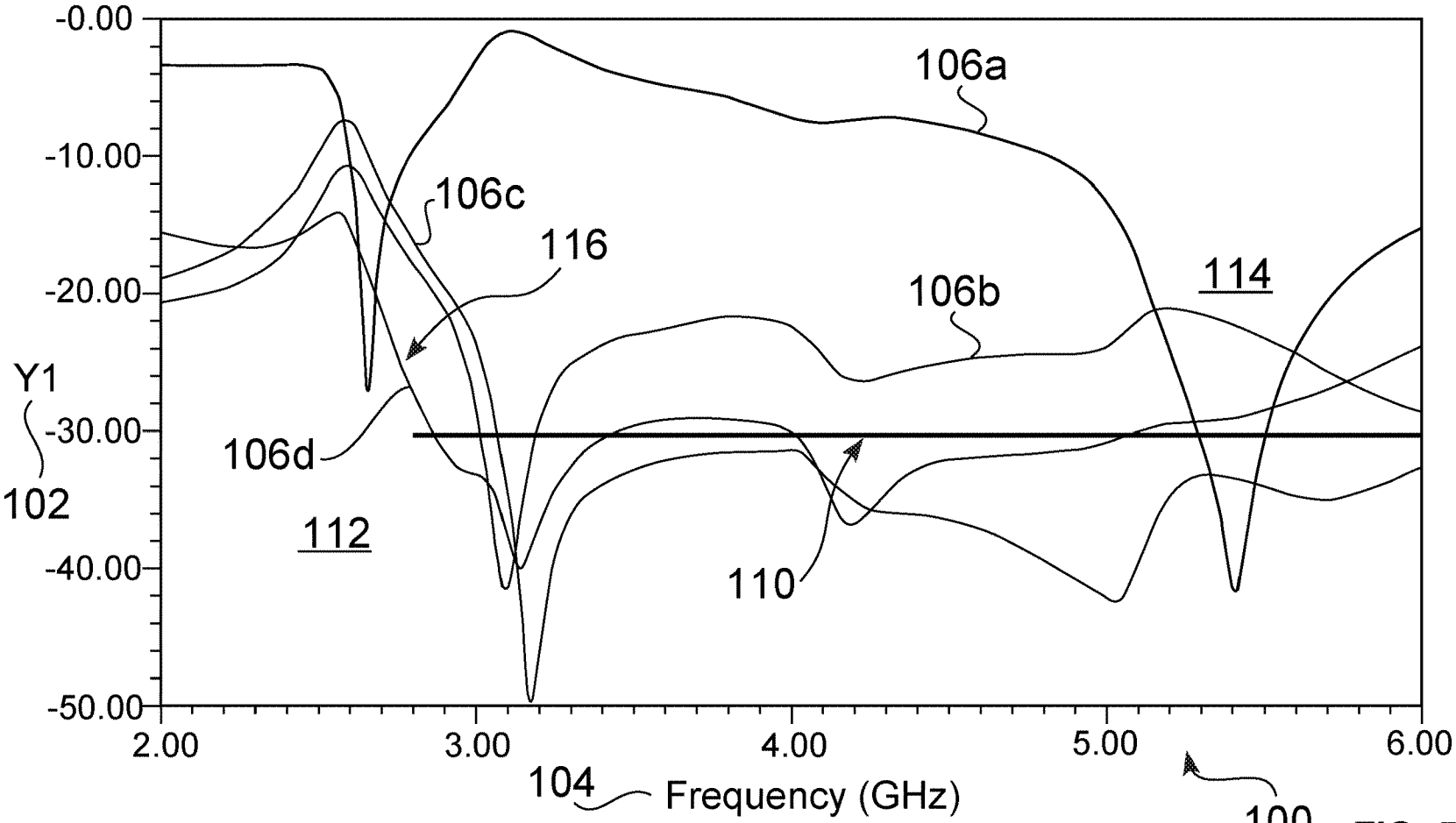
FIG. 5 is a chart showing reflection coefficients as a function of frequency, such as in relation to a 30 dB isolation line, for a four dipole broadside 2G/5G antenna array.
Figure 6:
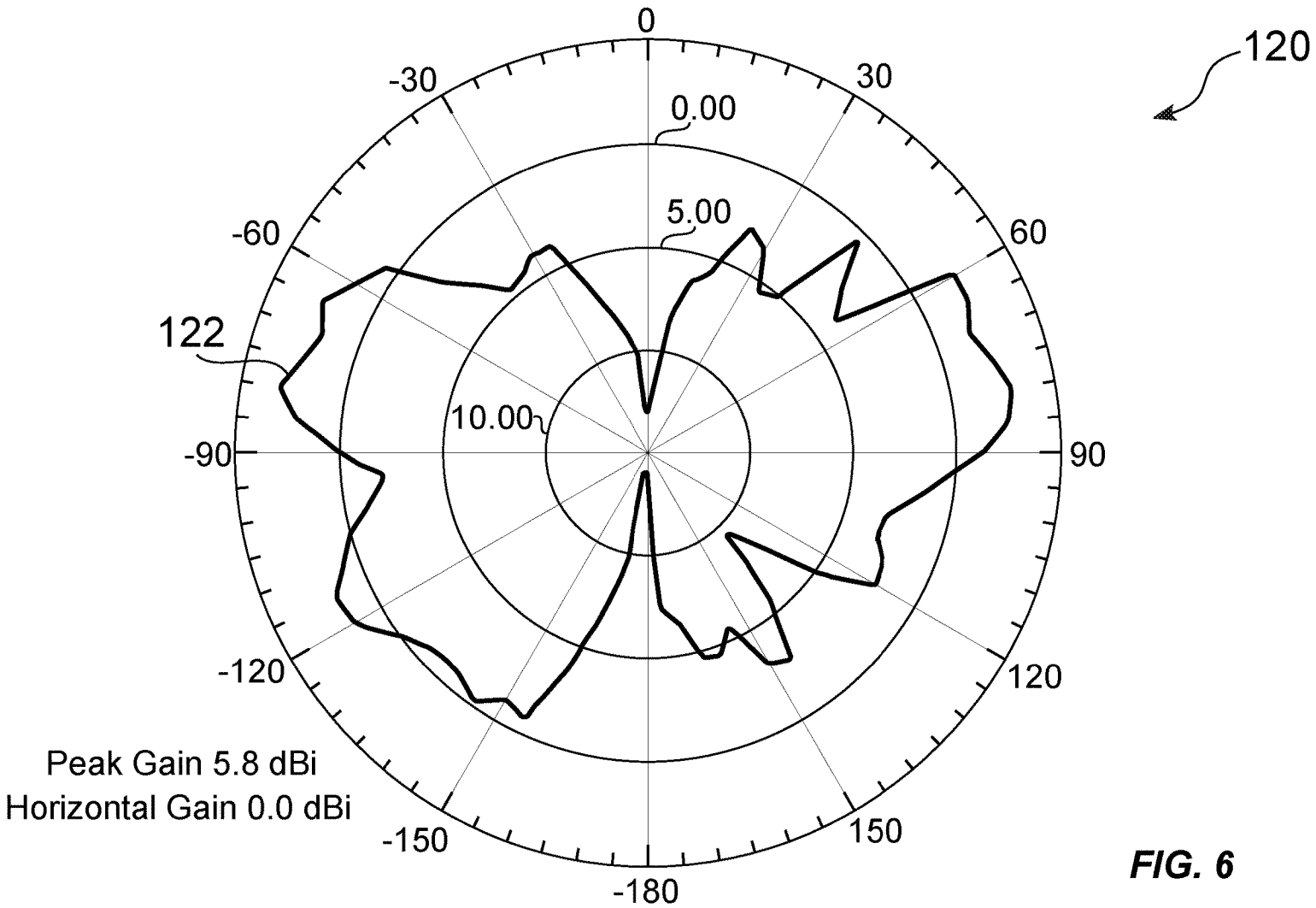
FIG. 6 is a chart that shows a 2D beam radiation pattern of an illustrative embodiment of a four dipole broadside 2G/5G antenna array.

FIG. 5 and FIG. 6 show illustrative analysis and testing of an illustrative embodiment of a four dipole broadside 2G/5G antenna array 80, such as seen in FIG. 4, to consider isolation performance of the four dipole broadside 2G/5G antenna array 80, and to determine if there is a useful configuration that can provide an isolation of at least 30 dB.

For example, FIG. 5 is a chart 100 showing reflection coefficient (Y1) 102 as a function of frequency 104 for each of four configurations 106*a*-106*d*, such as in relation to a 30 dB isolation line 110. Within the 2G region 112, the impact 112 of the PCB ground reflection is indicated, and it can also be seen that additional tuning would be required to provide an isolation of at least 30 dB. The impact on the reflection coefficient is also indicated for the 5G region 114.

FIG. 6 is a chart 120 that shows a 2D beam radiation pattern 122 of an illustrative embodiment of a four dipole broadside 2G/5G antenna array 80, such as seen in FIG. 4, for operation at 5.4 GHz, in which Phi=90 degrees. As seen in FIG. 6, the configuration as tested provides a peak gain of 5.8 dBi, and a horizontal gain of 0.0 dBi.

The test results of the four dipole broadside 2G/5G antenna 80, that includes a line array 83 comprising antenna elements 84*a*-84*d*, such as seen in FIG. 4, show that the vertical beam pattern is at or near maximum in the horizontal plane at 5G. While the 5G isolation at 85 mm is too small, at 170 mm and 255 mm, the 5G isolation is very close to the required 30 dB. It is also observed that the ground reflection at 5G helps slightly, while the 2G isolation is short of the 30 db isolation 110 at any of the spacings, and suffers from PCB reflection 112.

The four dipole broadside 2G/5G antenna array 80 can readily be used for a wide variety of antenna systems. In some embodiments, the four dipole broadside 2G/5G antenna array 80 can be configured to provide an isolation of at least 30 dB.

Figure 7:
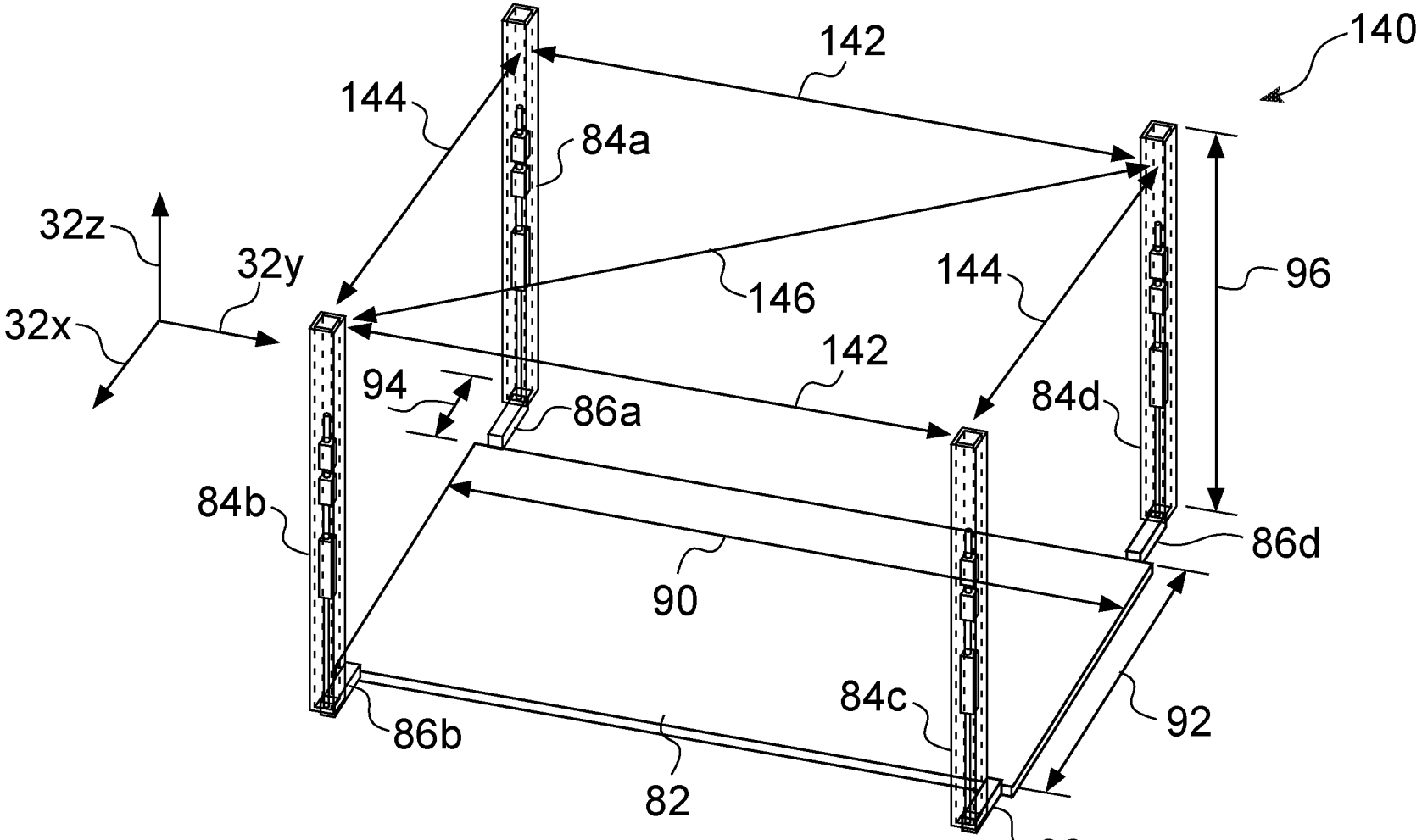
FIG. 7 shows an illustrative embodiment of a quad dipole 2G/5G corner antenna array, having a PCB ground slope of 0 degrees.

FIG. 7 shows an illustrative embodiment of a quad dipole 2G/5G corner antenna array 140, which in some embodiments can be configured for an external 2G/5G antenna system, while providing signal isolation between each of the antenna elements 84*a*-84*d*. The illustrative quad dipole 2G/5G corner antenna array 140 seen in FIG. 7 includes a central rectangular printed circuit board (PCB) 82, such as coplanar with respect a plane defined by the X axis 32*x* and the Y axis 32*y*. In the illustrative quad dipole 2G/5G corner antenna array 140 seen in FIG. 7, the PCB 82 has a width 90, e.g., 271 mm, and a depth 92, e.g., 170 mm. The illustrative antenna elements 84*a*-84*d* seen in FIG. 7 extend vertically, to a height 96, e.g., 170 mm, and are connected to the PCB 82 by respective conductors 86*a*-86*d* that extend, such as along X axis 32*x*, by a distance 94, e.g., 30 mm.

An illustrative embodiment of the quad dipole dual-band antenna structure comprises a generally rectangular printed circuit board (PCB) 82 having four corners corresponding thereto, and an antenna array 140 including four antennas 84*a*-84*d* that are respectively connected to and extending vertically by a height from each of the four corners of the PCB 82, wherein the four antennas include a first antenna 84*a*, a second antenna 84*b*, a third antenna 84*c* and a fourth antenna 84*d*, wherein a length 142 of the antenna array 140 is defined between the first antenna 84*a* and the fourth antenna 84*d*, and between the second antenna 84*b* and the third antenna 84*c*, wherein a width 144 of the antenna array 140 is defined between the first antenna 84*a* and the second antenna 84*b*, and between the fourth antenna 84*d* and the third antenna 84*c*, and wherein a diagonal distance 146 of the antenna array 140 is defined between the first antenna 84*a* and the third antenna 84*c*, and between the second antenna 84*b* and the fourth antenna 84*d*.

The illustrative antenna elements 84*a*-84*d* seen in FIG. 7 define a rectangle having a length 142 of 255 mm, a width 144 of 224.34 mm, and a diagonal 146 of 339.64 mm.

Figure 8:
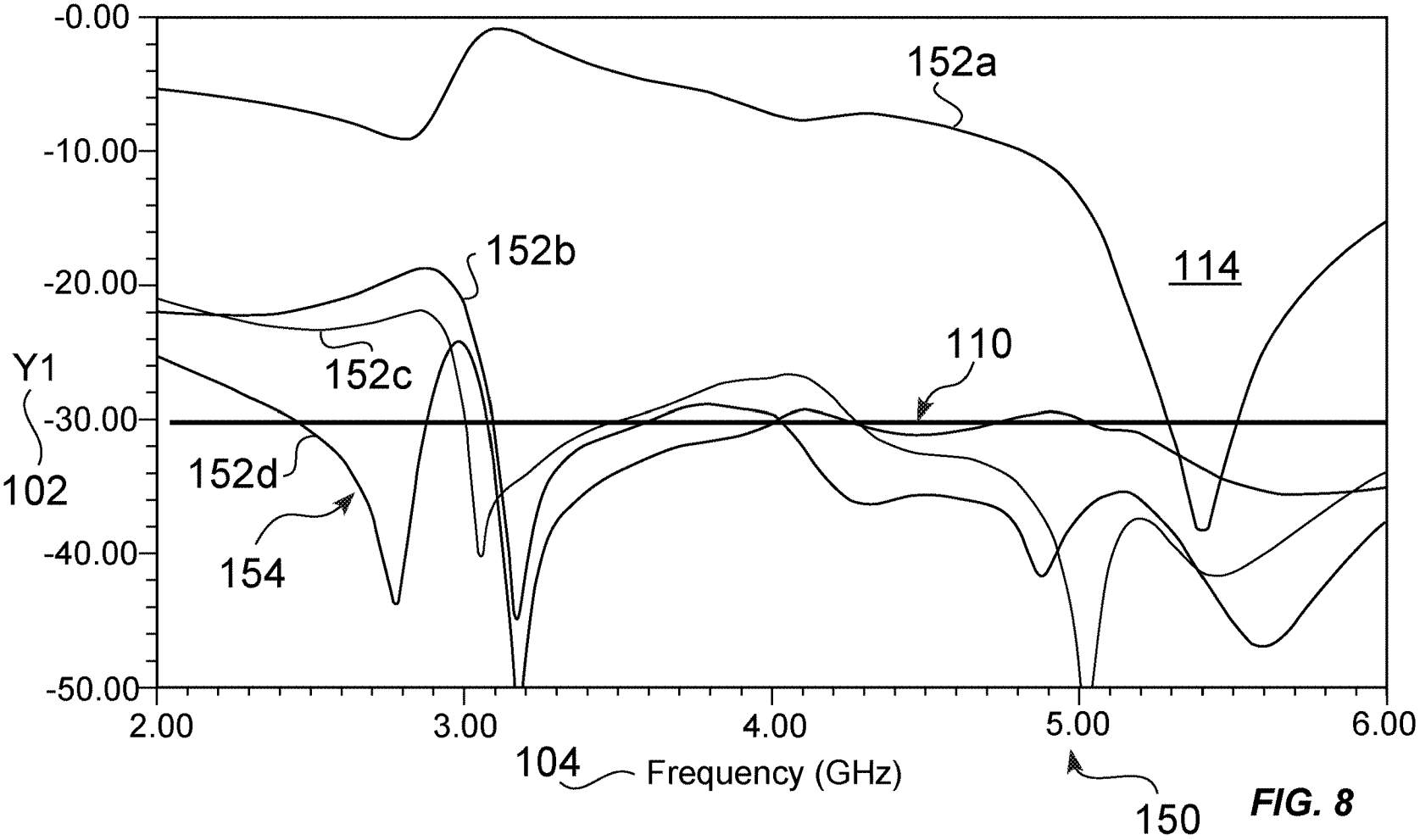
FIG. 8 is a chart showing reflection coefficients as a function of frequency between different antenna elements of a four dipole broadside 2G/5G antenna array.
Figure 9:
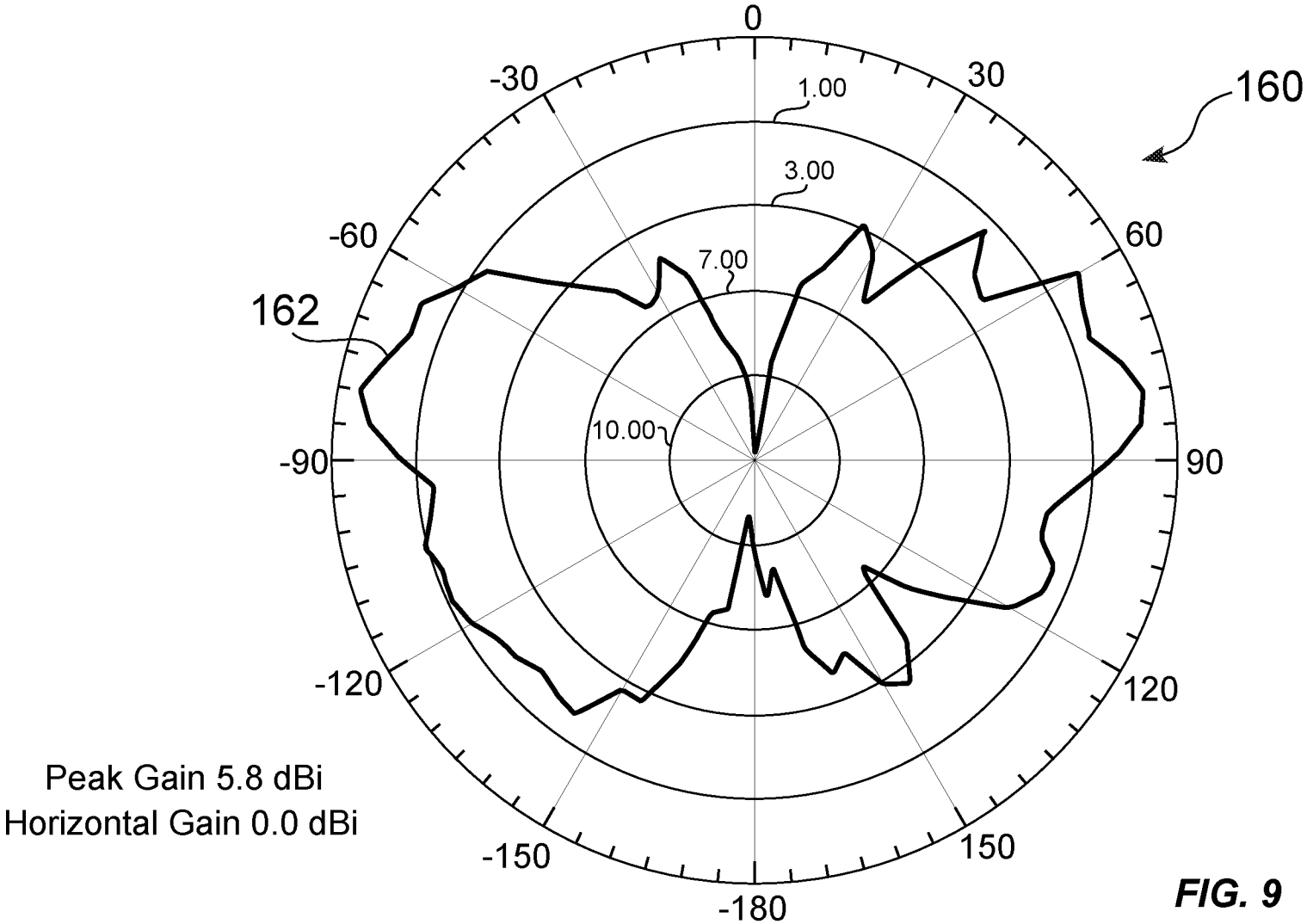
FIG. 9 is a chart that shows a 2D beam radiation pattern of an illustrative embodiment of a quad dipole 2G/5G corner antenna array.

FIG. 8 and FIG. 9 show testing and analysis of an illustrative embodiment of a quad dipole 2G/5G corner antenna array 140 as seen in FIG. 7, such as to consider isolation performance of the quad dipole 2G/5G corner antenna array 140, and to determine if there is a useful configuration that can provide an isolation of at least 30 dB.

For example, FIG. 8 is a graph 150 showing reflection coefficients 102 as a function of frequency 104 between different antenna pairs of a four dipole broadside 2G/5G antenna array 140 (FIG. 4), as indicated by 152*a*-152*d*, such as in relation to a 30 dB isolation line 110. For example, line 152*a* is based on a single antenna element, e.g., 84*a* (S1,1), line 152*b* is based on antennas 84*a* and 84*b* (or 84*c* and 84*d*) having a spacing 144, a line 152*c* is based on antennas 84*a* and 84*d* (or 84*b* and 84*c*) having a spacing 142, and a line 152*d* is based on antennas 84*a* and 84*c* (or 84*b* and 84*d*) having a spacing 146. FIG. 15 is a table 220 that provides a matrix of the test results for the illustrative 2G/5G corner array 84*a*-84*d*, as configured with a PCB ground slope of 0 degrees.

Within the 2G region, a null 154 due to the PCB ground reflection is indicated for 152*d*, and it can also be seen that additional tuning would be required for some configurations 152 to provide an isolation of at least 30 dB. The impact on the reflection coefficient is also indicated for the 5G region 114. As seen in FIG. 8, line 152*d* provides optimum reflection coefficient performance between diagonal antenna pair 84*a* and 84*c*, and between diagonal antenna pair 84*b* and 84*d*.

FIG. 9 is a chart 160 that shows a 2D beam radiation pattern 162 of an illustrative embodiment of a quad dipole 2G/5G corner antenna array 140 as seen in FIG. 7, for operation at 5.4 GHz, in which Phi=90 degrees, for a peak gain of 5.8 dBi, and a horizontal gain of 0.0 dBi.

Figure 10:
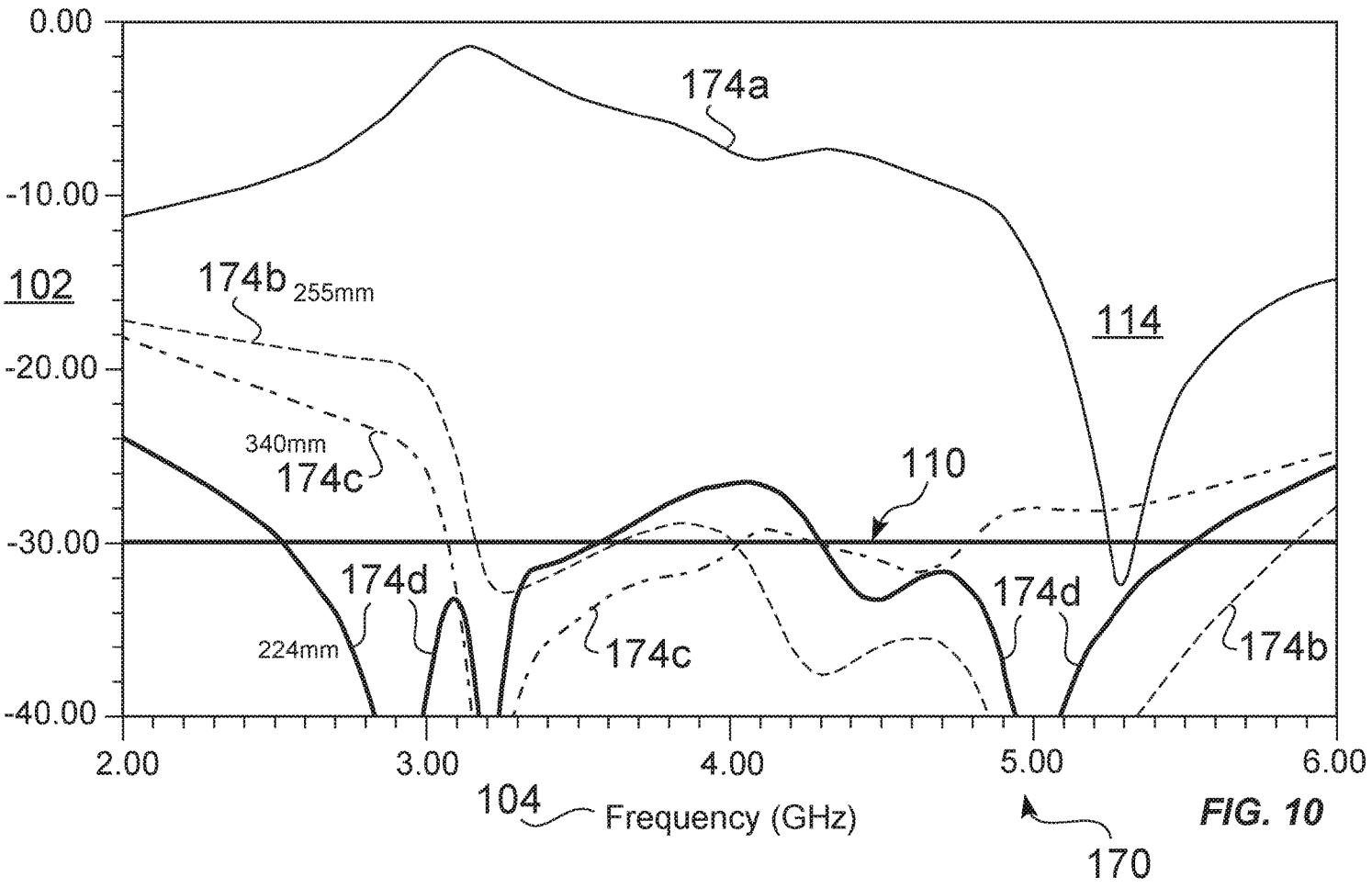
FIG. 10 is a chart showing 2G rectangular reflection coefficients as a function of frequency between different antenna elements of a quad dipole corner antenna array, for a system rated at 2.45 GHz.

FIG. 10 is a chart 170 showing 2G rectangular reflection coefficients 102 as a function of frequency 104 between different antenna elements 84 of a four dipole broadside antenna array, as shown by 174*a*-174*d*, such as in relation to a 30 dB isolation line 110, for a system rated at 2.45 GHz. For instance, line 174*b* shows simulated performance for an antenna separation of 255 mm, line 174*c* shows simulated performance for an antenna separation of 340 mm, and line 174*d* shows simulated performance for an antenna separation of 224 mm.

Figure 11:
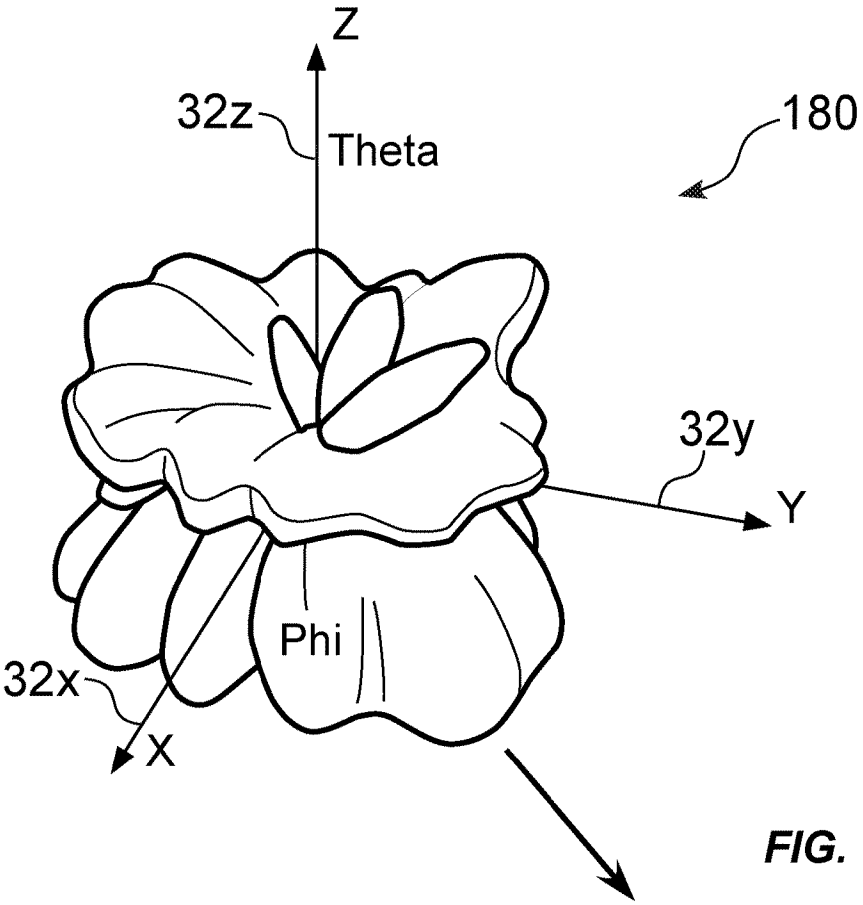
FIG. 11 shows an illustrative three-dimensional (3D) 2.45 GHz beam pattern, for a quad dipole corner antenna array.

FIG. 11 shows an illustrative three-dimensional (3D) 2.45 GHz beam pattern 180, for a rectangular antenna array 140 (FIG. 7), such as looking across a ground plane defined by X-axis 32*x* and Y-axis 32*y*, with theta at 90 degrees, i.e., orthogonal to the ground plane, and aligned with the Z-axis 32*z*.

Figure 12:
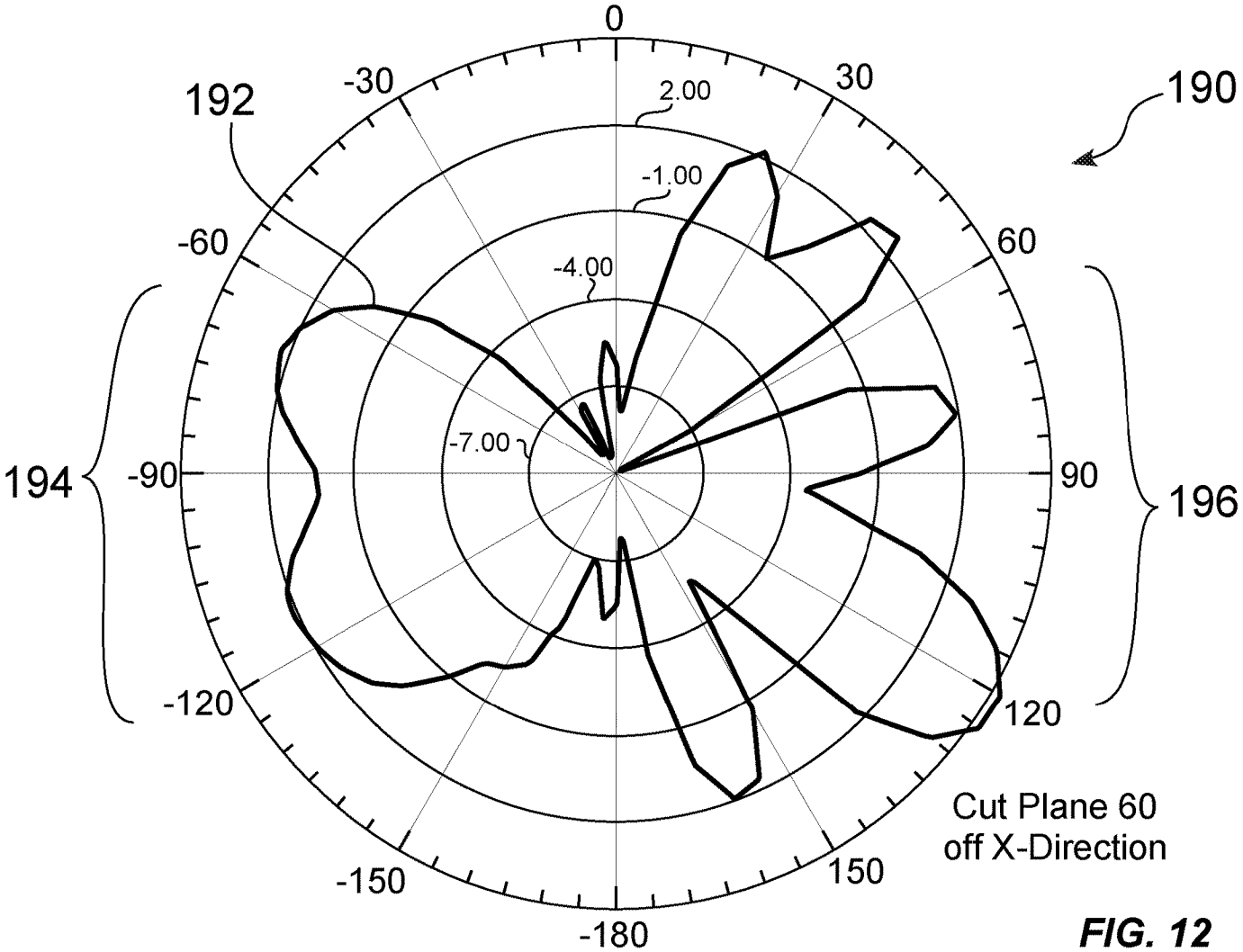
FIG. 12 shows an illustrative vertical radiation pattern for a quad dipole corner antenna array, which shows radiation patterns for both looking away from the center the PCB, as well as looking inward toward the center of the PCB.

FIG. 12 is a graph 190 that shows an illustrative vertical radiation pattern 192 for a rectangular antenna array 140, such as seen in FIG. 7, which indicates both looking away 194 from the center of the PCB 82, as well as looking inward 196 toward the center of the PCB 82.

As a comparison of the performance between the four dipole broadside 2G/5G antenna array 80, having a linear configuration, and that of a quad dipole 2G/5G corner antenna array 140, such as referred to herein as a rectangular configuration, it can be seen that the 5G performance is the same or similar between the configurations 80 and 140. As also seen, the resultant 5G vertical beam pattern is the same or similar between the line formation 80 and the rectangular formation 140, which is due to PCB ground reflection.

However, it can be seen that the 2G performance is substantially different between the line configuration 80 and the rectangular configuration 140, based on the increased distance 142 (FIG. 7) on the long side of the rectangular configurations 140, such as compared with the separation 98 between neighboring antenna elements 84, e.g., between 84*a* and 84*b* as seen in FIG. 4. Therefore, the antenna combination of 84*a* and 84*d*, and the antenna combination of 84*b* and 84*c*, such as seen in FIG. 7, provide the optimum solution for antenna 2G performance, as well as for combined 2G/5G performance.

With regard to specific configurations of the rectangular antenna configurations 140, some minor tuning to length can be used to improve the 2G performance. For 2G operation, the PCB ground plane impacts the inward looking beam pattern 196, such as seen in FIG. 12, which provides the required isolation. As also seen in FIG. 12, the 2G outward looking beam pattern 194 is not impacted by the PCB reflection. In cases, the antennas 84 should be vertical, i.e., aligned with the Z-axis 32*z*.

Figure 13:
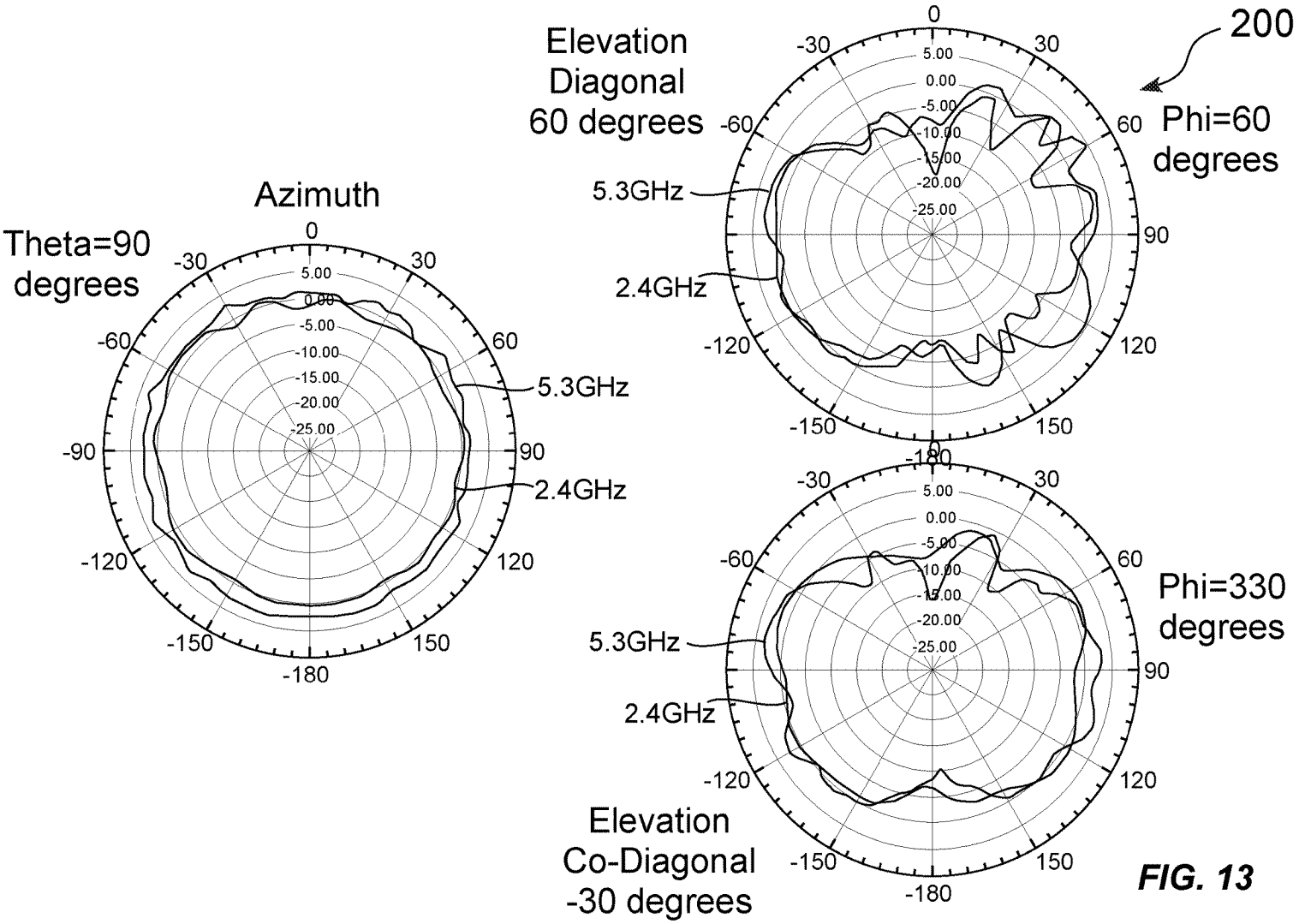
FIG. 13 shows radiation patterns for a quad dipole 2G/5G corner array having a PCB ground slope of 0 degrees, including azimuth, diagonal, and co-diagonal radiation patterns for frequencies of 2.4 GHz and 5.3 GHz.

FIG. 13 shows radiation patterns 200 for a quad dipole 2G/5G corner array 140 having a PCB ground slope of 0 degrees, including azimuth radiation patterns for frequencies of 2.4 GHz and 5.3 GHz, in which Theta=90 degrees, elevation diagonal radiation patterns for frequencies of 2.4 GHz and 5.3 GHz, in which Phi=60 degrees, and elevation co-diagonal radiation patterns for frequencies of 2.4 GHz and 5.3 GHz, in which Phi=330 degrees.

The results are based on an illustrative quad dipole 2G/5G corner array 140, such as seen in FIG. 7, in which the center to center (c/c) distance 144 between antenna elements 84*a* and 84*b* is 224 mm c/c, the distance 146 between antenna elements 84*a* and 84*c* is 340 mm c/c, and the distance 142 between antenna elements 84*a* and 84*d* is 255 mm c/c.

Figure 14:
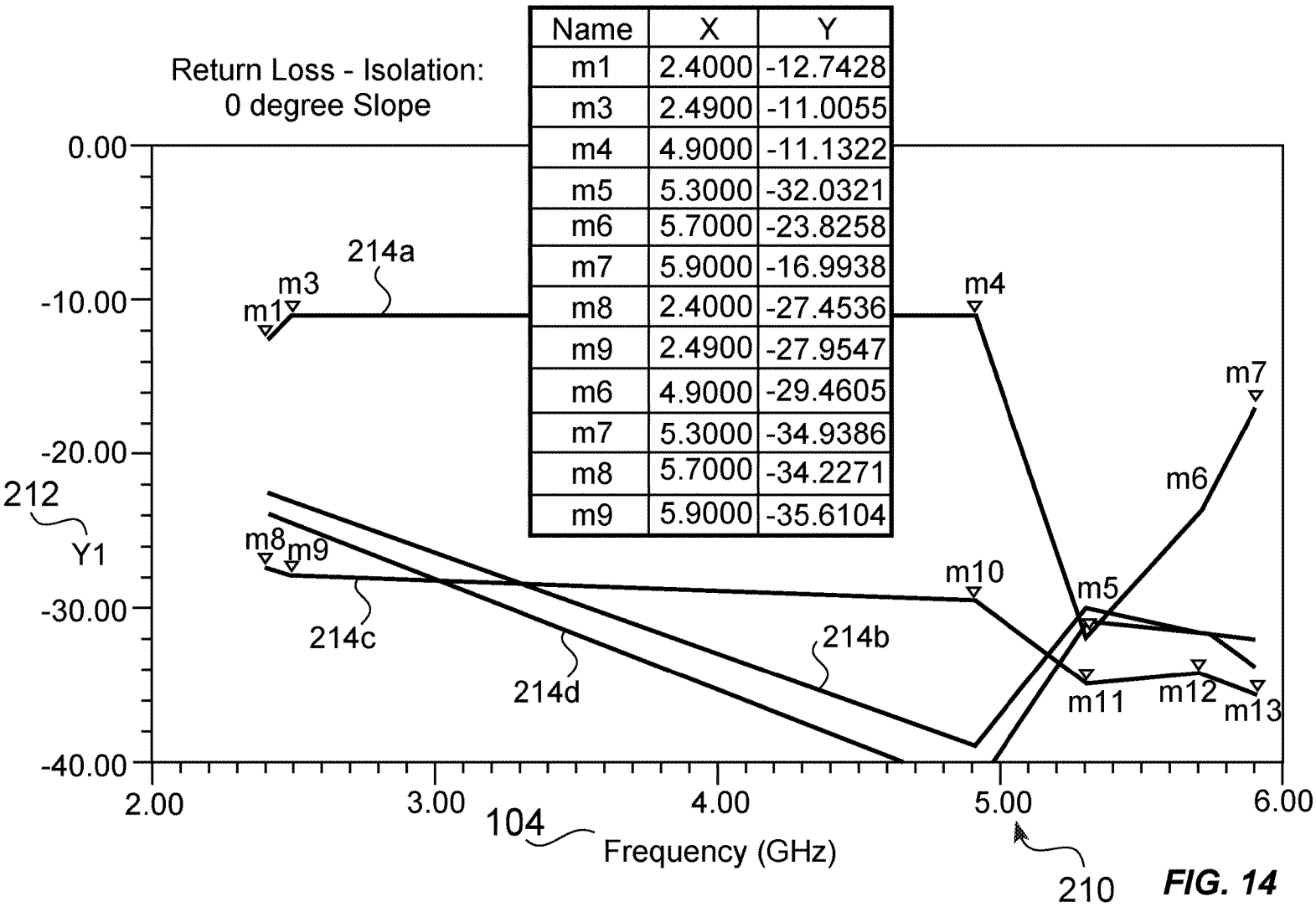
FIG. 14 is a chart that shows return loss/isolation as a function of frequency between the different antenna elements for the illustrative quad dipole 2G/5G corner array having a PCB ground slope of 0 degrees, as seen in FIG. 7.

FIG. 14 is a graph and corresponding chart 210 that shows return loss/isolation 212 as a function of frequency 104 between the different antenna elements 84 for the illustrative 2G/5G corner array 84*a*-84*d* seen in FIG. 7, including line 214*a* for antenna element 84*a*, line 214*b* for antennas 84*a* and 84*b* having a spacing 144 of 224 mm c/c, a line 214*d* for antennas 84*a* and 84*d* having a spacing 142 of 255 mm c/c, and a line 214*c* for antennas 84*a* and 84*c* having a spacing 146 of 340 c/c. FIG. 15 is a table 220 that provides a matrix of the test results for the illustrative 2G/5G corner array 84*a*-84*d*, as configured with a PCB ground slope of 0 degrees.

Figure 16:
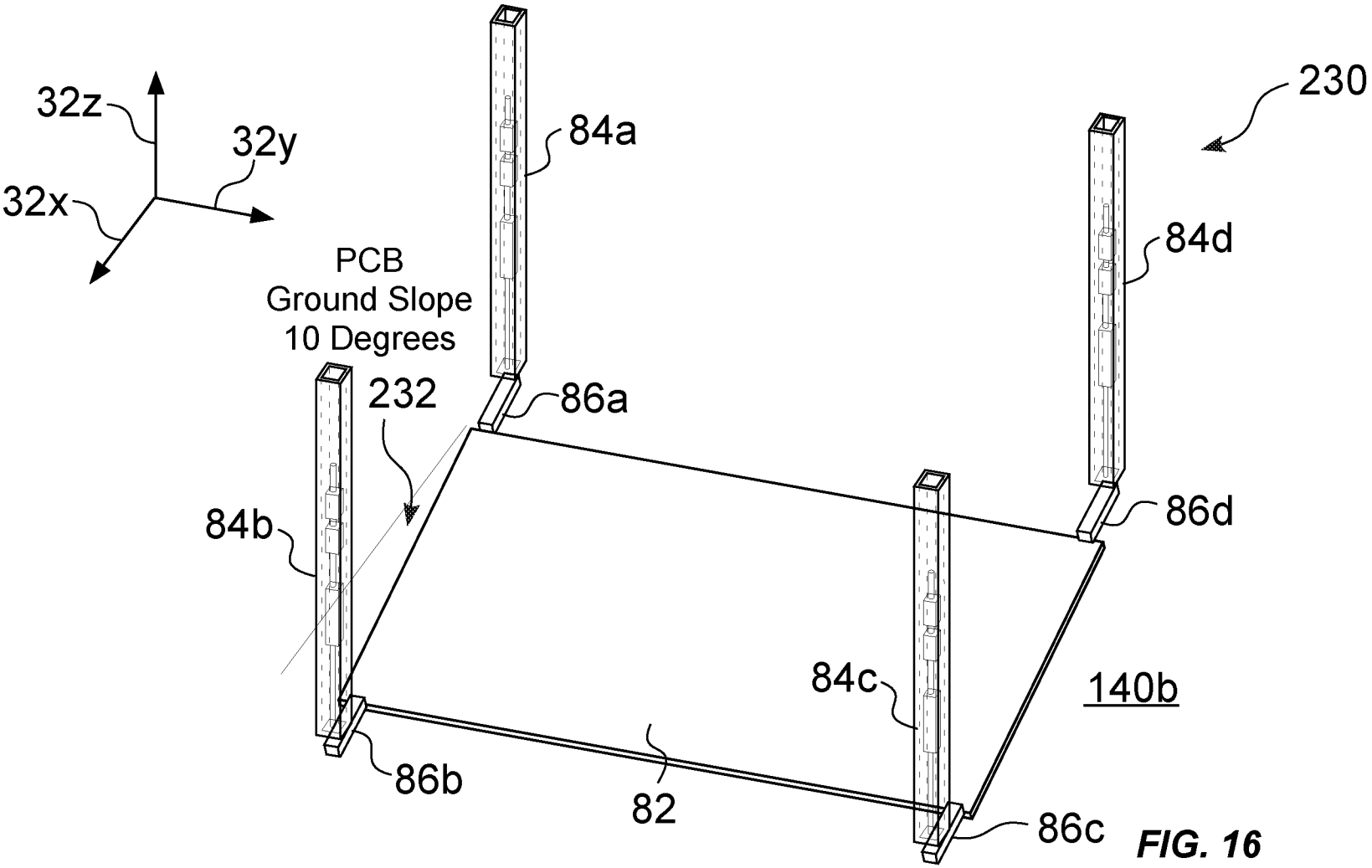
FIG. 16 shows an illustrative embodiment of a quad dipole 2G/5G corner antenna array, in which the array has a PCB ground slope of 10 degrees.

FIG. 16 shows an illustrative embodiment 230 of a quad dipole 2G/5G corner antenna array 140*b*, having antenna elements 84*a*-84*d*, in which the array has a PCB ground slope 232 of 10 degrees. The illustrative antenna elements 84*a*-84*d* seen in FIG. 16 extend from the central PCB 82 by respective conductors 86*a*-86*d*. The illustrative quad dipole 2G/5G corner antenna array 140*b* seen in FIG. 16 has a center to center (c/c) distance 144 between antenna elements 84*a* and 84*b* of 221 mm c/c, a distance 146 between antenna elements 84*a* and 84*c* is 337 mm c/c, and a distance 142 between antenna elements 84*a* and 84*d* of 255 mm c/c.

Figure 17:
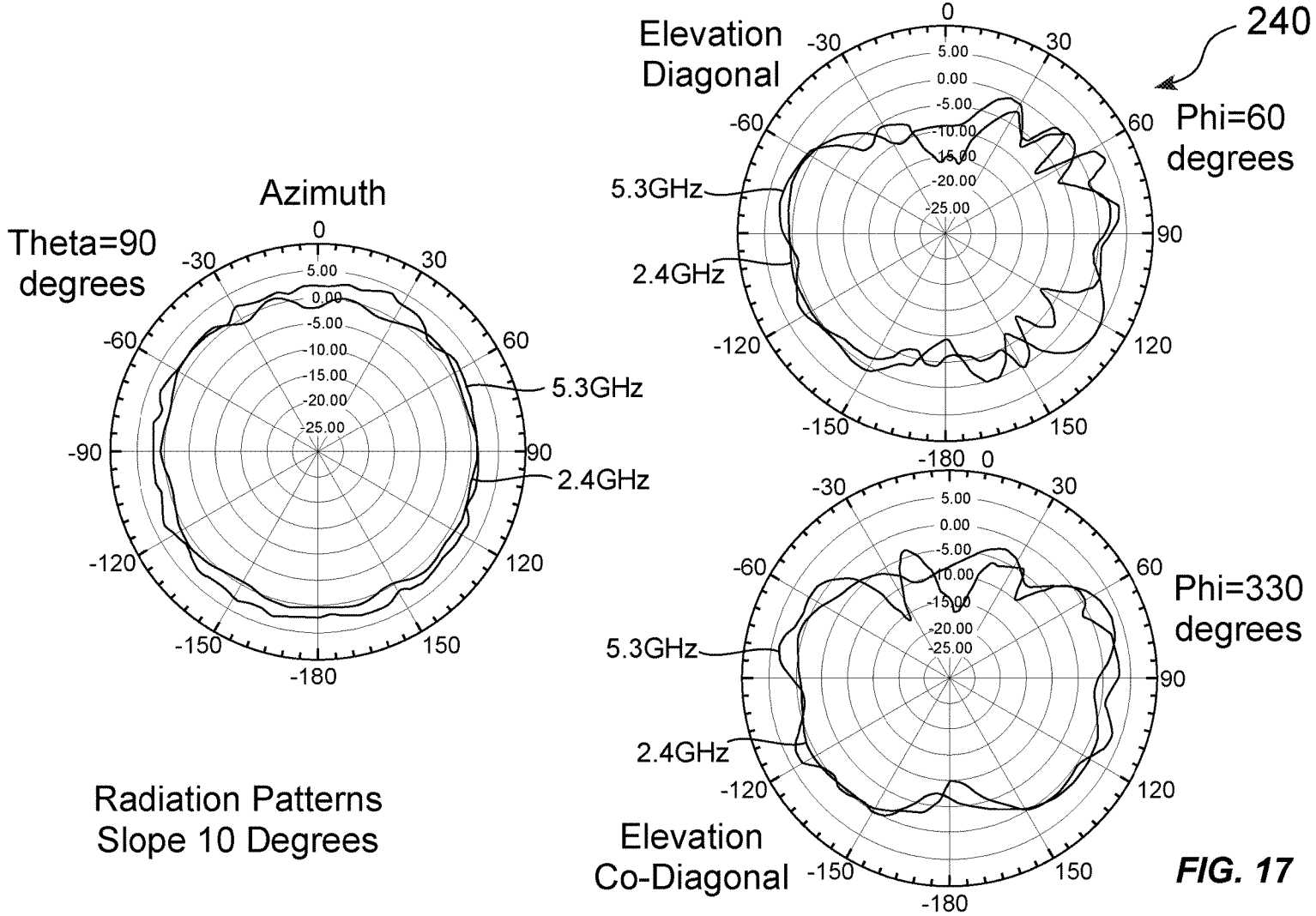
FIG. 17 shows radiation patterns for the quad dipole 2G/5G corner antenna array shown in FIG. 16.

FIG. 17 shows radiation patterns 240 for a quad dipole 2G/5G corner array 140*b* having a PCB ground slope of 10 degrees, including azimuth radiation patterns for frequencies of 2.4 GHz and 5.3 GHz, in which Theta=90 degrees, elevation diagonal radiation patterns for frequencies of 2.4 GHz and 5.3 GHz, in which Phi=60 degrees, and elevation co-diagonal radiation patterns for frequencies of 2.4 GHz and 5.3 GHz, in which Phi=330 degrees. The results are based on an illustrative quad dipole 2G/5G corner array 140*b*, such as seen in FIG. 16.

Figure 18:
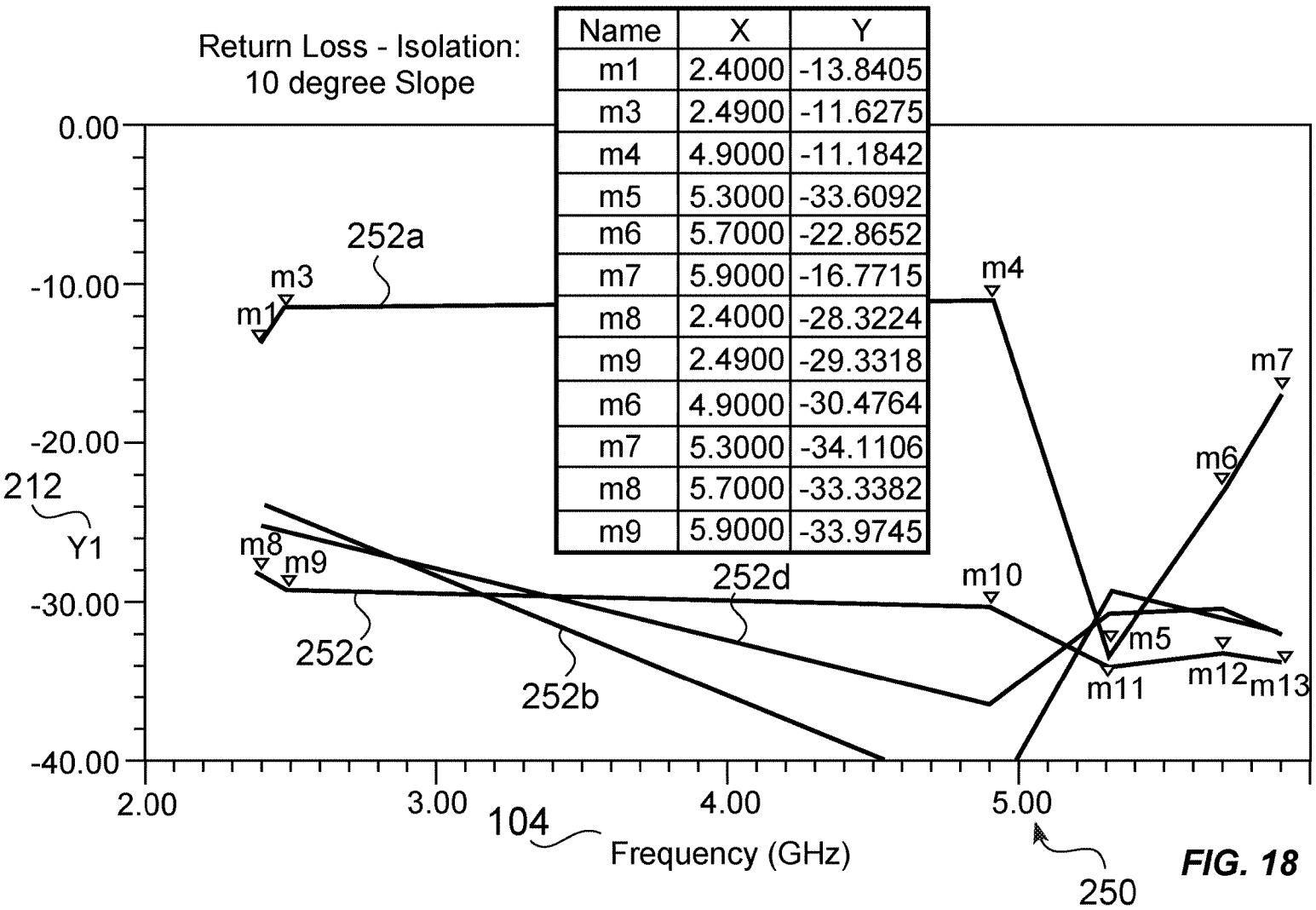
FIG. 18 is a chart that shows return loss/isolation as a function of frequency between the different antenna elements for the illustrative 2G/5G corner antenna array seen in FIG. 16.

FIG. 18 is a chart 250 that shows return loss/isolation as a function of frequency 104 between the different antenna elements 84 for the illustrative 2G/5G corner array 140*b* seen in FIG. 16, including line 252*a* for antenna element 84*a*, line 252*b* for antennas 84*a* and 84*b* having a spacing 144 of 221 mm c/c, line 252*d* for antennas 84*a* and 84*d* having a spacing 142 of 255 mm c/c, and line 252*c* for antennas 84*a* and 84*c* having a spacing 146 of 337 c/c. FIG. 19 is a table 260 that provides a matrix of the test results for the illustrative 2G/5G corner array 140*b*, as configured with a PCB ground slope of 10 degrees.

Figure 20:
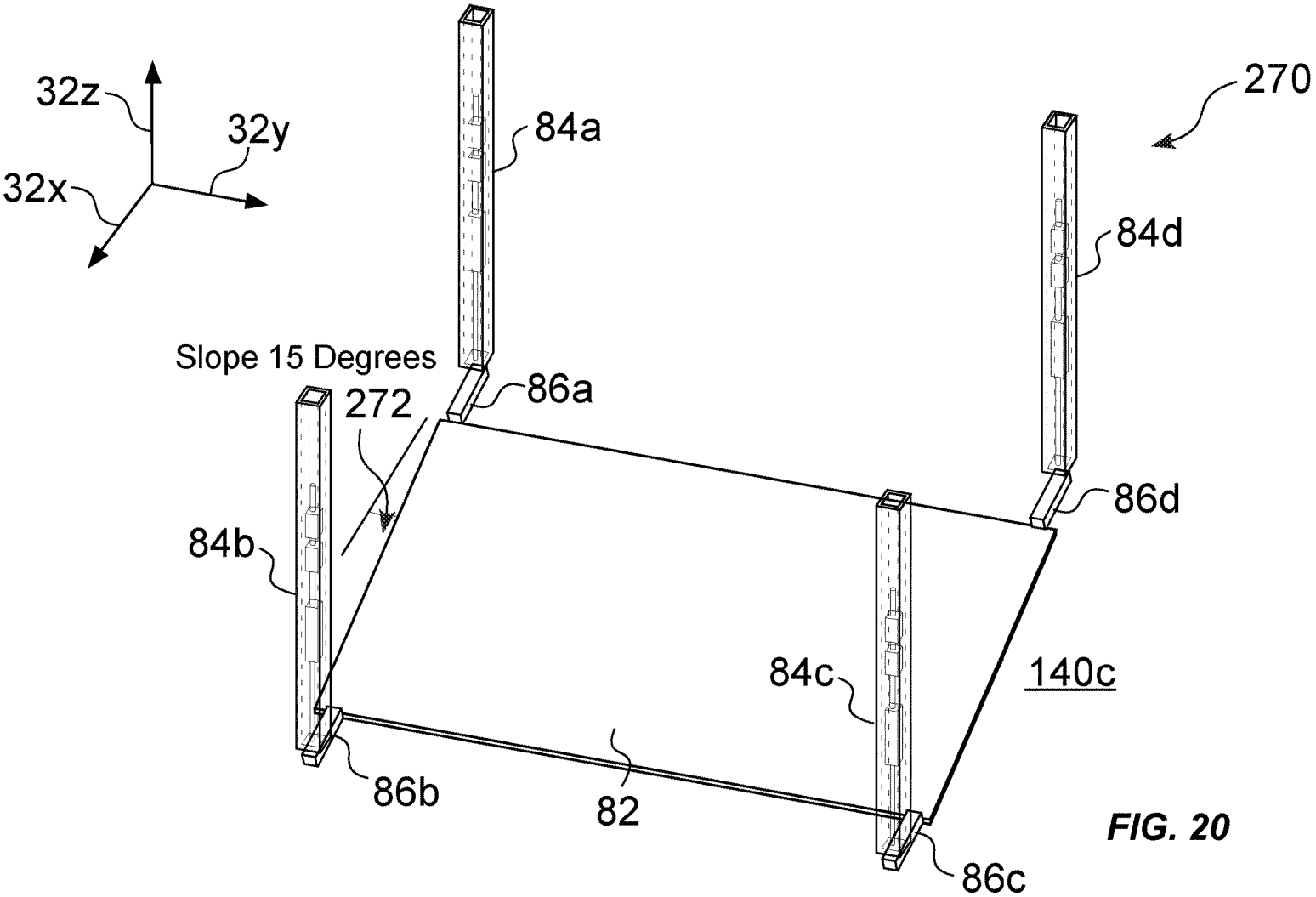
FIG. 20 shows an illustrative embodiment of a quad dipole 2G/5G corner antenna array, which has a PCB ground slope of 15 degrees.

FIG. 20 shows an illustrative embodiment 270 of a quad dipole 2G/5G corner antenna array 140*c*, having antenna elements 84*a*-84*d*, in which the array has a PCB ground slope 272 of 15 degrees. The illustrative antenna elements 84*a*-84*d* seen in FIG. 20 extend from the central PCB 82 by respective conductors 86*a*-86*d*. The illustrative quad dipole 2G/5G corner antenna array 140*c* seen in FIG. 20 has a center to center (c/c) distance 144 between antenna elements 84*a* and 84*b* of 216 mm c/c, a distance 146 between antenna elements 84*a* and 84*c* is 334 mm c/c, and a distance 142 between antenna elements 84*a* and 84*d* of 255 mm c/c.

Figure 21:
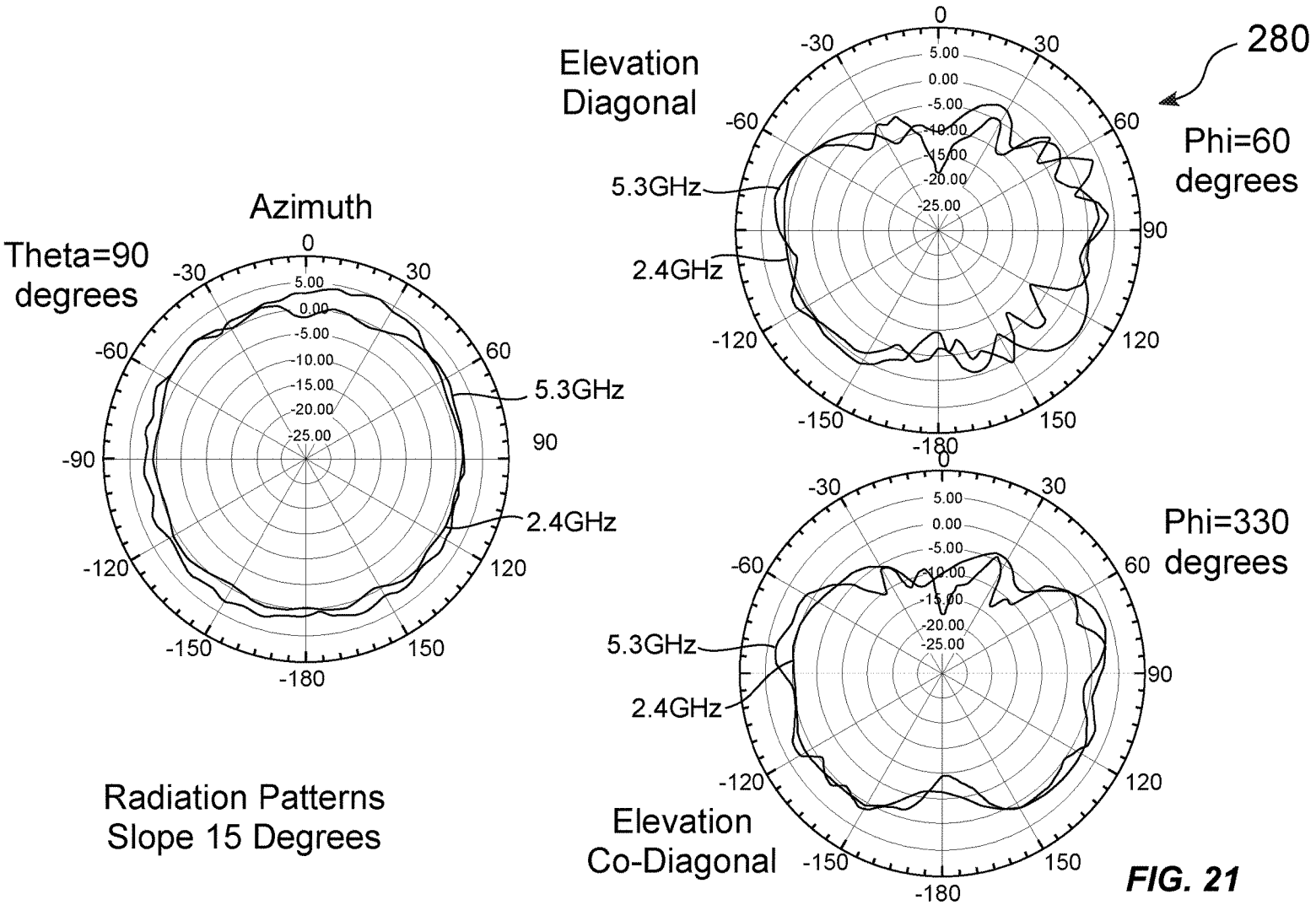
FIG. 21 shows radiation patterns for a quad dipole 2G/5G corner antenna array having a PCB ground slope of 15 degrees, as shown in FIG. 20.

FIG. 21 shows radiation patterns 280 for a quad dipole 2G/5G corner array 140*c* having a PCB ground slope of 15 degrees, including azimuth radiation patterns for frequencies of 2.4 GHz and 5.3 GHz, in which Theta=90 degrees, elevation diagonal radiation patterns for frequencies of 2.4 GHz and 5.3 GHz, in which Phi=60 degrees, and elevation co-diagonal radiation patterns for frequencies of 2.4 GHz and 5.3 GHz, in which Phi=330 degrees. The results are based on an illustrative quad dipole 2G/5G corner array 140*c*, such as seen in FIG. 20.

Figure 22:
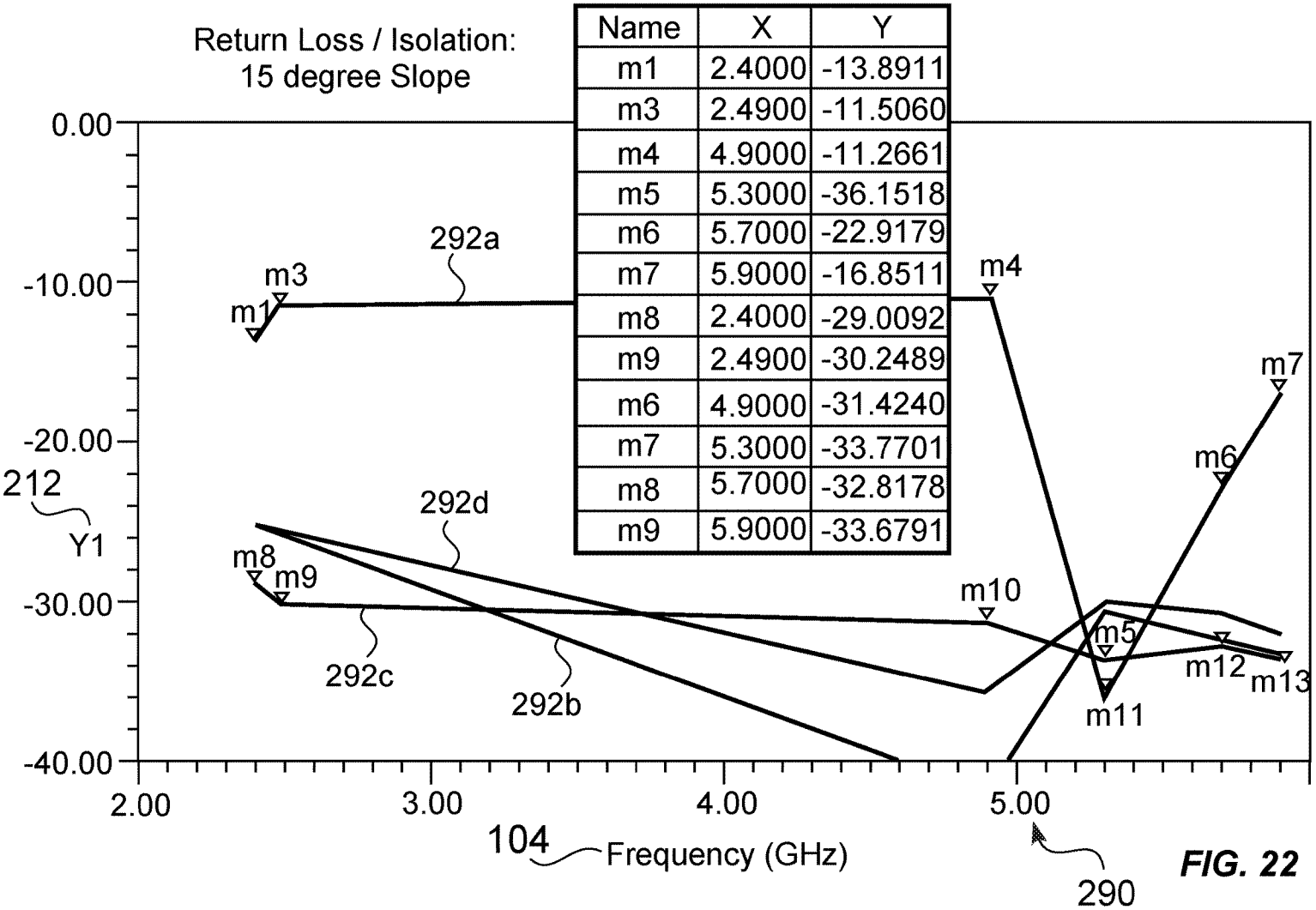
FIG. 22 is a chart that shows return loss/isolation as a function of frequency between the different antenna elements for the illustrative 2G/5G corner array seen in FIG. 20.

FIG. 22 is a chart 290 that shows return loss/isolation 212 as a function of frequency 104 between the different antenna elements 84 for the illustrative 2G/5G corner array 140*c* seen in FIG. 20, including line 292*a* for antenna element 84*a*, line 292*b* for antennas 84*a* and 84*b* having a spacing 144 of 216 mm c/c, line 292*d* for antennas 84*a* and 84*d* having a spacing 142 of 255 mm c/c, and line 292*c* for antennas 84*a* and 84*c* having a spacing 146 of 334 mm c/c. FIG. 23 is a table 294 that provides a matrix of the test results for the illustrative 2G/5G corner array 140*c*, as configured with a PCB ground slope of 15 degrees.

In a comparison of the performance results for the illustrative 2G/5G corner arrays 140,140*b* and 140*c*, it is seen that the match remains substantially the same, independent of ground slope. As well, the individual antenna beam patterns for the illustrative 2G/5G corner arrays 140,140*b* and 140*c* are also substantially the same.

However, it can be seen that isolation performance favors the use of increasing the PCB ground slope 232,272. For the illustrative 2G/5G corner arrays 140,140*b* and 140*c* tested, the 2G/5G corner array 140*c* having a PCB ground slope 272 of 15 degrees provided the best isolation performance, while the 2G/5G corner array 140*b*, having a PCB ground slope 232 of 10 degrees, also provided satisfactory isolation. As further seen, for 2G operation, there is a dependence on the ground plane reflection to increase the isolation. In the flat (0 degree slope) 2G/5G corner array 140, such as seen in FIG. 7, the reflection is optimum when the antenna separation is adjusted on one of the sides to 215 mm c/c. It can also be seen that the use of a separate reflecting plane can ensure good isolation and shadowing from PCB noise.

Isolated Multi Band Dipole Antennas.

Also disclosed herein are embodiments of isolated multi-band center or end-fed dipole antennas, having single-sided PCB or metal-only structures, for operation with at least two distinct frequencies. The disclosed antennas can provide RF isolation, such as with an RF trap on the coax cable, or with a Balun system.

Figure 24:
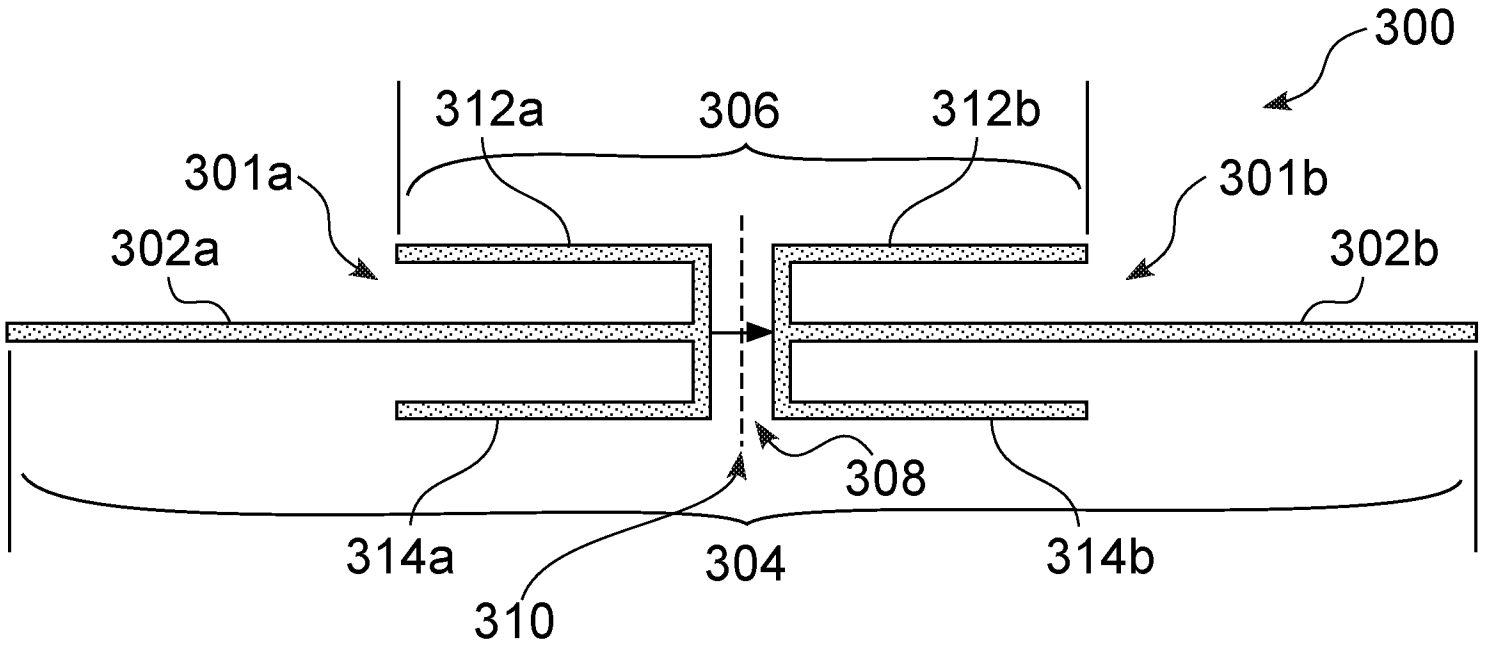
FIG. 24 shows an illustrative dual band dipole antenna having a pair of path structures, and a dipole feed point located within a central region between the path structures.

As an introduction to different antenna structures, FIG. 24 shows an illustrative dual band dipole antenna 300, including a first path structure 301*a* and a second path structure 301*b*, wherein a dipole feed point 310 can be established within central region 308 located between the path structures 301*a*,301*b*. As further seen in FIG. 24, the dual band dipole antenna 300 includes a low band dipole 304 established between the path structures 301*a* and 301*b*, including path elements 302*a* and 302*b*, such as for 2G operation, and a high band dipole 306, such as for 5G operation, established between a central region of the path structures 301*a* and 301*b*, including respective upper path elements 312*a* and 312*b*, and respective lower path elements 314*a* and 314*b*.

Figure 25:
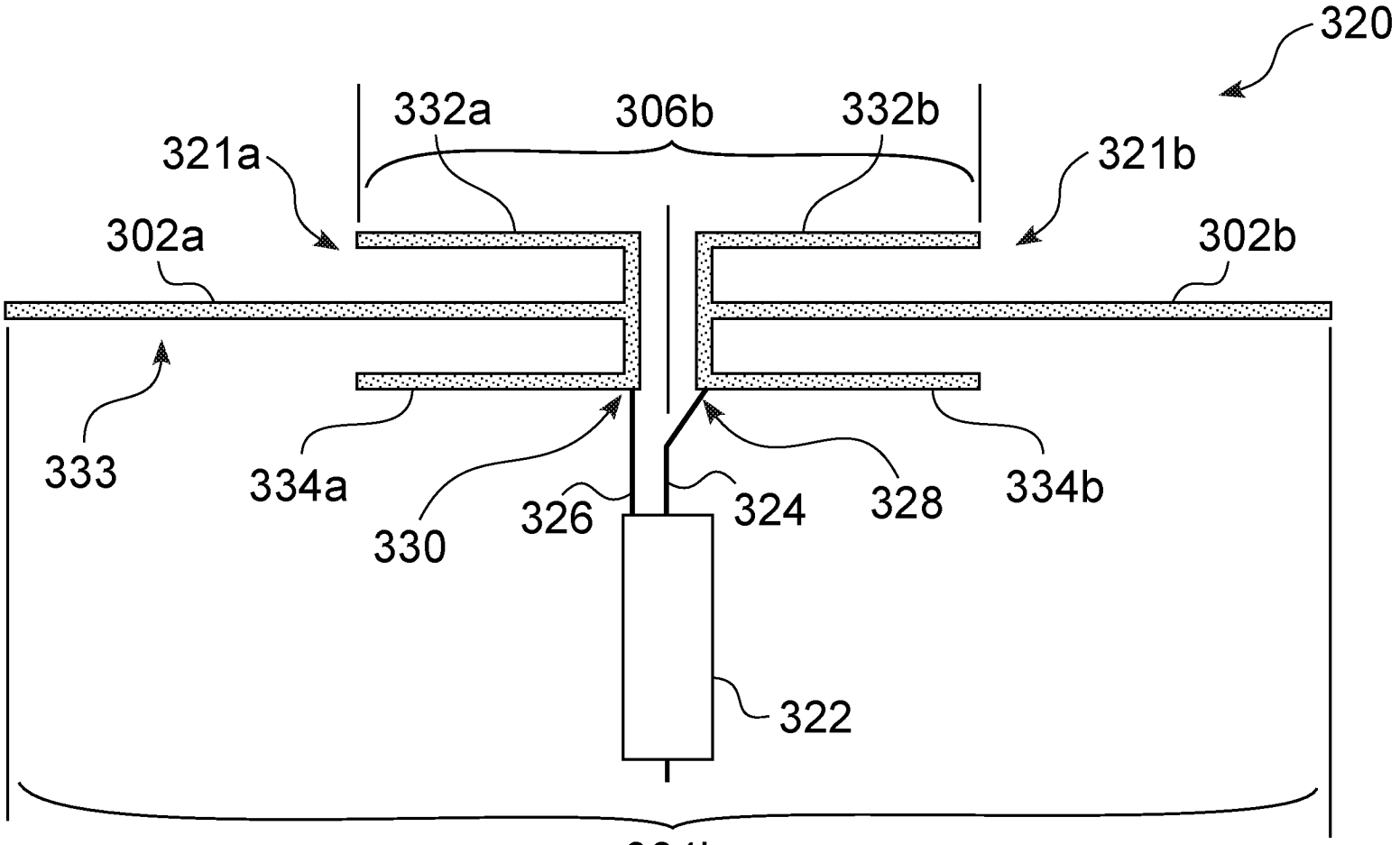
FIG. 25 is a schematic view an illustrative dual band dipole antenna, in which a coaxial cable, having a center conductor and an outer conductive shield, is connected to the first path structure and to the second path structure.

FIG. 25 is a schematic view an illustrative dual band dipole antenna assembly 320, in which a coaxial cable feed 322, having a center conductor 324 and an outer conductive shield 326, is connected to a first path structure 321*a* and to a second path structure 321*b*. As seen in FIG. 25, the center conductor 324 is connected to the second path structure 321*b* through a center conductor connection 328, while the coax shield 326 is connected to the first path structure 321*a* by a shield connection 330. The illustrative dual band dipole antenna 320 seen in FIG. 25 also includes a dipole feed point 333 associated with the first path structure 321*a*.

As further seen in FIG. 25, the dual band dipole antenna 320 includes a low band dipole 304*b* that includes path elements 302*a* and 302*b*, such as for 2G operation, and a high band dipole 306*b* established between a central region of the path structures 321*a* and 321*b*, such as for 5G operation, including respective upper path elements 332*a* and 332*b*, and respective lower path elements 334*a* and 334*b*.

Figure 26:
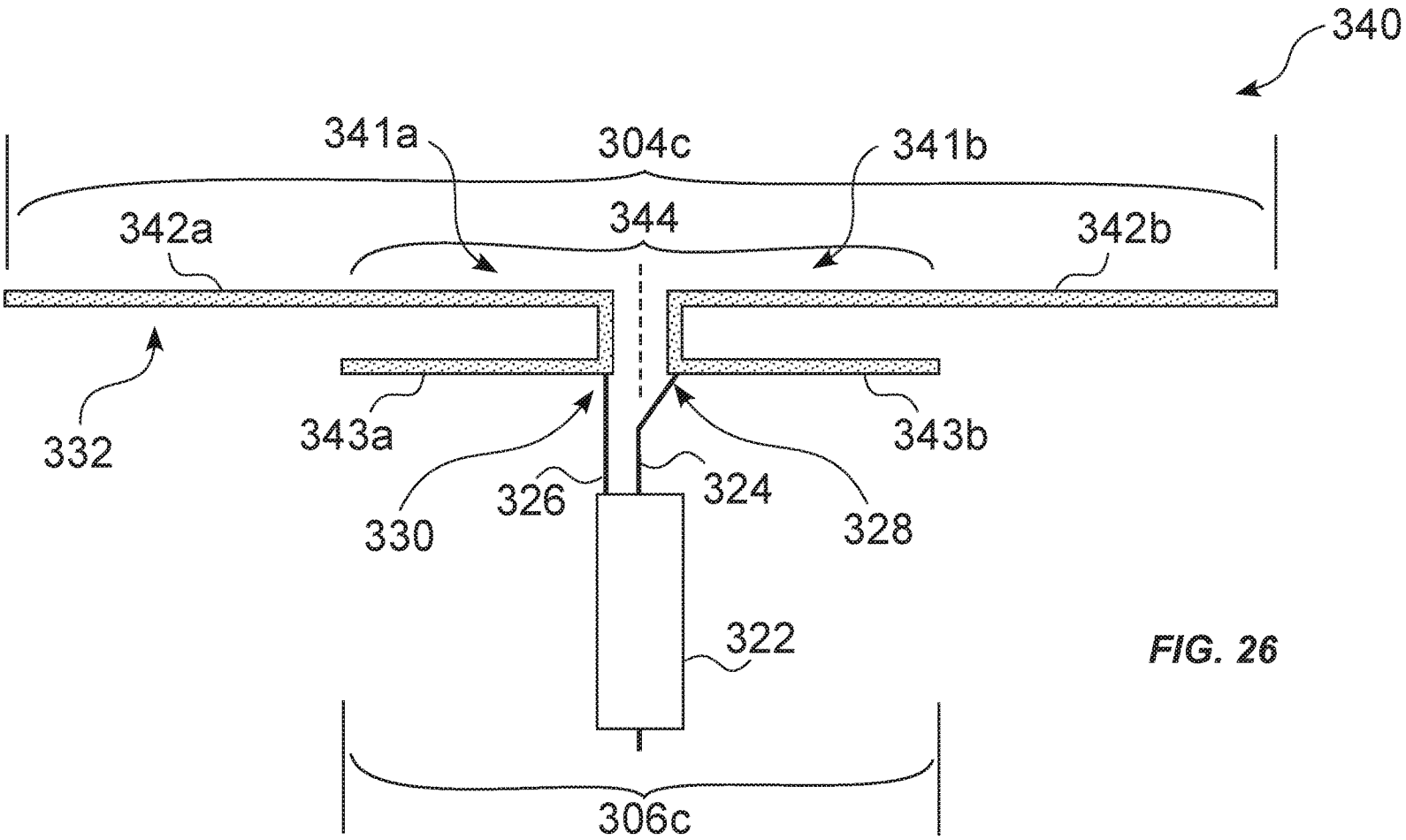
FIG. 26 is a schematic view an illustrative center fed dual band dipole antenna, in which a coaxial cable feed is connected to the first path structure and to the second path structure at a central feed point.

FIG. 26 is a schematic view of an illustrative center fed dual band dipole antenna 340, in which a coaxial cable feed 322, having a center conductor 324 and an outer conductive shield 326, is connected to a first path structure 341*a* and to a second path structure 341*b*. As seen in FIG. 26, the center conductor 324 is connected to the second path structure 341*b* through a center conductor connection 328, while the coax shield 326 is connected to the first path structure 341*a* by a shield connection 330. The illustrative dual band dipole antenna 340 seen in FIG. 26 also includes a dipole feed point 332 associated with the low dipole path 342*a* of the first path structure 341*a*.

As further seen in FIG. 26, the center fed dual band dipole antenna 340 includes a low band dipole 304*c* that includes the path elements 342*a* and 342*b*, such as for 2G operation, and a high band dipole 306*c* that includes lower path elements 343*a* and 343*b*, such as for 5G operation.

Figure 27:
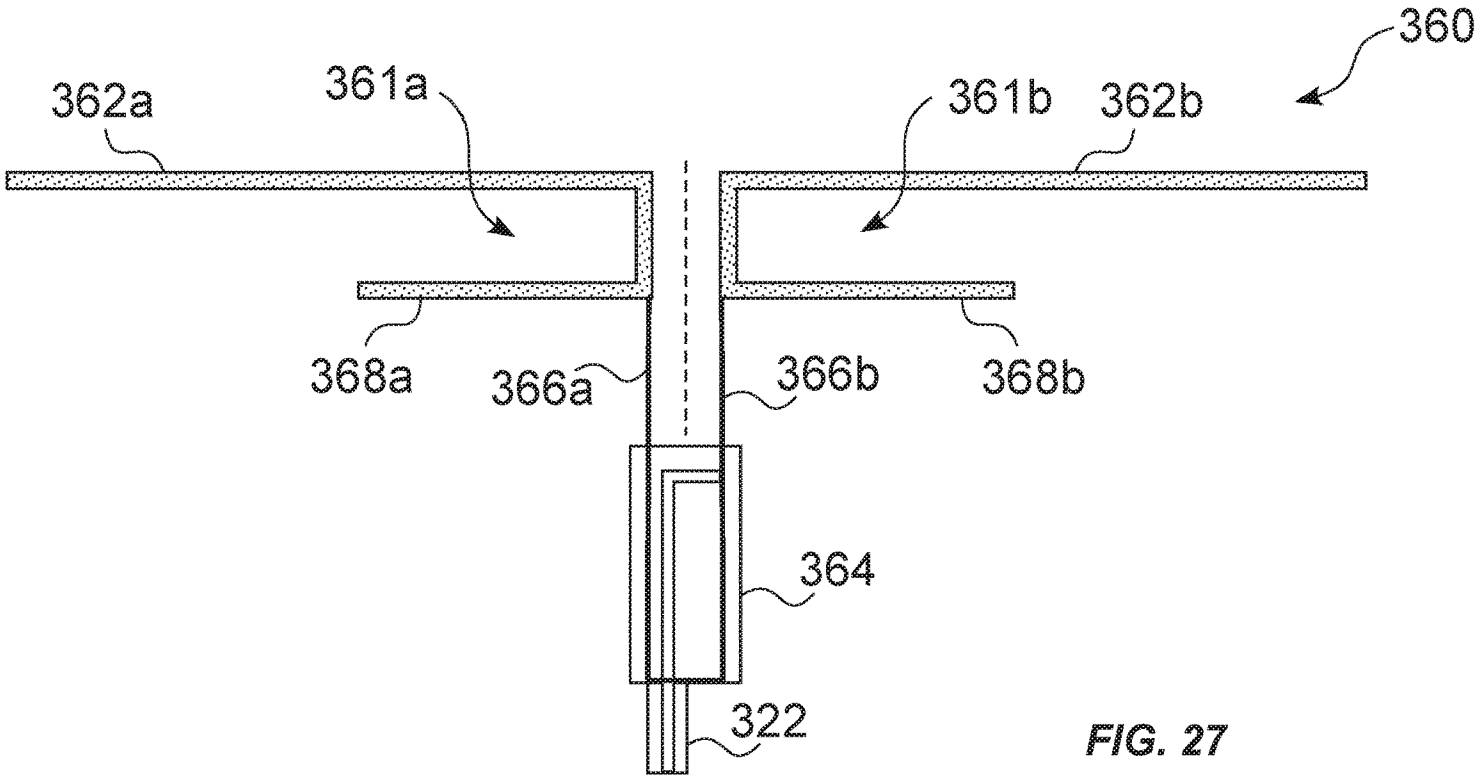
FIG. 27 is a schematic view an illustrative center fed dual band dipole antenna, in which a balun is used to connect a coaxial cable feed to both the first path structure and the second path structure at a central feed point.

FIG. 27 is a schematic view an illustrative center fed dual band dipole antenna 360, in which a balun device 364 is used to connect a coaxial cable feed 322 to both a first path structure 361*a* and to a second path structure 361*b*, through respective connections 366*a* and 366*b*. The balun device 364 is used to convert between an unbalanced signal on the antenna side, and a balanced signal on the coax side.

The illustrative path structures 361*a* and 361*b* include respective antenna lower paths 368*a* and 368*b*, but do not include corresponding upper paths, such as paths 332*a* and 332*b* shown in FIG. 25. The illustrative path structures 361*a* and 361*b* operate as a single antenna band, in which the structure is limited to dual band operation for frequencies that are even multiples, e.g., 2.45 GHz and 4.9 Ghz.

While the illustrative center fed dipoles 300,320 and 340 shown in FIGS. 24-26 respectively can be configured for both 2G and 5G operation, such antenna architectures simply connect 330 the shield 326 of a feed coax 322 to one side of the dipole structure, and connect 328 the center conductor 324 to the other side of the dipole structure. This practice typically results in poor antenna isolation of common mode signals from the printer circuit board PCB.

As such, disclosed herein are a variety of embodiments of isolated multi-band center or end-fed dipole antennas, which can significantly improve antenna RF isolation, and which can be implemented using single sided PCBs or metal only structures.

Figure 28:
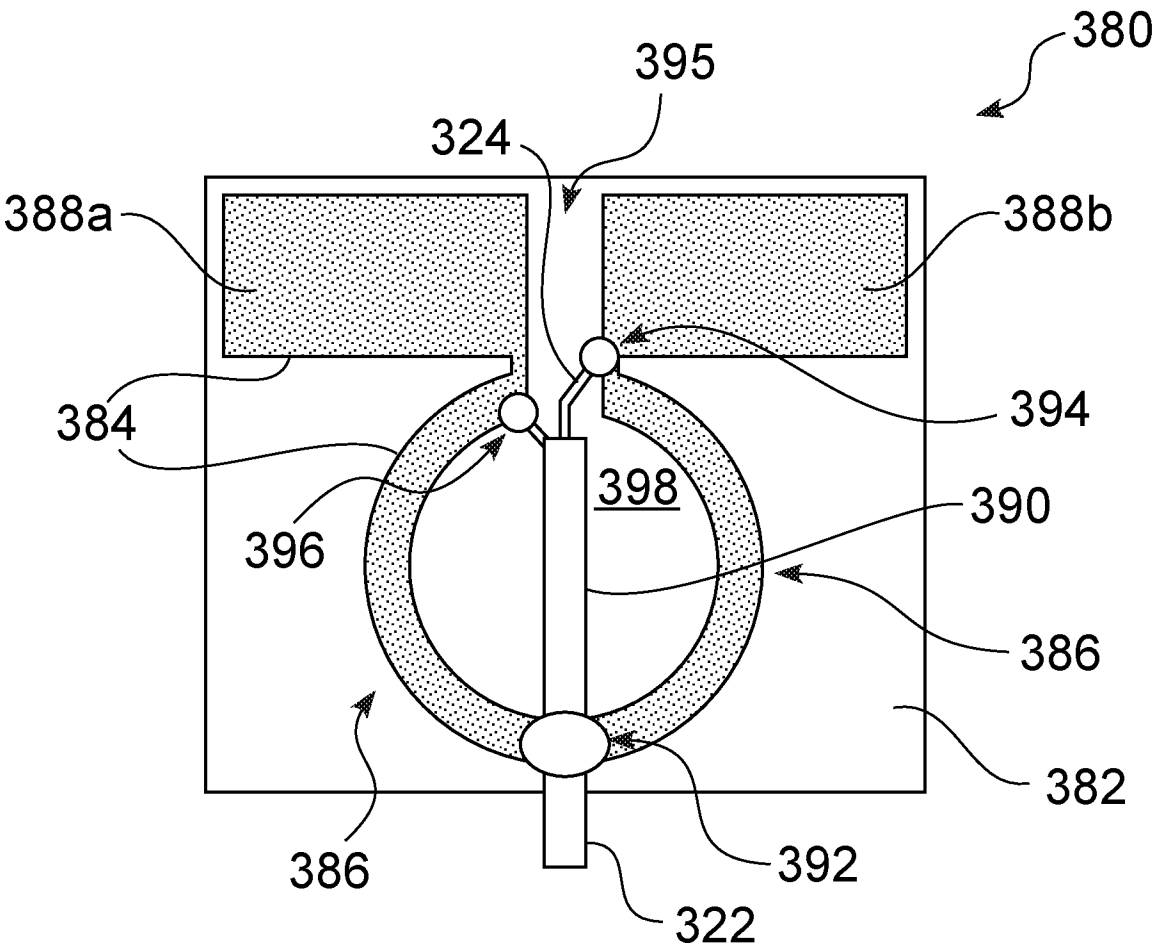
FIG. 28 is a schematic view of an illustrative center fed dipole antenna structure for single band operation, wherein a balun structure as well as a single band antenna are established as a metallic layer on a single side of a printed circuit board.

FIG. 28 is a schematic view of an illustrative center fed dipole antenna structure 380 for single band operation, wherein a balun structure 386 as well as a single band antenna 388, comprising elements 388*a* and 388*b*, can be established as a metal-only structure, or as a metallic layer 384, e.g., copper, on a printed circuit board (PCB) 382, which can be integrated with or separate from a PCB that includes active electronics for a wireless signal processing. The illustrative metallic layer 384 seen in FIG. 28 can readily be photolithography formed within the outline of a PCB substrate 382. The illustrative metallic layer 384 seen in FIG. 28 includes balun paths 386 that extend from a coax connection point 392 in opposing directions, and then transition into opposing antenna band elements 388*a* and 388*b* than can be formed on the same metallic layer 384. A feed gap 395 is defined between the band elements 388*a*,388*b*.

At a lead end 398 of the coax feed 322, such as proximate to the region where the balun paths 386 and the antenna elements 388 transition together, a solder point 394 is used to electrically connect the center conductor 324 to antenna element 388*b*, while a solder point 396 is used to electrically connect the coax shield 326 to the opposing antenna element 388*a*. The illustrative feed coax 322 seen in FIG. 28 is secured to the PCB 382 by a solder point 392 between the coax feed 322 and the balun 386, and can be implemented at the same time and using the same soldering process as is used for solder points 394 and 396.

An illustrative embodiment of the antenna structure 380 comprises an electrically conductive, metallic dipole antenna 388 for operation in a corresponding frequency band, the dipole antenna 388 including a first dipole half, e.g., 388*a*, that extends outward in a first direction from a first half of a feed point, and a second dipole half, e.g., 388*b*, that extends outward in a second direction opposite the first direction from a second half of the feed point, wherein a feed gap 395 is defined between the first and second halves of the feed point, and wherein the first dipole half 388*a* and the second dipole half 388*b* define a center-fed dipole antenna 388, the structure further including an electrically conductive, metallic first balun path 386 extending from the first half dipole half 388*a* proximate to the first half of the feed point to a coax solder point 392, an electrically conductive, metallic second balun path 386 that extends from the second half dipole half 388*b* proximate to the second half of the feed point to the coax solder point 392, a coax shield connection point 396 located on the first balun path 386 proximate to the first half of the feed point, and a coax conductor connection point 394 located on the second balun path 386 proximate to the second half of the feed point.

Figure 29:
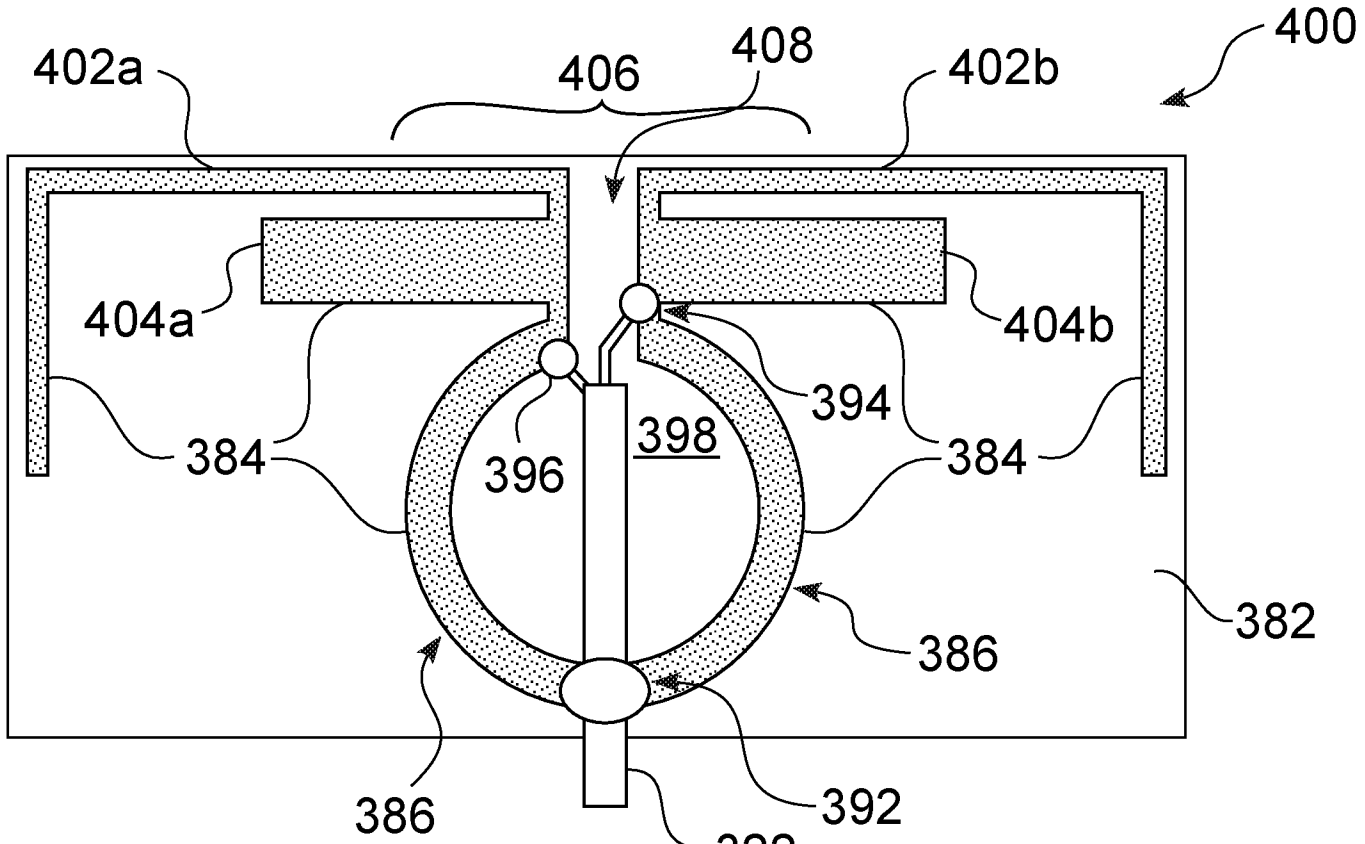
FIG. 29 is a schematic view of an illustrative center fed dipole antenna structure for dual band operation, wherein a balun structure, as well as a dual band antenna are established as a metallic layer on a single side of a printed circuit board.

FIG. 29 is a schematic view of an illustrative center fed dipole antenna structure 400 for dual band operation, wherein a balun structure 386, as well as a dual band antenna 406, can be established as a metal-only structure, or as a metallic layer 384 on a printed circuit board PCB 382. For instance, the illustrative metallic layer 384 seen in FIG. 29 can readily be photolithography formed within the outline of a PCB substrate 382.

The illustrative metallic layer 384 seen in FIG. 29 includes balun paths 386 that extend from a coax connection solder point 392 in opposing directions, and then transition into opposing antenna band elements 404*a*,404*b* that can be formed on the same metallic layer 384. The dual band antenna structure 406 seen in FIG. 29 includes opposing pairs of low band top elements 402*a* and 402*b*, as well as opposing pairs of high band bottom elements 404*a*,404*b*. A gap 408 is defined between the opposing antenna elements.

At a lead end 398 of the coax feed 322, such as proximate to the region where the balun paths 386 and the lower antenna elements 404*a*,404*b* merge together, a solder point 394 can be used to electrically connect the center conductor 324 to antenna element 404*b*, while a solder point 396 can be used to electrically connect the coax shield 326 to the opposing antenna element 404*a*. While the feed coax 322 can be secured to the PCB 392 by a variety of mechanisms, the use of a solder point 392 between the coax feed 322 and the balun paths 386 can be implemented at the same time and using the same soldering process as is used for solder points 394 and 396.

In operation, the center fed dipole antenna structure 400 is limited in operation to frequencies that are even multiples, e.g., 2.45 GHz and 4.9 Ghz. In a typical embodiment, the low band top elements 402*a* and 402*b* are top loaded structures, wherein removal of the low band top elements 402*a* and 402*b* can readily be performed to convert the antenna 400 to single band operation.

Figure 30:
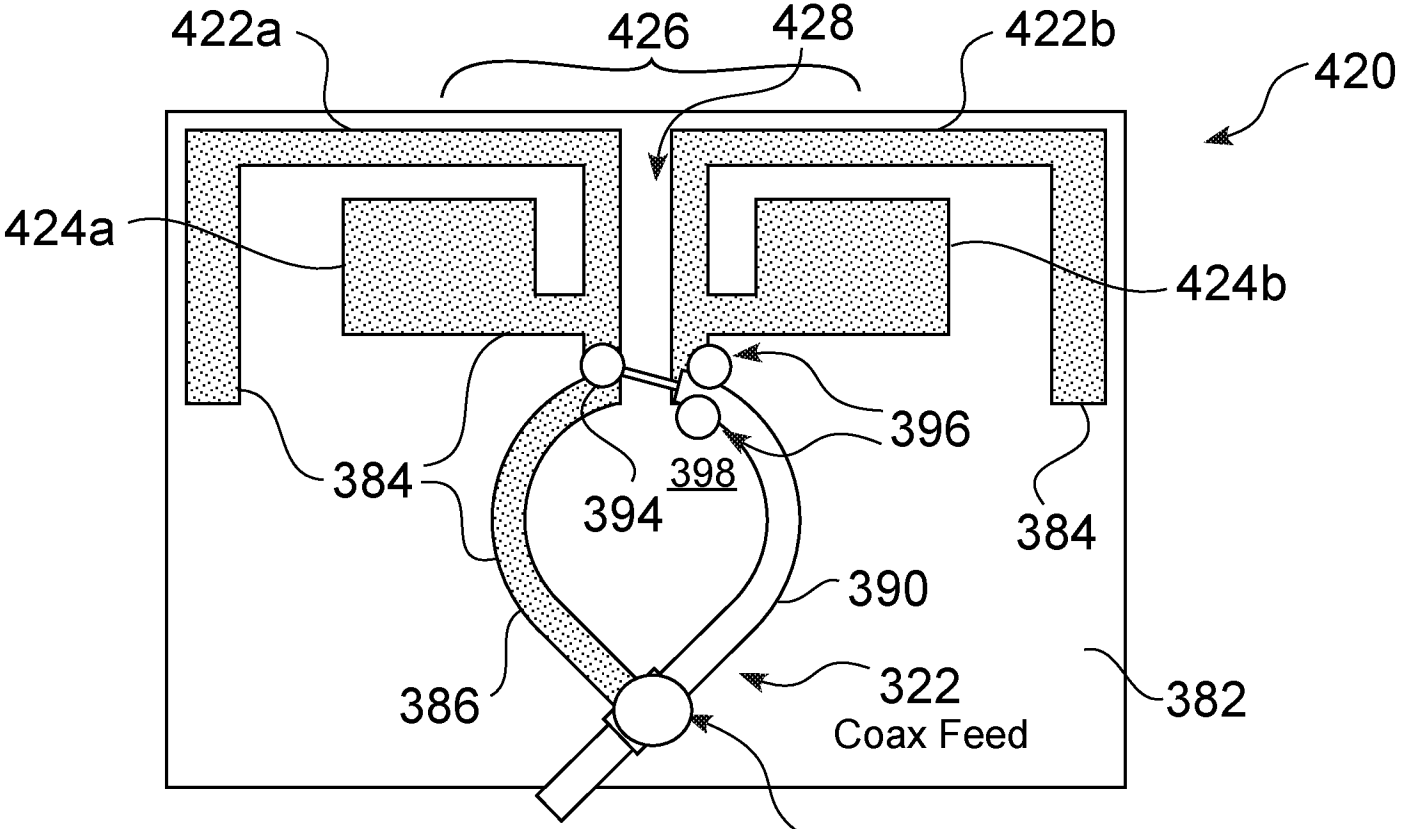
FIG. 30 is a schematic view of an illustrative center fed dipole antenna structure for dual band operation, wherein a balun path, as well as a dual band antenna, are established as metallic layers on a printed circuit board, and wherein a coaxial feed cable is used to complete the balun structure.
Figure 31:
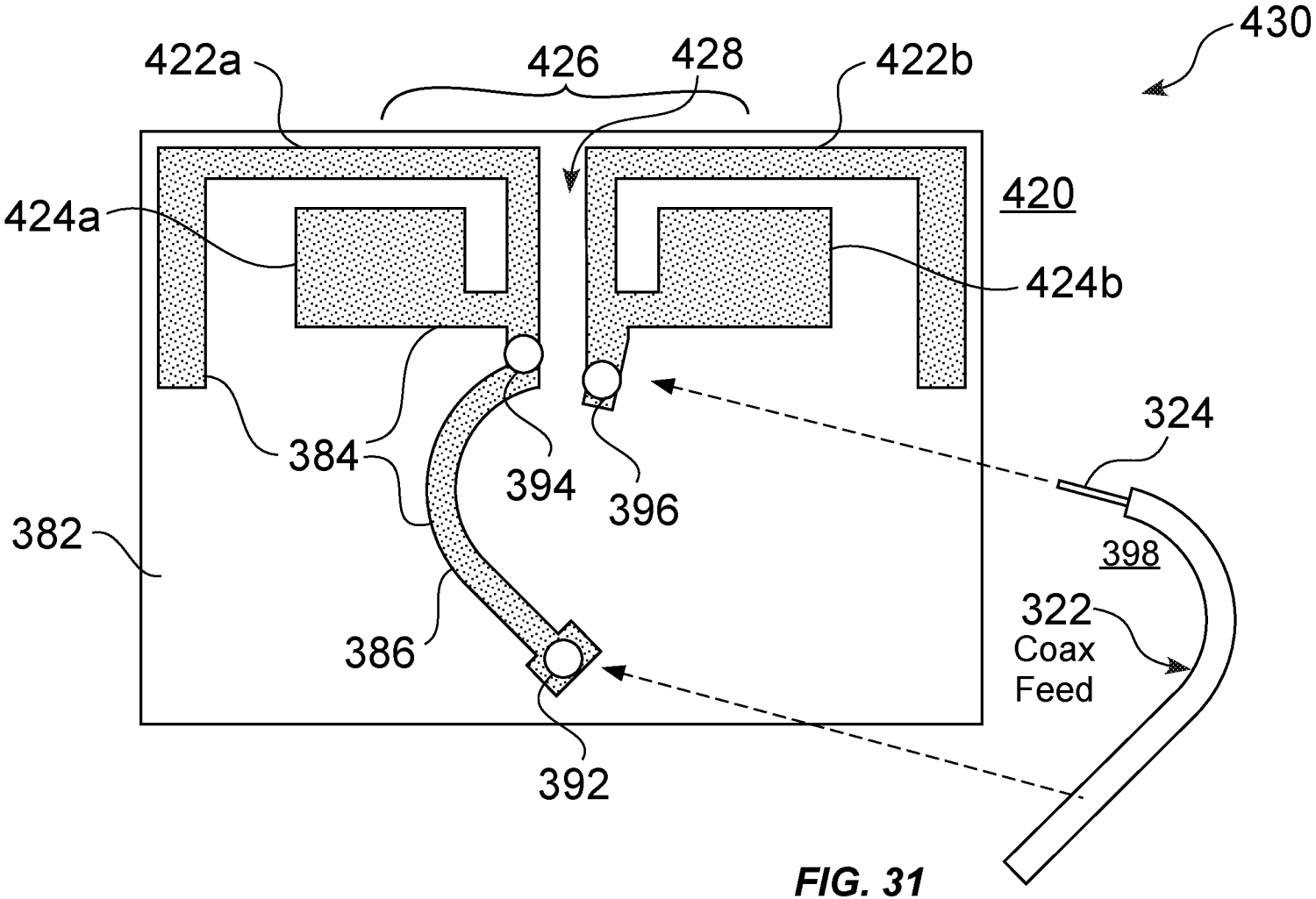
FIG. 31 is an expanded assembly view of the illustrative center fed dipole antenna structure seen in FIG. 30.

FIG. 30 is a schematic view of an illustrative center fed dipole antenna structure 420 for dual band operation, wherein a balun structure 386, as well as a dual band antenna 426 can be established as a metal-only structure, or as metallic layers 384 on a printed circuit board PCB 382. FIG. 31 is an expanded assembly view 430 of an illustrative center fed dipole antenna structure 420. The illustrative metallic layers 384 seen in FIG. 30 and FIG. 31 can readily be photolithography formed within the outline of a PCB substrate 382.

The illustrative metallic layers 384 seen in FIG. 30 and FIG. 31 include a balun path 386 that extends from a coax connection solder point 392 to a coax center conductor connection point 394 located at the bottom high band antenna element 424*a*, and to a top low band antenna element 422*a*. The illustrative metallic layers 384, which can readily be formed concurrently, also include a bottom high band antenna element 424*b* and to a top low band antenna element 422*b*. One or more coax shield connection solder points 396 are located proximate to the bottom high band antenna element 424*b*. In combination, the dual band antenna structure 426 seen in FIG. 30 and FIG. 31 includes the opposing upper low band top elements 422*a* and 422*b*, as well as the opposing bottom high band bottom elements 424*a*,424*b*. A gap 428 is defined between the opposing antenna elements.

As further seen in FIG. 30 and FIG. 31, the balun 386 extends around one side of the antenna structure, while the coax feed 322, having an outer shield 390, extends around the opposite side of the antenna structure, such that, when the outer conductive shield 390 of the coax feed 322 is connected between solder point 392 and one or more solder points 396, and when the inner conductor 324 is electrically connected at solder point 394, the coax feed 322 acts to complete the balun for the antenna structure, i.e., the coax shield 390 completes the balun 384 structure.

An illustrative embodiment of the center fed dipole antenna structure 420 comprises an electrically conductive, metallic dipole antenna 426, including a first dipole half, e.g., 422*a* and 424*a*, that extends outward in a first direction from a first half of a feed point, and a second dipole half, e.g., 422*b* and 424*b*, that extends outward in a second direction opposite the first direction from a second half of the feed point, wherein a feed gap 428 is defined between the first and second halves of the feed point, and wherein the first dipole half and the second dipole half define a center-fed dipole antenna 426, the structure further including an electrically conductive, metallic balun path 386 extending from the first dipole half proximate to the first half of the feed point to a coax solder point 392, a coax shield connection point 396 located proximate to the second half of the feed point, a coax conductor connection point 394 located on the balun path 386 proximate to the first half of the feed point, and a coaxial cable 390 including a center conductor 44, a coaxial shield 40 surrounding the center conductor 44, and coaxial insulator 42 between the center conductor 44 and the coaxial shield 40, wherein the coaxial cable 390 extends from a lead end 398 to a remote end opposite the lead end 398, wherein at the lead end 398, the center conductor 44 is connected to the coax conductor connection point 394, and the coaxial shield 40 is connected to the coax shield connection point 396, wherein the coaxial shield 40 is also connected to the coax solder point 392, wherein the remote end of the coaxial cable 390 extends beyond the coax solder point 392 for connection to antenna electronics, and wherein the coaxial shield 40 and the balun path 386 form a balun structure for the antenna structure 420.

In operation, the center fed dipole antenna structure 420 is limited in operation to frequencies that are even multiples, e.g., 2.45 GHz and 4.9 Ghz. In a typical embodiment, the low band top elements 422*a* and 422*b* are top loaded structures, wherein removal of the low band top elements 422*a* and 422*b* can readily be performed to convert the antenna 420 to single band operation. During fabrication, the length of the coax feed 322 that is soldered between solder points 392 and 396 can be chosen to accurately match the conductive path provided by the balun 386.

Figure 32:
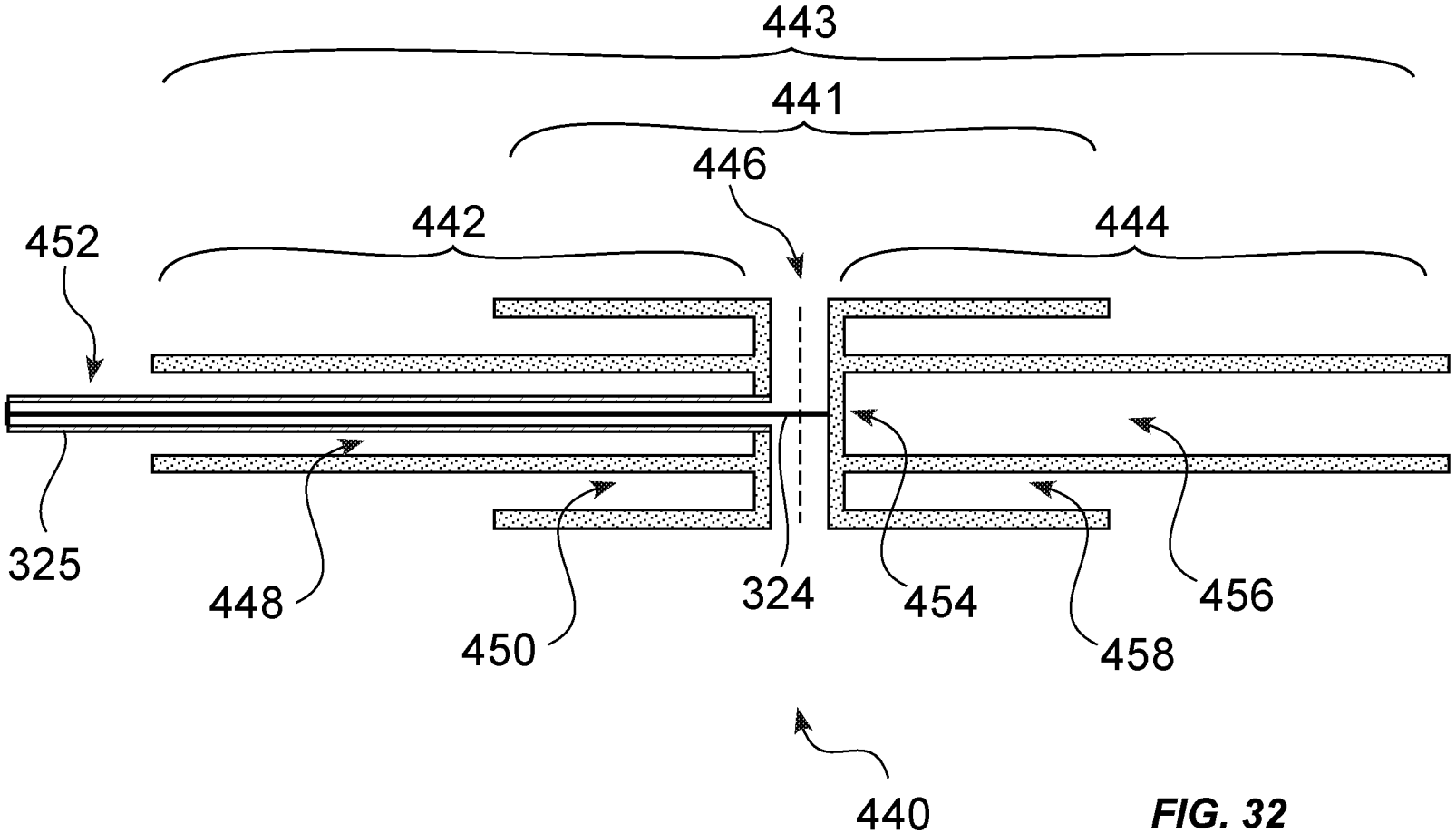
FIG. 32 is a schematic view of an illustrative end fed dipole antenna structure.

FIG. 32 is a schematic view of an illustrative end fed dipole antenna structure 440, which includes a first antenna structure 442 and a second antenna structure 444, wherein a gap 446 is defined between the structures 442 and 444. The first antenna structure 442 seen in FIG. 32 includes an inner low band trap 448 and outer high band trap 450, while the second antenna structure 444 includes an inner low band trap 456 and an outer high band trap 458, such that the first antenna structure 442 and the second antenna structure 444 define a high band antenna structure 441 and a low band antenna structure 443.

The illustrative end fed dipole antenna structure 440 seen in FIG. 32 includes an end feed coax 452 having an inner conductor 324 and an outer conductive shield 325 that is electrically insulated from the inner conductor 324. As also seen in FIG. 32, the lead end of the coax 452 (such as connected to active antenna electronics through an opposing remote end), enters and extends though the inner low band trap region 448 of the first antenna structure 442. The inner conductor 324 extends beyond the first antenna structure 442, across the gap 446, and is electrically connected to the second antenna structure 444 at a coax center conductor contact point 454 proximate the feed gap 446, while the outer conductive shield 325 is electrically connected to the first antenna structure 442 proximate the feed gap 446. In operation, at the open end of the trap 448, the effective impedance is very high, and therefore makes the dipole structure 440 appear to be disconnected from the feed coax cable 452, i.e., from the left end as shown.

Figure 33:
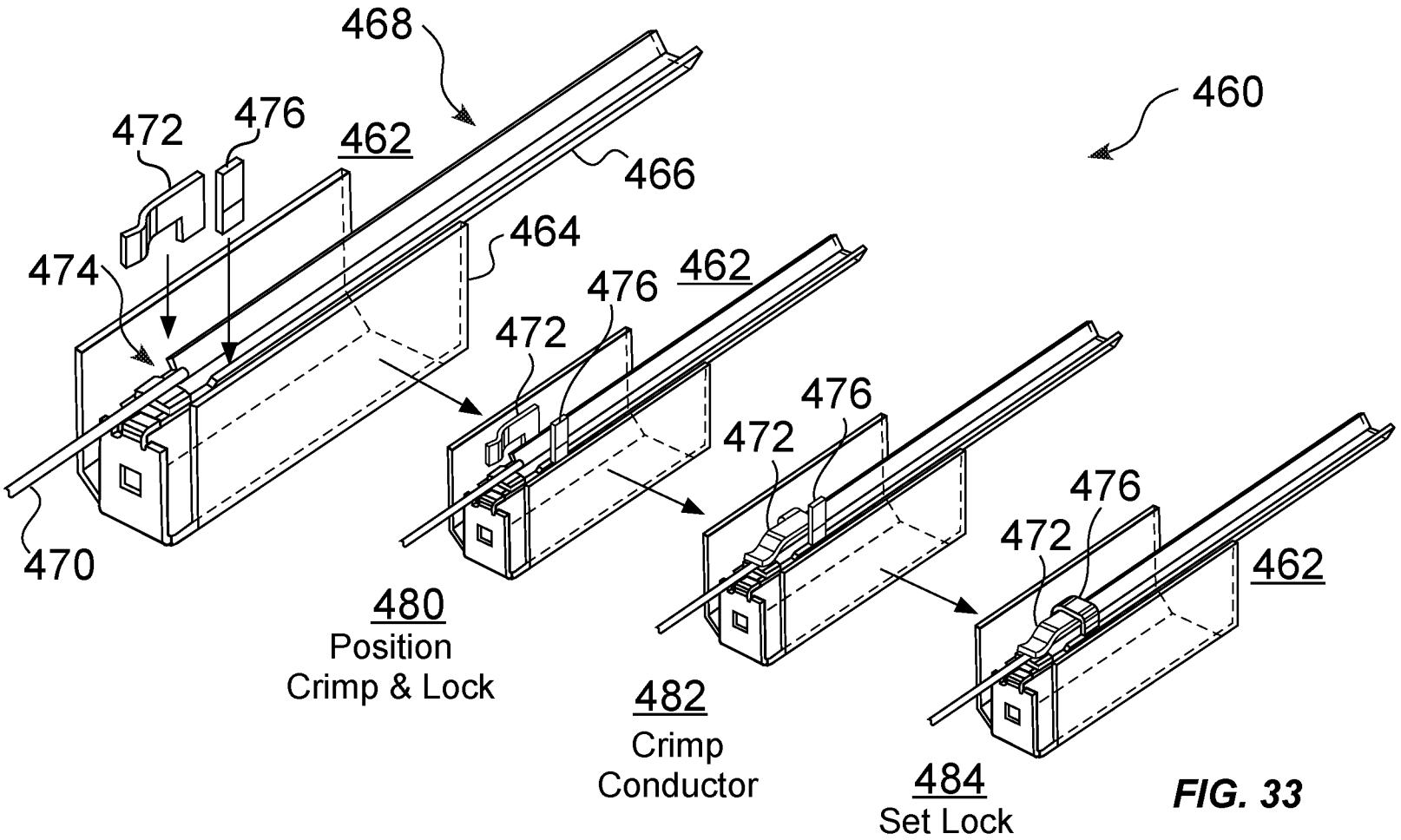
FIG. 33 shows detailed assembly views of a crimp assembly, such as to provide a robust and low cost connection between a conductive antenna lead and an antenna.

FIG. 33 shows detailed assembly views 460 of a crimp assembly 462, such as to provide a robust and low cost connection, e.g., a remote side connection 468, between a conductive antenna lead 470 and one or more of the antenna embodiments disclosed herein.

The illustrative crimp assembly 462 seen in FIG. 33 includes a crimp assembly body 464 from which a connector portion 466 extends, in which the crimp assembly body 464 and the connector portion 466 can be formed from metal sheet, e.g., stamped copper or brass, or plated sheet stock. The crimping assembly also includes a crimp 472 and a lock 476, which are configured to secure a conductive lead 470 at a conductor crimp location 474. As shown at detail 480, the conductive lead 470 can be accurately located with respect to the conductor crimp location 474, and the crimp 472 and lock 476 can be positioned to secure the conductive lead 470. As seen at detail 482, the crimp 472 is then folded over the conductive lead 470. As seen at detail 484, the lock 476 is then folded over the crimp 472, to secure the conductive lead 470 to the crimp assembly 462.

An illustrative embodiment of the crimp assembly 462 can be implemented as an electrical connector for a coaxial antenna feed, comprising an electrically conductive crimp assembly body 464 formed from sheet metal, wherein the crimp assembly body 464 extends from a first end to a second end opposite the first end, and wherein a crimp location 474 is defined at the first end, a metal crimp element 472 configured for placement at the crimp location 474, and for securing a center conductor 470 of a coaxial antenna feed at the crimp location 474 when the metal crimp element 472 is folded over the center conductor 470, and a lock element 476 for securing the crimp element 472 to any of the center conductor 470 and the crimp assembly body 464.

In some embodiments, the conductive lead 470 comprises a center conductor 44, 324 of a coaxial cable as disclosed herein, the crimp assembly 462 can be used for connecting the center conductor to the base of an antenna. In some embodiments, the crimp assembly 462 also provides a spring action to ensure controlled pressure on the center conductor 44, 324. In some embodiments, the lock 476, when closed over the crimp 472, prevents creep with aging. In some embodiments, an access hole is cut, formed, or otherwise defined through the bottom of the surrounding metal sheath, such as to provide for the high band dipole, e.g., 404 (FIG. 29) or 424 (FIGS. 30-31).

Non-DC Path Antennas.

Figure 34:
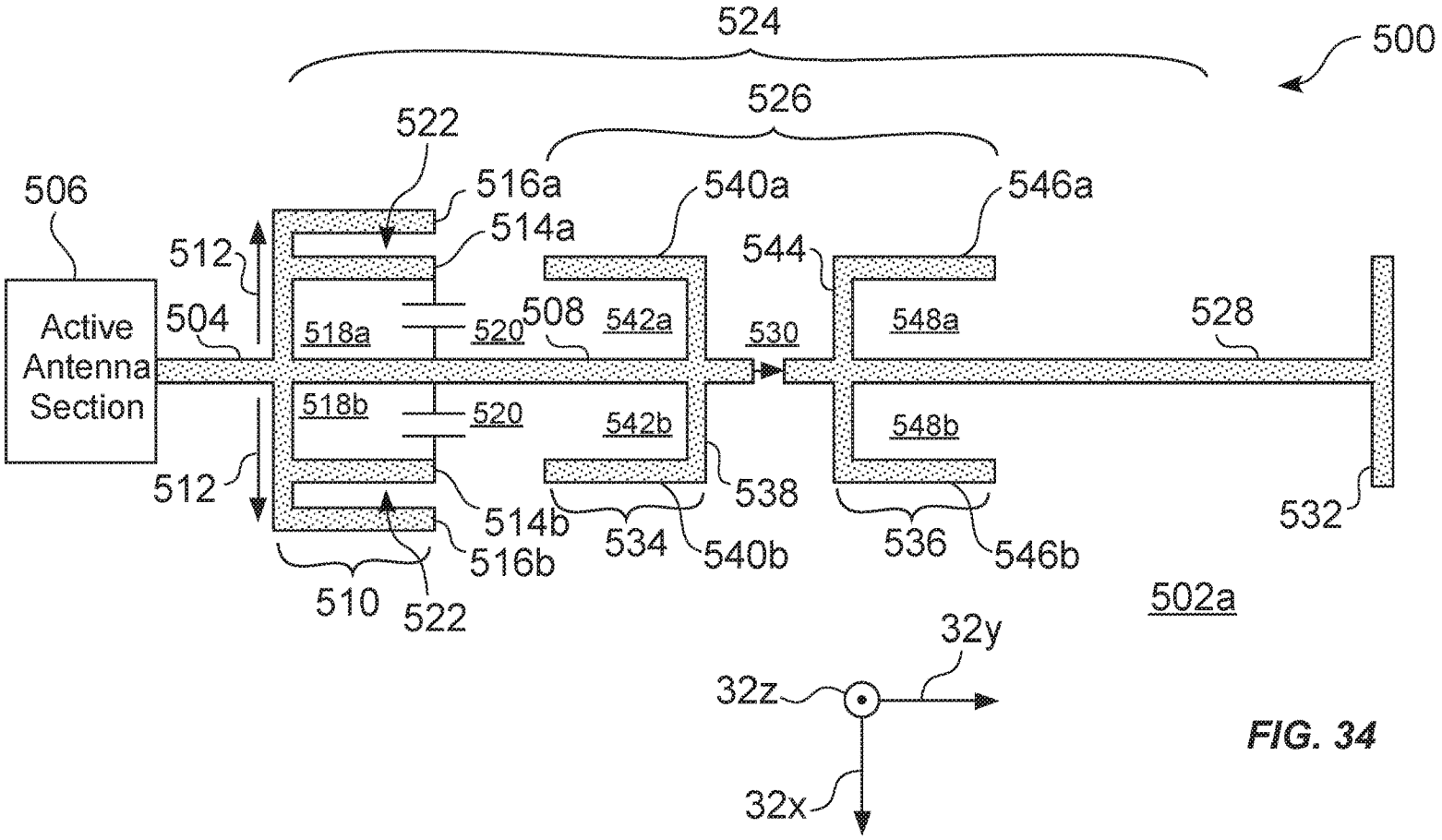
FIG. 34 is a schematic view of an illustrative non-DC Path 2G/5G antenna for a 2G/5G antenna that includes 2G and 5G trap structures.

FIG. 34 is a schematic view 500 of an illustrative Non-DC Path antenna 502, e.g., 502*a*, such as for 2G/5G operation. As seen in FIG. 34, the antenna 502 extends 504 from an active antenna section 506 to define a longitudinal path 508, such as aligned along a Y-axis 32*y*, to establish a 2G antenna 524 as well as a 5G antenna 526.

The illustrative 2G antenna 524 seen in FIG. 34 includes a dual 2G and 5G trap structure 510 that extends outward 512, e.g., along X-axis 32*x*, from the longitudinal path 508, from which a first pair of electrically conductive paths 514*a*,514*b* extend longitudinally. Further outward, a second pair of electrically conductive paths 516*a*,516*b* extend longitudinally.

The illustrative 2G and 5G trap structure 510 seen in FIG. 34 provides two 2G traps 518*a*,518*b*, wherein a first 2G trap 518*a* is defined between the longitudinal path 508 and path 514*a*, and wherein a second 2G trap 518*b* is defined between the longitudinal path 508 and path 514*b*. As further seen in FIG. 31, each of the 2G traps 518*a*,518*b* includes a corresponding capacitor 520. As additionally seen in FIG. 34, the illustrative 2G and 5G trap structure 510 includes two 5G traps 522, wherein a first 5G trap is defined between paths 514*a* and 516*a*, and a second 5G trap 522 is defined between paths 514*b* and 516*b*. The 5G traps 522 are included to correct the beam pattern for 5G operation.

The illustrative Non-DC Path antenna 502*a* seen in FIG. 34 also includes an antenna feed 530 for both the 2G antenna 524 and the 5G antenna 526, wherein the antenna feed 530 is defined between the first longitudinal path 508 and a second longitudinal path 528, which extends to an outer traverse path 532.

The illustrative 5G antenna 526 seen in FIG. 34 includes a first 5G antenna structure 534 defined on the first longitudinal path 508, and a second 5G antenna structure 536 defined on the second longitudinal path 528.

The first 5G antenna structure 534 includes a transverse path 538, and a pair of electrically conductive paths 540*a*, 540*b* that extend longitudinally away from the antenna feed 530, in which a first 5G trap 542*a* is defined between the longitudinal path 508 and path 540*a*, and a second 5G trap 542*b* is defined between the longitudinal path 508 and path 540*b*.

The second 5G antenna structure 536 includes a transverse path 544, and a pair of electrically conductive paths 546*a*,546*b* that extend longitudinally away from the antenna feed 530, in which a first 5G trap 548*a* is defined between the second longitudinal path 528 and path 546*a*, and a second 5G trap 548*b* is defined between the second longitudinal path 528 and path 546*b*.

An illustrative embodiment of the dual-band antenna structure 500 can be configured for operation in a first frequency band and a second frequency band, wherein the second frequency band is higher in frequency than the first frequency band, the dual-band antenna structure formed on a printed circuit board (PCB) 554 (FIG. 35) having a first end and a second end opposite the first end, and a first surface 556*a* (FIG. 35) and a second surface 556*b* (FIG. 35) opposite the first surface 556*a*, in which the dual-band antenna structure comprises a first path structure 508 and a second path structure 528, wherein an antenna feed region 530 is defined between the first path structure 508 and the second path structure 528, wherein the first antenna path structure 508 extends longitudinally from the antenna feed region 508 toward the first end of the PCB 554 for connection to an active antenna section 506, wherein the second antenna path structure 528 extends longitudinally from the antenna feed region toward the second end of the PCB 554, wherein the antenna structure 500 includes a first antenna 524 for operation in the first frequency band, and a second antenna 526 for operation in the second frequency band, wherein the first antenna 524 and the second antenna 526 are defined by the first path structure 508 and the second path structure 528, and include a first high band path structure 534 including a first transverse path 538 that extends outward from both sides of the first longitudinal path 508, and a pair of paths 540*a*,540*b* that extend from the first transverse path 538 away from the antenna feed 530 toward the first end of the PCB 554, wherein a pair of traps 542*a*,542*b* for the second frequency band are defined between the first longitudinal path 508 and the pair of paths 542*a*,542*b* that extend from the first transverse path 508, a second high band path structure 536 including a second transverse path 544 that extends outward from both sides of the second longitudinal path 528, and a pair of paths 548*a*,548*b* that extend from the second transverse path 544 away from the antenna feed 530 toward the second end of the PCB 554, wherein a pair of traps 548*a*,548*b* for the second frequency band are defined between the second longitudinal path 528 and the pair of paths 546*a*,546*b* that extend from the second transverse path 528, and a third path structure 510 located between the first end of the PCB and the first high band path structure 534, the third path structure 510 including a third transverse path 512 that extends outward from both sides of the first longitudinal path 508, a pair of outer paths 516*a*, 516*b* that extend longitudinally from the third transverse path 512, and a pair of inner paths 514*a*,514*b* that extend longitudinally from the third transverse path 512, wherein each of the inner paths 514*a*,514*b* are located between a corresponding one of the outer paths 516 and the first longitudinal path 508, wherein pair of traps 522 for the second frequency band are defined between the corresponding outer paths 516 and inner paths 514, and wherein a pair of traps 518*a*,518*b* for the first frequency band are defined between the corresponding inner paths 514 and the first longitudinal path 508.

Figure 35:
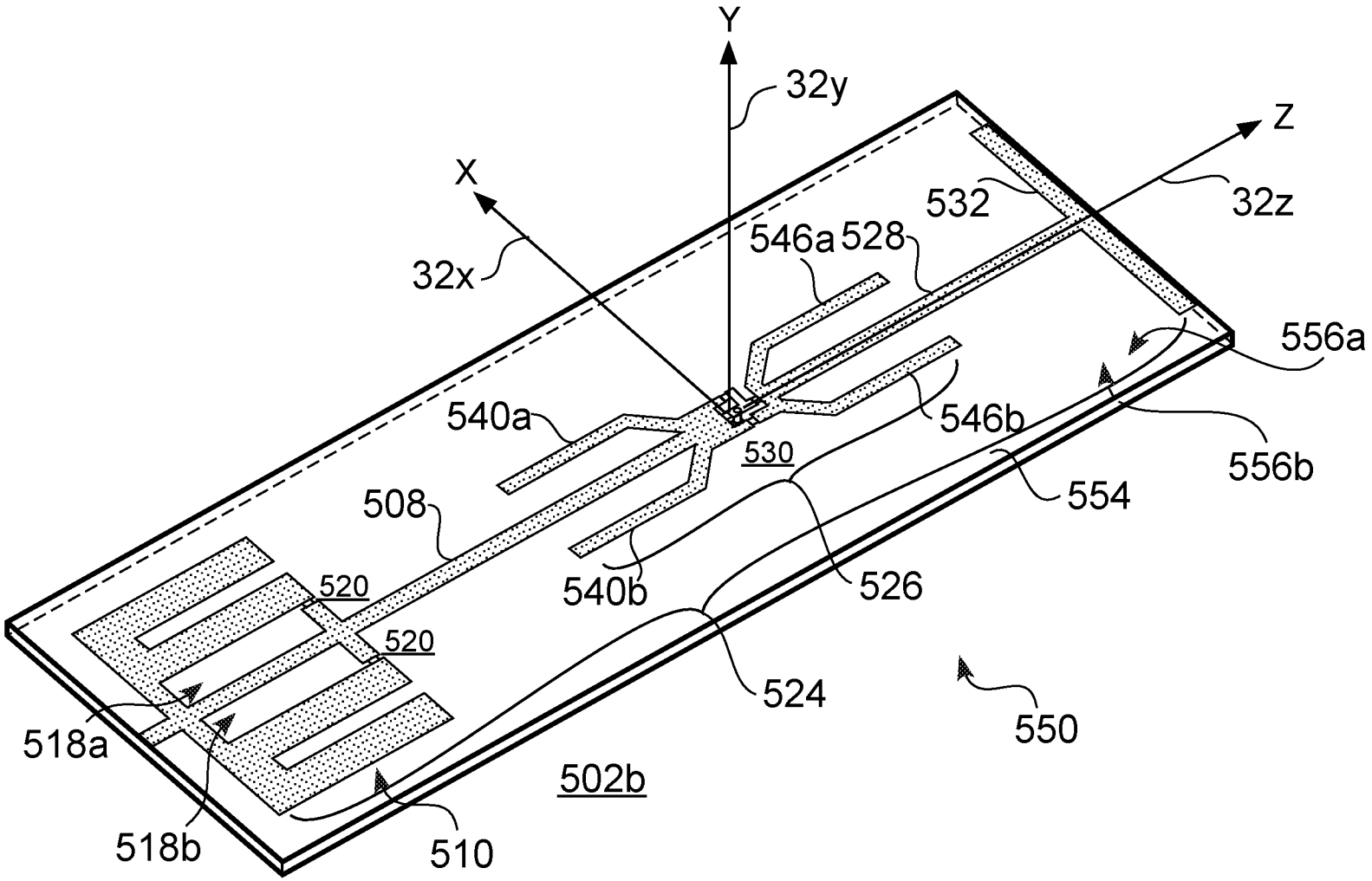
FIG. 35 shows a detailed view of an illustrative non-DC Path 2G/5G antenna structure.
Figure 45:
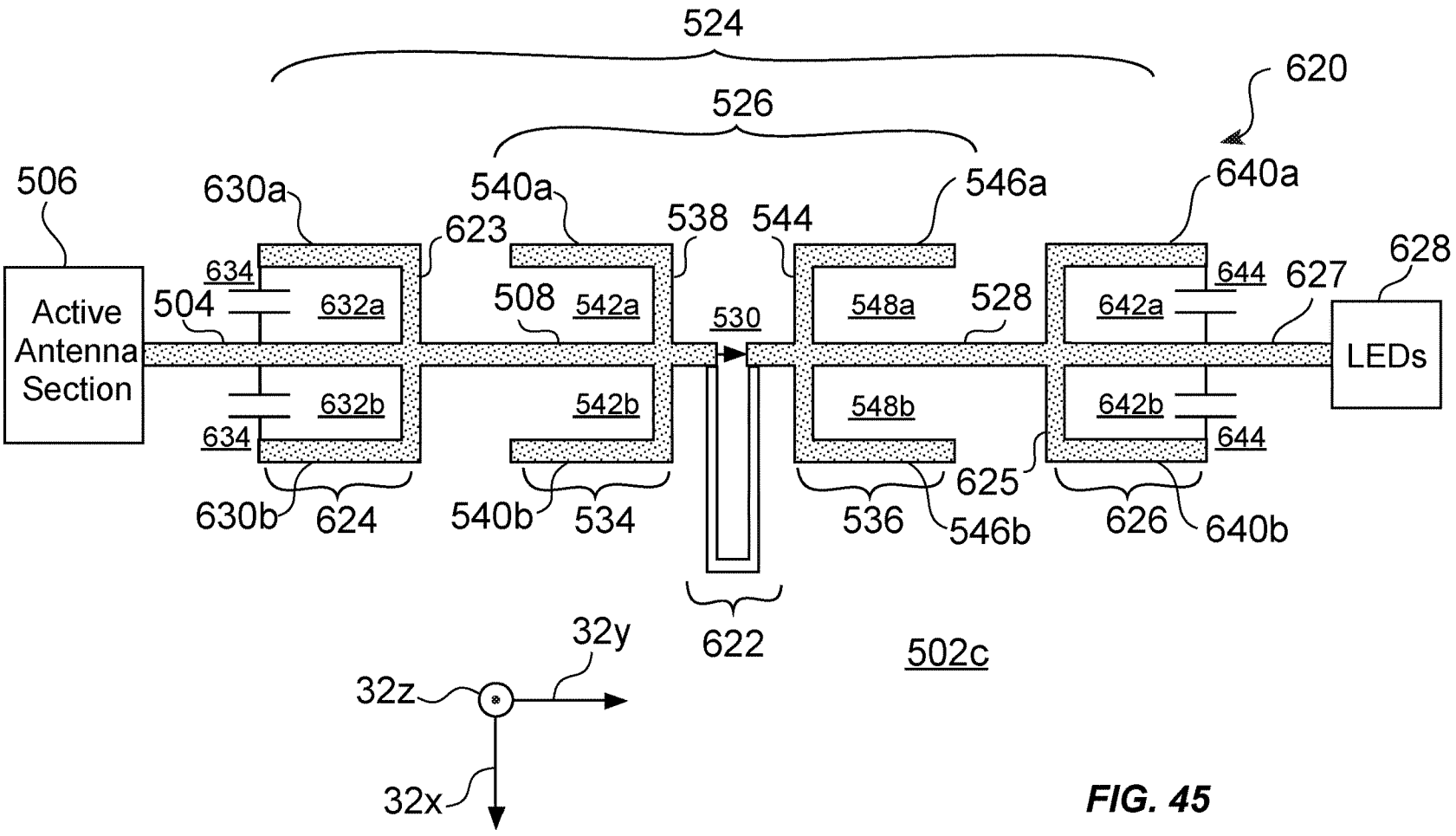
FIG. 45 is a schematic view of an illustrative DC Path 2G/5G antenna that includes 2G and 5G trap structures.

FIG. 35 shows a detailed view 550 of an illustrative non-DC Path 2G/5G antenna 502, e.g., 502*b*, for 2G/5G operation, such as for an antenna 502 embodiment that does not include connected LEDs 628 (FIG. 45). The illustrative Non-DC Path 2G/5G antenna 502*b* seen in FIG. 35 can be formed as a stand-alone structure, or can be formed on one or both surfaces 556*a*,556*b* of a printed circuit board (PCB) 554.

The illustrative Non-DC Path 2G/5G antenna 502*b* seen in FIG. 35 can provide a 2G antenna structure 524 as well as a 5G antenna structure 526, which are generally aligned with the Z-axis 32*z*.

The illustrative 2G antenna structure 524 seen in FIG. 35 includes a dual 2G-5G trap structure 510, such as described in reference to FIG. 34, wherein the dual 2G-5G trap structure 510 extends from a first longitudinal path 508, which can be connected to an active antenna section 506 (FIG. 34). The dual 2G-5G trap structure 510 seen in FIG. 35 also includes capacitors 520 for the 2G traps 518*a*,518*b*.

Figure 36:
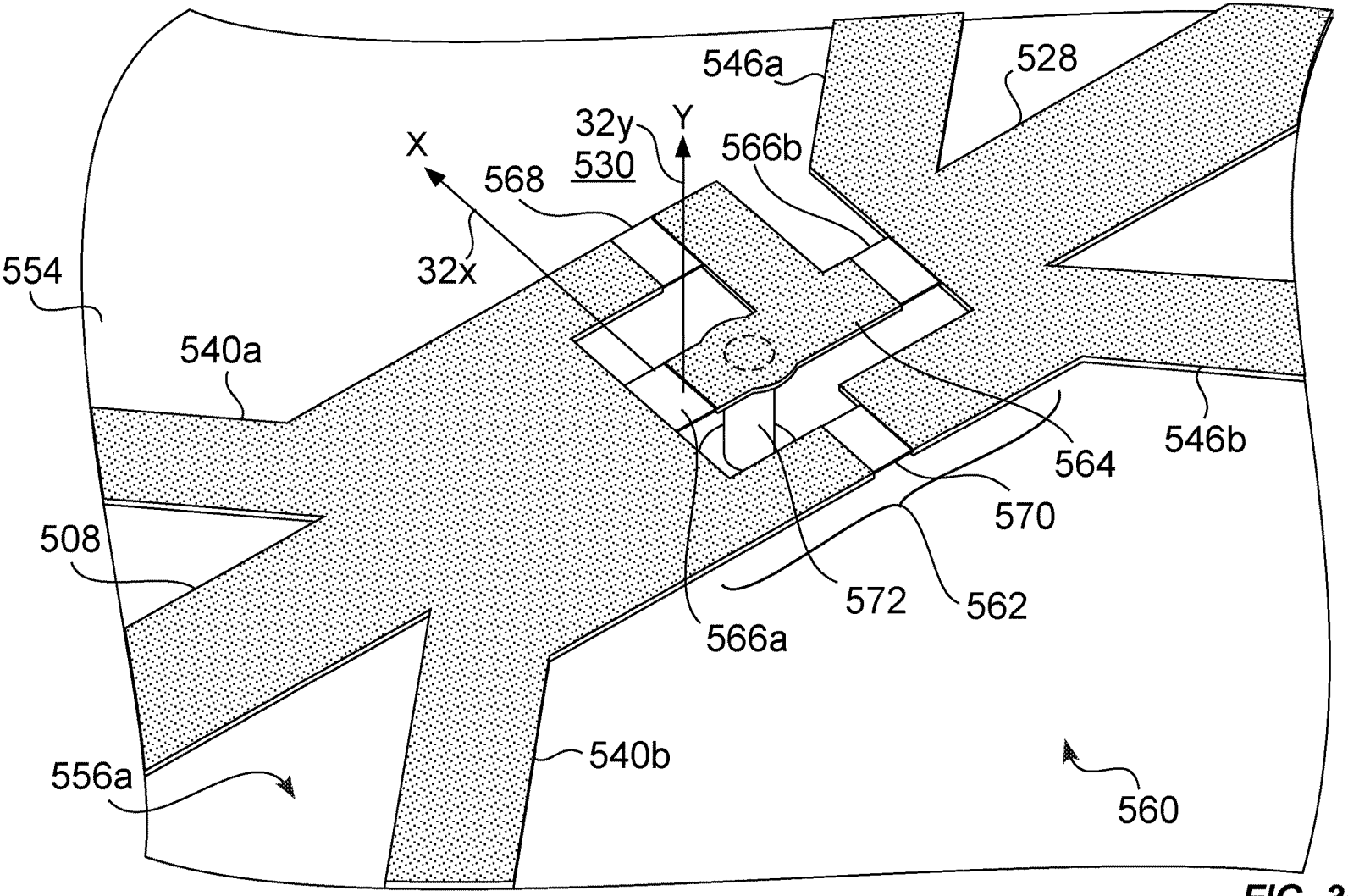
FIG. 36 is a close up view of a distribution matching structure for an illustrative Non-DC Path 2G/5G antenna, such as seen in FIG. 35.

FIG. 36 is a close up view 560 of a distribution matching structure 562 for an illustrative Non-DC Path 2G/5G antenna 502*b*, such as seen in FIG. 35. The illustrative distribution matching structure 562 seen in FIG. 36 is established on the surface 556*a* of the PCB substrate 554 across the antenna feed path 530, and can be connected, such as through an electrically conductive via 572, which extends through the PCB substrate 554.

In some embodiments, the via electrically conductive via 572 is connected to other conductive paths, e.g., DC feed path 656 (FIG. 47), or structures, e.g., a series inductor 664 (FIG. 47) and/or a series capacitor 668 (FIG. 47), located on the opposing surface 556*b* of the PCB 554.

The illustrative distribution matching structure 562 seen in FIG. 36 includes a central electrically conductive region 564 within the feed path 530. The illustrative distribution matching structure 562 seen in FIG. 36 also includes a first series capacitor 566*a* between the first longitudinal path 508 and the central region 564, and a second series capacitor 566*b* between the central region 564 and the second longitudinal path 528. An additional capacitor 568 can extend between the first longitudinal path 508 and the central region 564. A further capacitor 570 can extend directly between the first longitudinal path 508 and the second longitudinal path 528. The specific routing and capacitors of the distribution matching structure 562 can be configured to provide the desired matching characteristics for the 2G/5G antenna 502*b*. As well, the distribution matching structure 562 can readily be fabricated concurrently with a photolithographic etching process used to form the other antenna structures.

Figure 37:
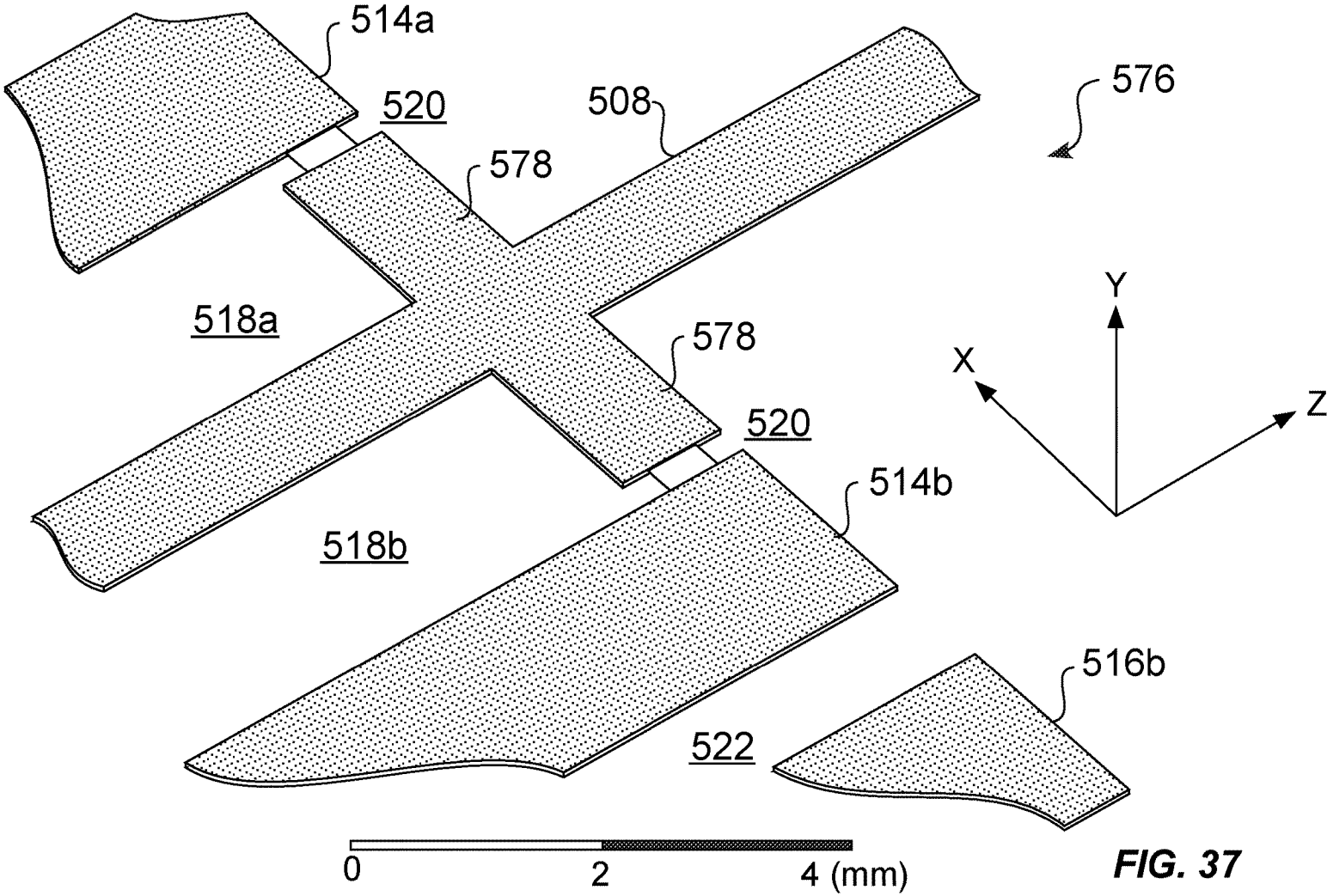
FIG. 37 is a partial close up view of an illustrative dual 2G/5G trap structure for an a Non-DC Path 2G/5G antenna.

FIG. 37 is a partial close up view 576 of an illustrative dual 2G/5G trap structure for a Non-DC Path 2G/5G antenna 502, e.g., 502*a*, 502*b*. As seen in FIG. 37, a first 2G trap 518*a* is defined between the longitudinal path 508 and path 514*a*, and a second 2G trap 518*b* is defined between the longitudinal path 508 and path 514*b*. As further seen in FIG. 37, each of the 2G traps 518*a*,518*b* includes a corresponding capacitor 520 between the longitudinal path 508 and corresponding paths 514*a*,514*b*. A traverse path 578 can extend from the longitudinal path 508 and/or a respective path 514, e.g., 514*a*, to provide the required gap for the 2G gap capacitors 520.

As additionally seen in FIG. 37 is one of a pair of 5G traps 522, which is defined between paths 514*b* and 516*b*. In some embodiments, the 5G traps 522 are included to correct the beam pattern for 5G operation.

Figure 38:
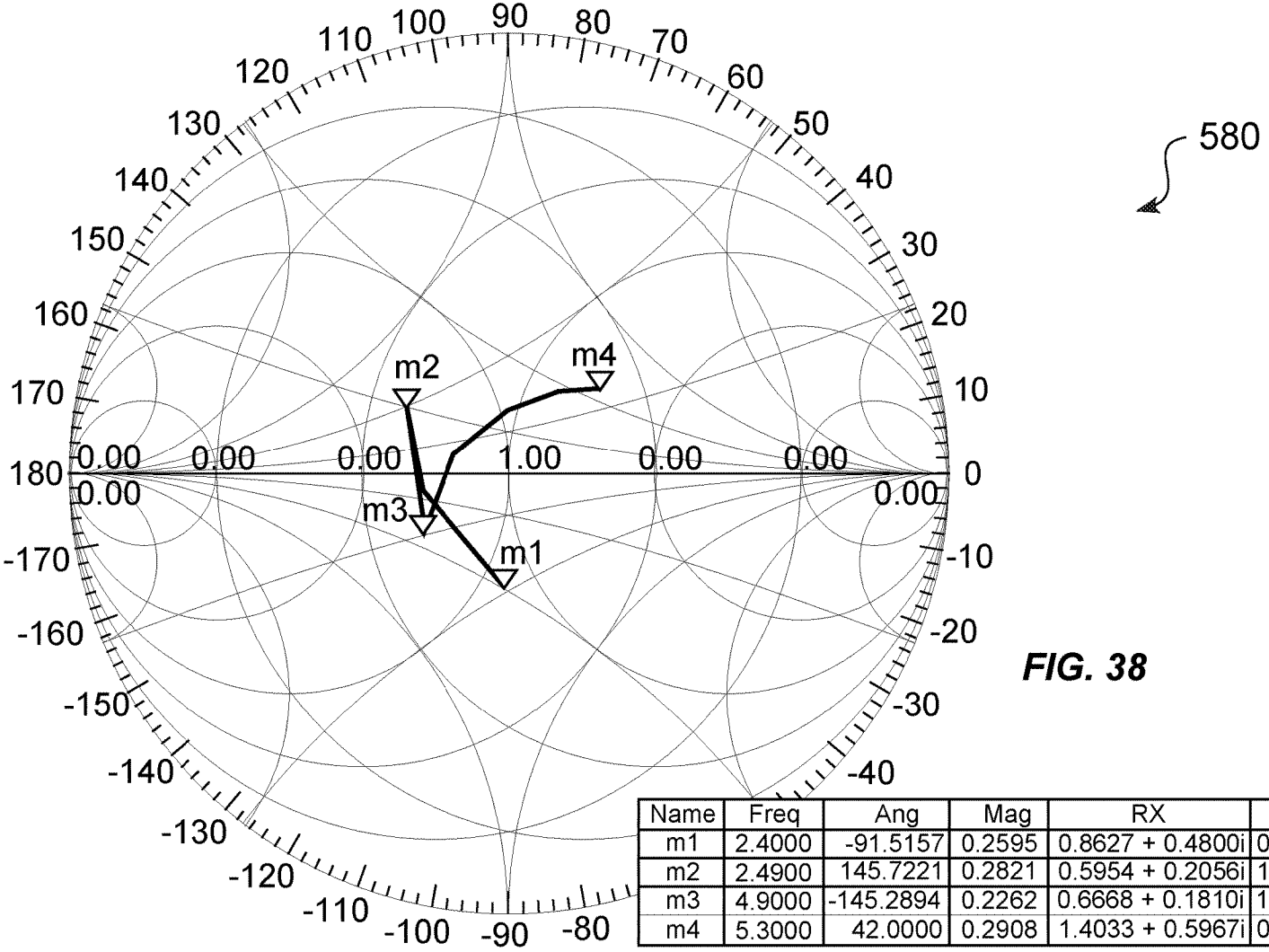
FIG. 38 is a Smith Chart that shows illustrative discrete inductive and capacitive (L & C) matching for a Non-DC Path 2G/5G antenna structure.
Figure 39:
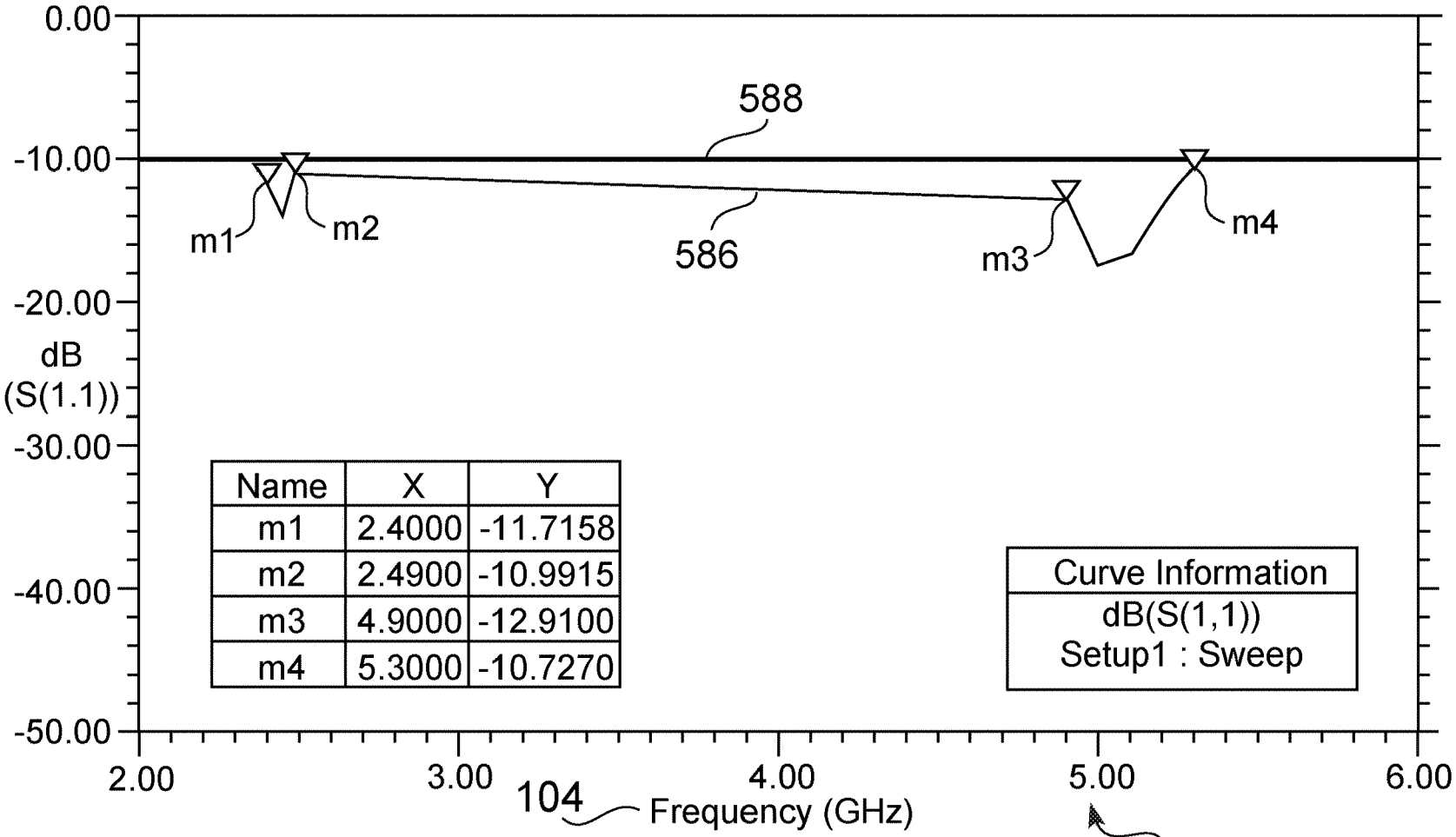
FIG. 39 is a chart that shows return loss as a function of frequency using discrete inductive and capacitive (L & C) matching with a Non-DC Path 2G/5G antenna structure.

FIG. 38 is a Smith chart 580 that shows illustrative discrete inductive and capacitive (L & C) matching for a 2G/5G antenna structure 502. FIG. 39 is a chart 584 that shows return loss as a function of frequency 104 for discrete inductive and capacitive (L & C) matching for a 2G/5G antenna structure 502, which includes a plot 586 that is based on measured performance, as compared with a goal return loss 588 of 10 dB.

Figure 40:
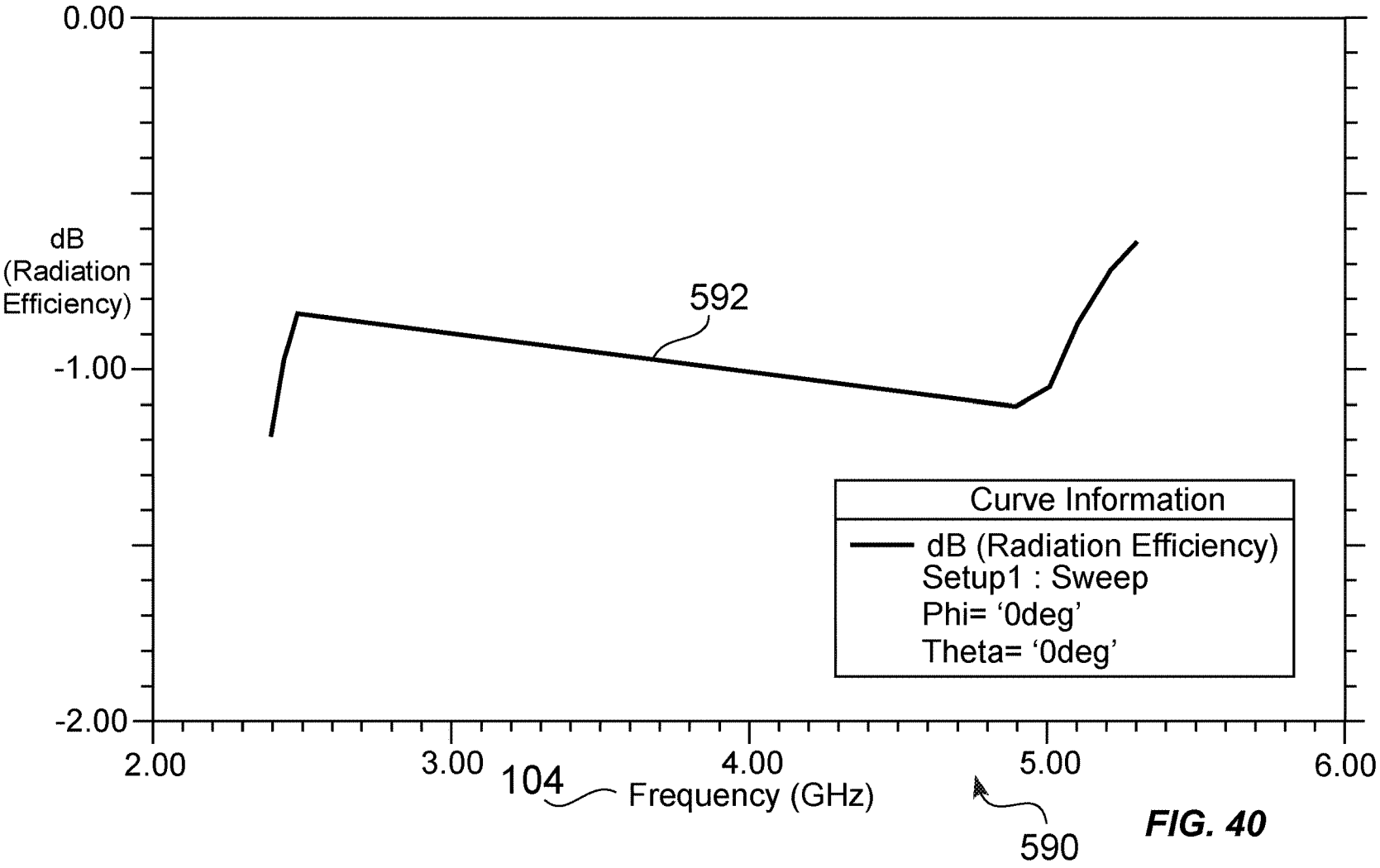
FIG. 40 is a first exemplary chart showing radiation efficiency as a function of frequency for discrete inductive and capacitive (L & C) matching using an a non-DC path 2G/5G antenna as disclosed herein.
Figure 41:
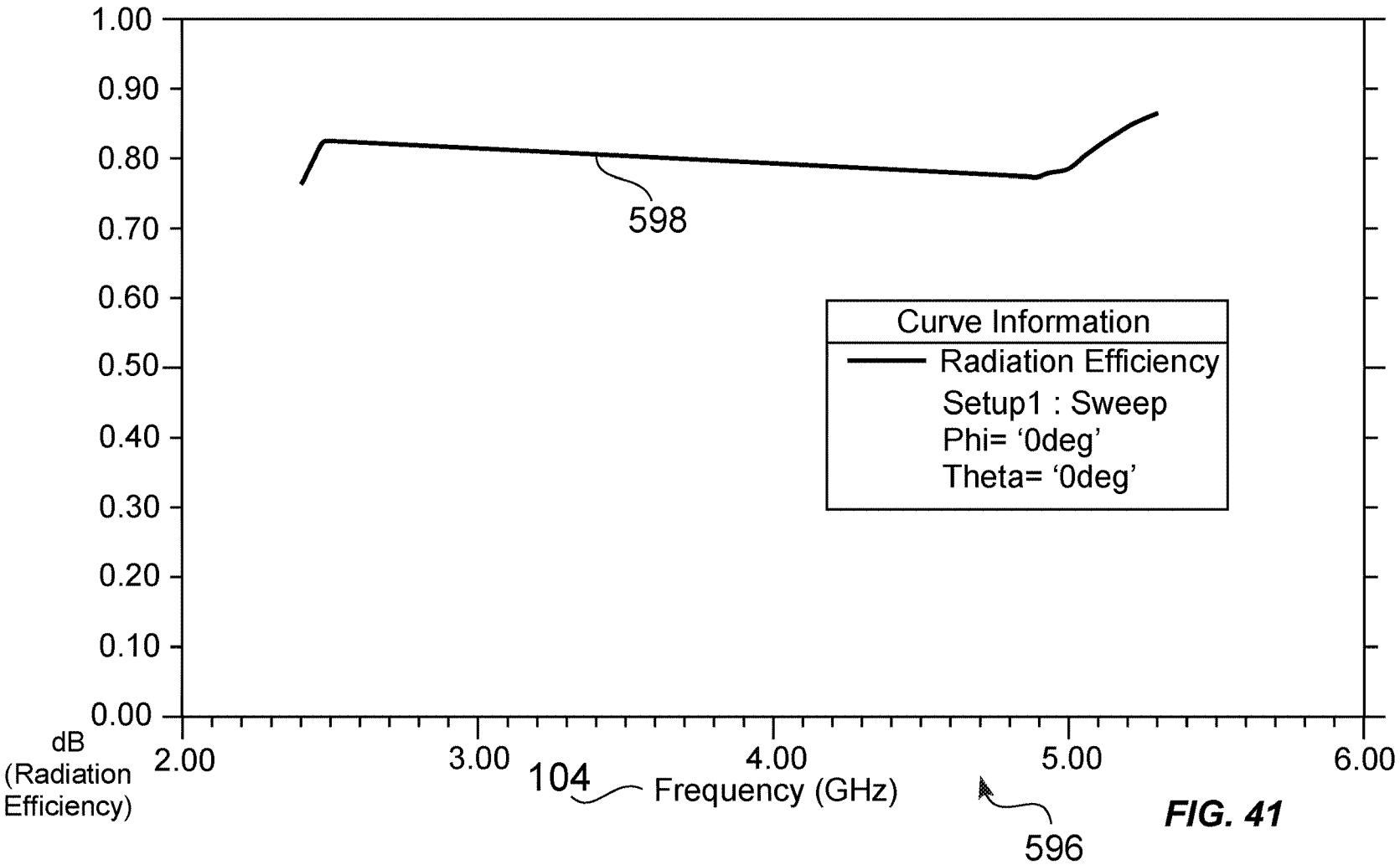
FIG. 41 is a second exemplary chart that shows radiation efficiency as a function of frequency for discrete inductive and capacitive (L & C) matching using a non-DC path 2G/5G antenna as disclosed herein.

FIG. 40 is a first exemplary graph 590 that shows a plot 592 of radiation efficiency (in dB) as a function of frequency 104 for discrete inductive and capacitive (L & C) matching using an a 2G/5G antenna 502 as disclosed herein. FIG. 41 is a second exemplary graph 596, including line 598, which shows radiation efficiency (in dB) as a function of frequency 104 for discrete inductive and capacitive (L & C) matching using a 2G/5G antenna 502 as disclosed herein.

Figure 42:
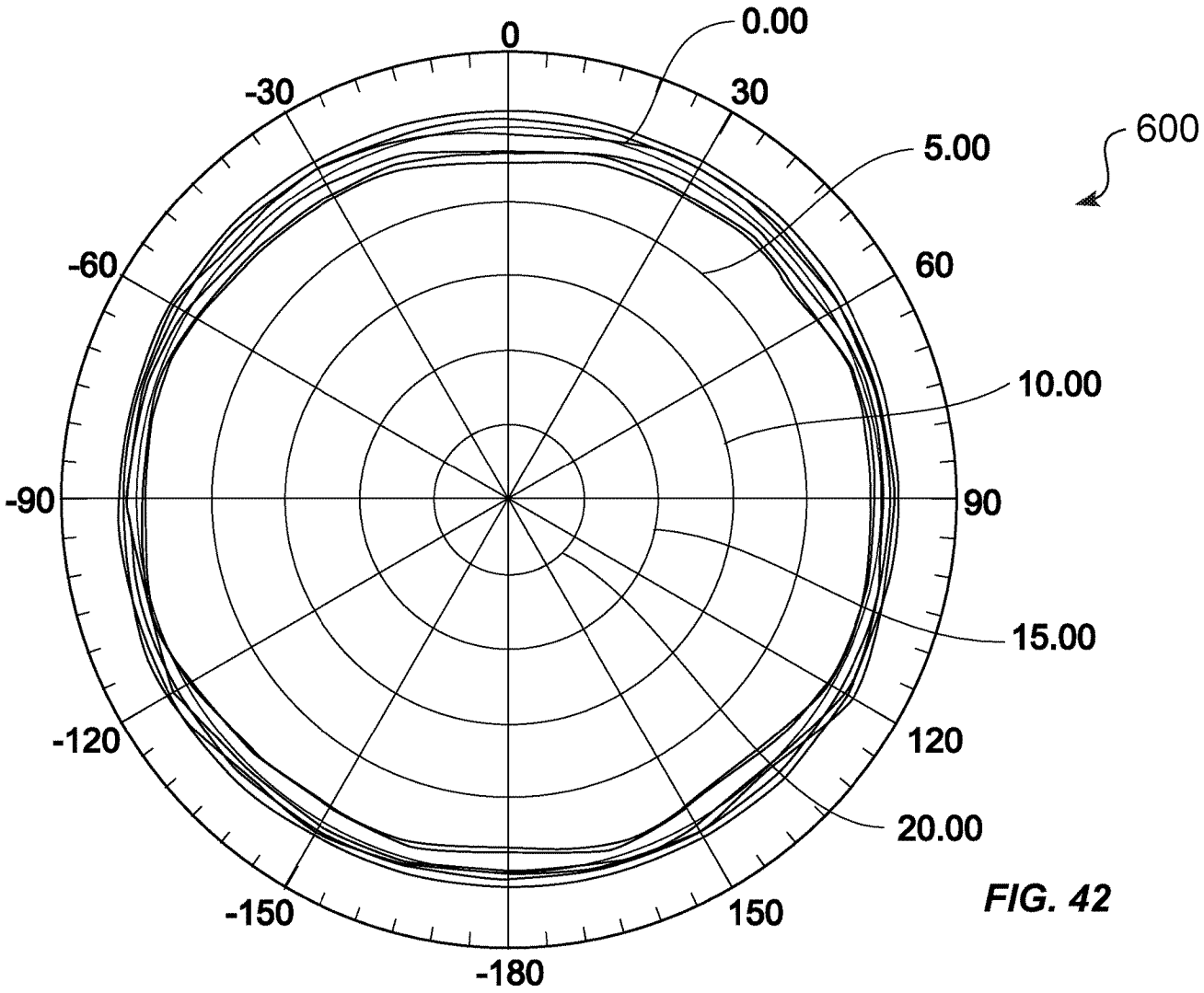
FIG. 42 is a chart showing azimuthal radiation patterns in the X-Y plane using an illustrative embodiment of a 2G/5G antenna as disclosed herein.

FIG. 42 is a chart showing azimuthal radiation patterns 600 in the X-Y plane, i.e., coplanar to a plane defined by the X-axis 32*x* and the Y-axis 32*y*, using an illustrative embodiment of a 2G/5G antenna 502 as disclosed herein.

Figure 43:
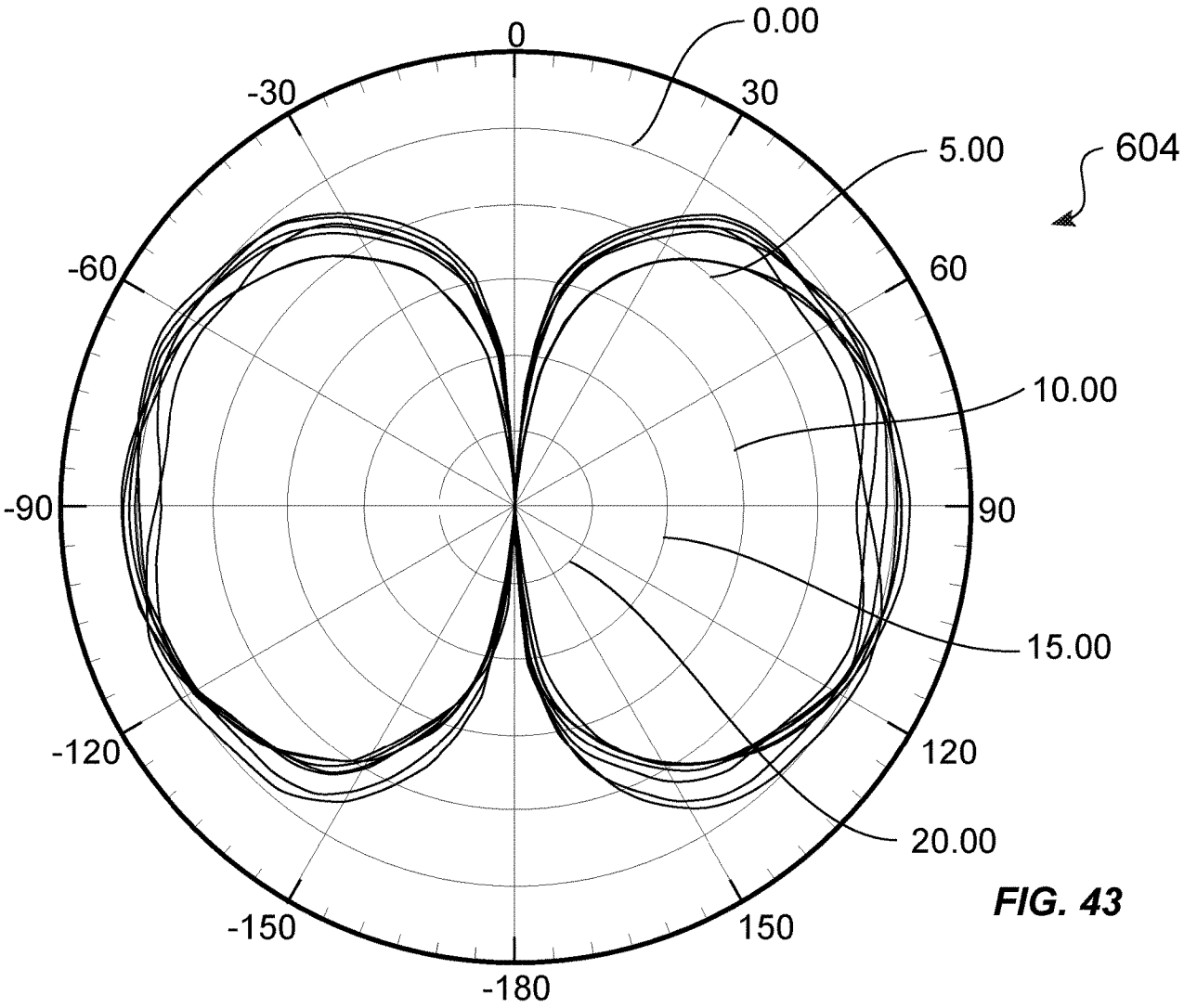
FIG. 43 is a chart showing elevation radiation patterns in the X-Z plane, using an illustrative embodiment of a 2G/5G antenna as disclosed herein.

FIG. 43 is a chart showing elevation radiation patterns 604 in the X-Z plane, i.e., coplanar to a plane defined by the X-axis 32*x* and the Z-axis 32*z*, using an illustrative embodiment of a 2G/5G antenna 502 as disclosed herein.

Figure 44:
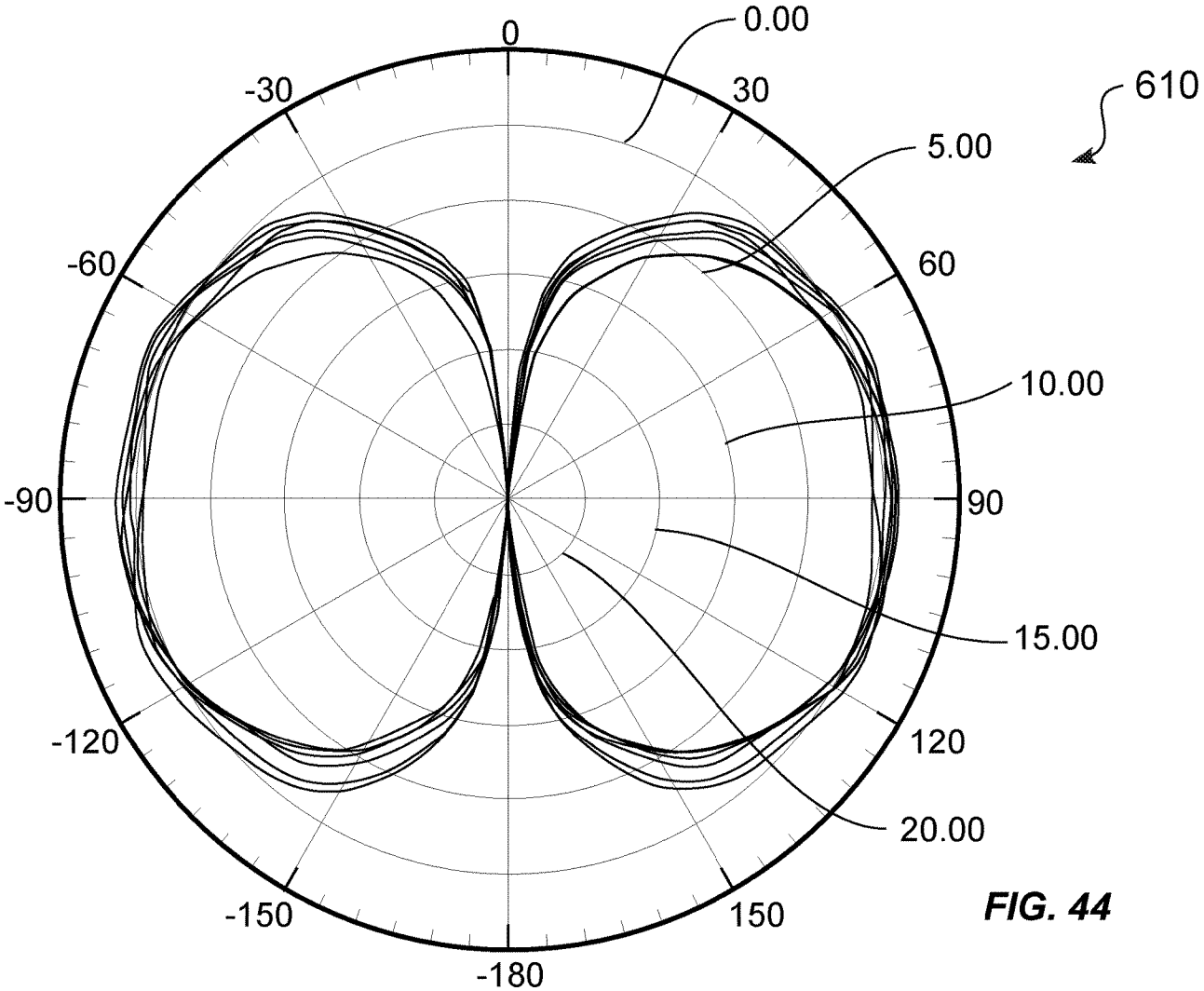
FIG. 44 is a chart showing elevation radiation patterns in the Y-Z plane, using an illustrative embodiment of a 2G/5G antenna as disclosed herein.

FIG. 44 is a chart showing elevation radiation patterns 610 in the Y-Z plane, i.e., coplanar to a plane defined by the Y-axis 32*y* and the Z-axis 32*z*, using an illustrative embodiment of a 2G/5G antenna 502 as disclosed herein.

2G/5G DC Path Antennas.

While some embodiments of the 2G/5G antenna 502, e.g., 502*a*,502*b*, as disclosed herein, do not include a DC-path, alternate embodiments of the 2G/5G antenna 502 can provide such functionality.

For instance, FIG. 45 is a schematic view 620 of an illustrative DC Path antenna 502*c*. As similarly shown in FIG. 34, the antenna 502*c* extends 504 from an active antenna section 506 to define a first longitudinal path 508, such as aligned along a Y-axis 32*y*, to establish a 2G antenna 524 as well as a 5G antenna 526, in combination with the second longitudinal path 528 and related structures.

As seen in FIG. 45, a 2G/5G trap structure 622 is provided across the feed path 530, which is configured to provide a trap for both the 2G antenna 524 and the 5G antenna 526. For instance, in an embodiment, the 2G/5G trap structure 622 is set for 3.5 GHz to provide for both antennas 524,526.

The illustrative 2G antenna 524 seen in FIG. 45 also includes a first 2G trap structure 624 that extends outward 623, e.g., along the X-axis 32*x*, from the longitudinal path 508, from which a pair of electrically conductive paths 630*a*,630*b* extend longitudinally.

The first 2G trap structure 624 seen in FIG. 45 provides two 2G traps 632*a* and 632*b*, wherein a first 2G trap 632*a* is defined between the longitudinal path 508 and path 630*a*, and wherein a second 2G trap 632*b* is defined between the longitudinal path 508 and path 630*b*. Each of the illustrative 2G traps 632*a*,632*b* seen in FIG. 45 includes a corresponding capacitor 634.

The illustrative 2G antenna 524 seen in FIG. 45 also includes a second 2G trap structure 626 that extends outward 625, e.g., along the X-axis 32*x*, from the second longitudinal path 528, from which a pair of electrically conductive paths 640*a*,640*b* extend longitudinally.

The second 2G trap structure 626 seen in FIG. 45 provides two 2G traps 642*a* and 642*b*, wherein a first 2G trap 642*a* is defined between the second longitudinal path 528 and path 640*a*, and wherein a second 2G trap 642*b* is defined between the second longitudinal path 528 and path 640*b*. Each of the illustrative 2G traps 642*a*,642*b* seen in FIG. 45 includes a corresponding capacitor 644.

The illustrative DC Path antenna 502*c* seen in FIG. 45 also includes an antenna feed 530 for both the 2G antenna 524 and the 5G antenna 526, wherein the antenna feed 530 is defined between the first longitudinal path 508 and the second longitudinal path 528, which can extend 627 for attachment to LEDs 628.

The illustrative 5G antenna 526 seen in FIG. 45 includes a first 5G antenna structure 534 defined on the first longitudinal path 508, and a second 5G antenna structure 536 defined on the second longitudinal path 528.

The illustrative first 5G antenna structure 534 seen in FIG. 45 includes a transverse path 538, and a pair of electrically conductive paths 540*a*,540*b* that extend longitudinally away from the transverse path 538, in which a first 5G trap 542*a* is defined between the longitudinal path 508 and path 540*a*, and a second 5G trap 542*b* that is defined between the longitudinal path 508 and path 540*b*.

The illustrative second 5G antenna structure 536 seen in FIG. 45 includes a transverse path 544, and a pair of electrically conductive paths 546*a*,546*b* that extend longitudinally away from the transverse path 544, in which a first 5G trap 548*a* is defined between the second longitudinal path 528 and path 546*a*, and a second 5G trap 548*b* that is defined between the second longitudinal path 528 and path 546*b*.

While the illustrative path structures seen in FIG. 45 are described as traverse and longitudinal paths, other specific configurations can be used.

An illustrative embodiment of the dual-band antenna structure 620 can therefore be configured for operation in a first frequency band and a second frequency band, wherein the second frequency band is higher in frequency than the first frequency band, wherein the dual-band antenna structure 620 is formed on a printed circuit board (PCB) 554 having a first end and a second end opposite the first end, and a first surface and 556*a* a second surface 556*b* opposite the first surface 556*a*, wherein the dual-band antenna structure 620 comprises a first path structure 508 on the first surface 556*a* of the PCB 554, a second path structure 528 on the first surface 556*a* of the PCB 554, wherein an antenna feed path 530 is defined between the first path structure 508 and the second path structure 528, a central trap structure 622 on the first surface 556*a* of the PCB 554 connecting the first path structure 508 and the second path structure 528 across the feed path 530, the central trap structure providing a trap for both the first band and the second band, and a DC feed path structure 656 on the second surface 556*b* of the PCB 554, wherein the first antenna path structure 508 extends longitudinally from the antenna feed path 530 toward the first end of the PCB 554 for connection to an active antenna section 506, wherein the second antenna path structure 528 extends longitudinally from the antenna feed path 530 toward the second end of the PCB 554, wherein the antenna structure 620 includes a first antenna 524 for operation in the first frequency band, and a second antenna 526 for operation in the second frequency band, wherein the first antenna 524 and the second antenna 526 are defined by the first path structure 508 and the second path structure 528, and include a first high band path structure 534 including a first transverse path 538 that extends outward from both sides of the first longitudinal path 508, and a pair of paths 540*a*,540*b* that extend from the first transverse path 508 away from the antenna feed 530 toward the first end of the PCB 554, wherein a pair of traps 542*a*,542*b* for the second frequency band are defined between the first longitudinal path 508 and the pair of paths 540*a*,540*b* that extend from the first transverse path 508, a second high band path structure 536 including a second transverse path 544 that extends outward from both sides of the second longitudinal path 528, and a pair of paths 546*a*,546*b* that extend from the second transverse path 528 away from the antenna feed 530 toward the second end of the PCB 554, wherein a pair of traps 548*a*, 548*b* for the second frequency band are defined between the second longitudinal path 528 and the pair of paths 546*a*, 546*b* that extend from the second transverse path 528, a first low band path structure 624 including a third transverse path 623 that extends outward from both sides of the first longitudinal path 508, a pair of paths 630*a*,630*b* that extend from the third transverse path 623 away toward the first end of the PCB 554, and a pair of capacitors 634, wherein each of the pair of capacitors 634 is connected between a corresponding one of the pair of paths 630 and the first longitudinal path 508, wherein a pair of traps 632*a*,632*b* is defined between the first longitudinal path 508 and a corresponding one of the pair of paths 630 that extend from the third transverse path 623, and a second low band path structure 626 including a fourth transverse path 625 that extends outward from both sides of the second longitudinal path 528, a pair of paths 640*a*,640*b* that extend from the fourth transverse path 625 toward the second end of the PCB 554, and a pair of capacitors 644, wherein each of the pair of capacitors 644 is connected between a corresponding one of the pair of paths 640 and the second longitudinal path 528, wherein a pair of traps 642*a*,642*b* is defined between the second longitudinal path 528 and a corresponding one of the pair of paths 640 that extend from the fourth transverse path 625, wherein the DC feed path 656 structure extends longitudinally on the second surface of the PCB 554.

Figure 46:
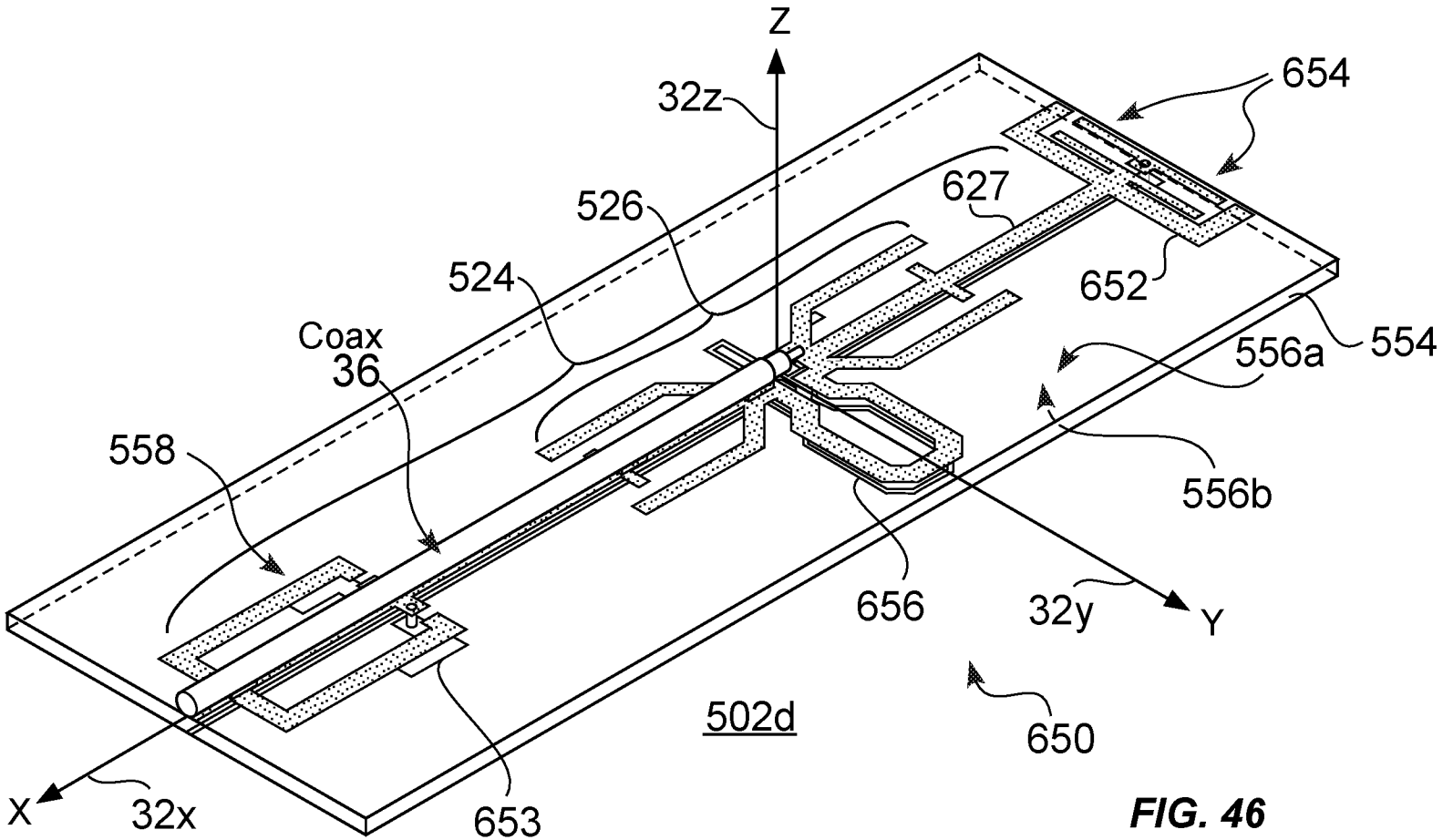
FIG. 46 is a perspective schematic view of distribution matching for dual band feed through for an illustrative DC Path 2G/5G antenna that includes 2G and 5G trap structures.

FIG. 46 is a schematic view 650 an illustrative embodiment of a DC Path 2G/5G antenna 502*d* that can be configured to provide distribution matching for dual band feed-through. The illustrative DC Path 2G/5G antenna 502*d* seen in FIG. 46 can be formed on opposing surfaces 556*a*, 556*b* of a printed circuit board (PCB) substrate 554, such as to provide a 2G antenna structure 524 as well as a 5G antenna structure 526, which are generally aligned with the X-axis 32*x*.

The illustrative 2G antenna structure 524 seen in FIG. 46 includes a 2G trap structure 558,653 on one or both surfaces 556*a*,556*b*, such as extending from a central longitudinal path 508 (FIG. 34), in which the central longitudinal path 508 can also be connected to an active antenna section 506 (FIG. 45). The illustrative trap structure 653 seen in FIG. 46 includes vias 572 (FIG. 36) that extend between surfaces 556*a* and 556*b*, and also includes formed paths on surface 556*b* that can be used to provide trap capacitor structures in conjunction with the trap structure 558 on surface 556*a*.

The illustrative 2G antenna structure 524 seen in FIG. 46 is attached to a coaxial cable 36, such as 1.37 mm mini coax cable 36, that extends longitudinally, such as proximate to the longitudinal path 508, and is connected to the antenna structure 524 across the antenna feed 530 (FIG. 45). The illustrative 2G antenna structure 524 seen in FIG. 46 also includes a DC feed path 656 on the surface 556*b* of the PCB 554 opposite to the 2G antenna structure 524 and the 5G antenna structure 526. The illustrative outer traverse path 652 seen in FIG. 46, which extends from the second longitudinal path 528, can include a mounting location 654 for one or more LEDs 628 (FIG. 45). In some embodiments, the LEDs 628 are retained within the indicated area associated with the outer traverse path 652.

Figure 47:
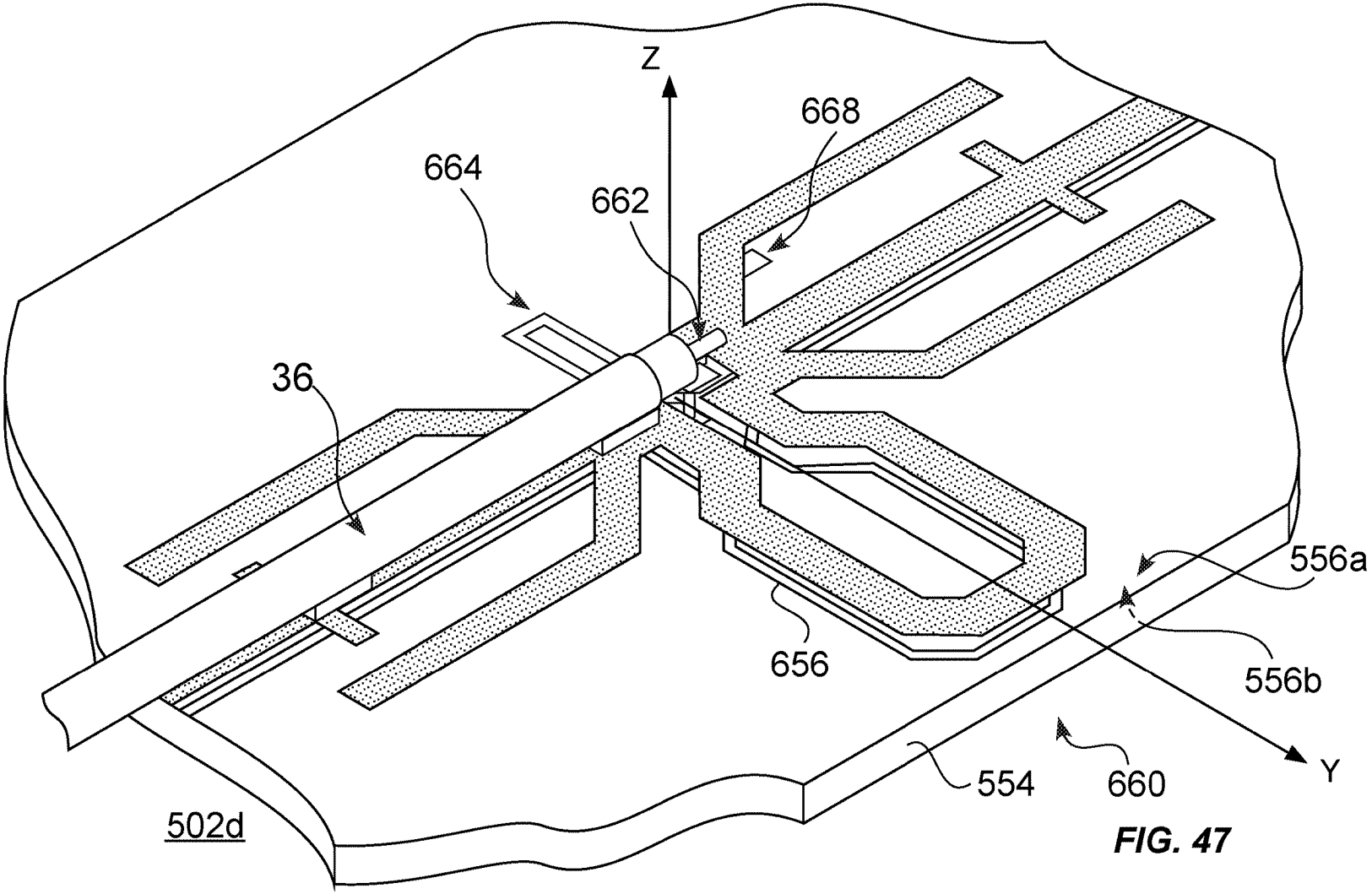
FIG. 47 is a detailed partial view of a dual band feed through for a 2G/5G antenna.

FIG. 47 shows a detailed partial view 660 of a DC Path 2G/5G antenna 502*d* that is configured to provide distribution match for dual band feed-through. The coax 36 is connected to the antenna feed 530 (FIG. 45) through a coax feed point 662. In addition to the DC peed path 656, the DC Path 2G/5G antenna 502*d* seen in FIG. 47 includes a series inductor 664 and a series capacitor 668, which can be matched.

Figure 48:
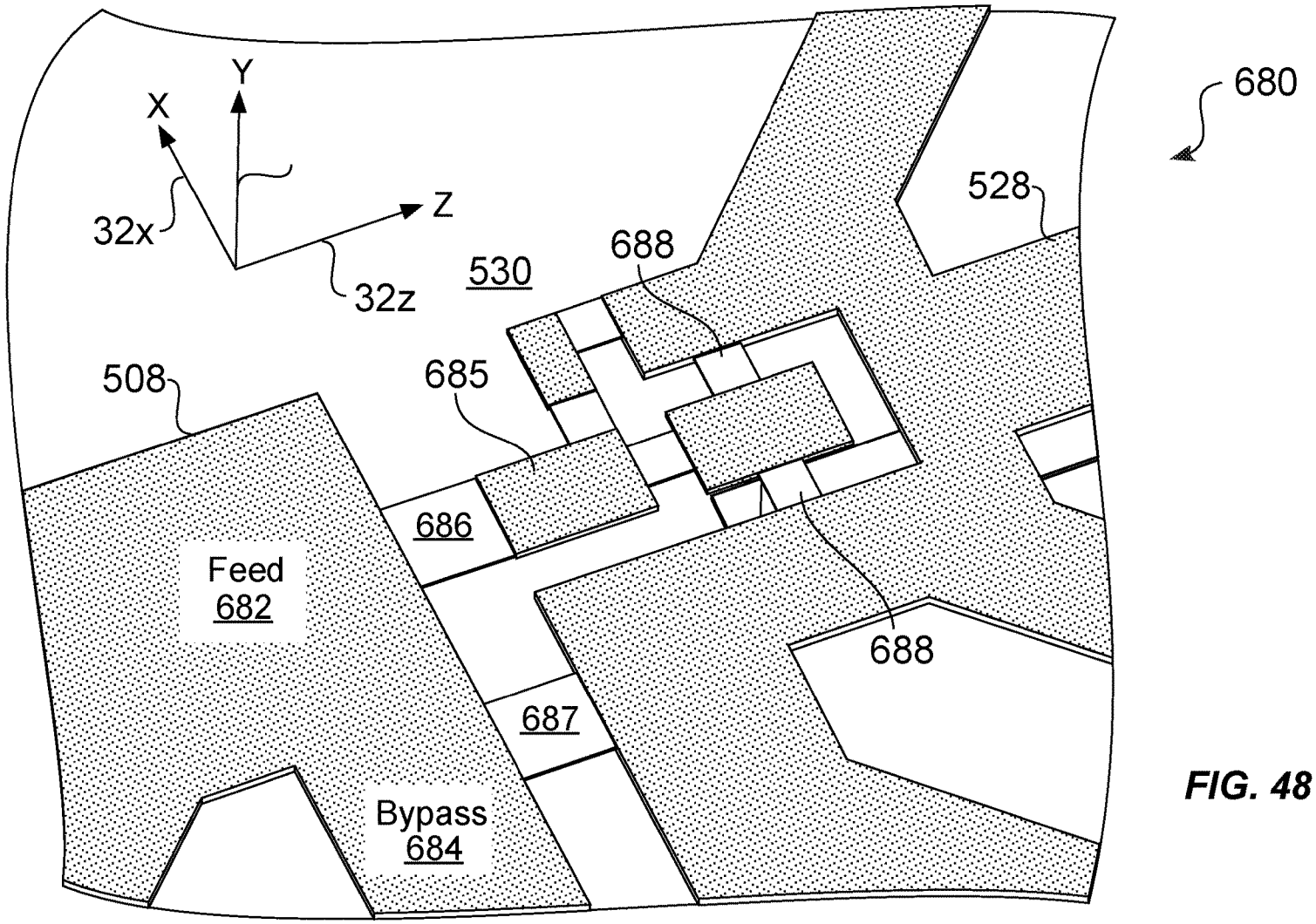
FIG. 48 is a close up view of match, feed and DC bypass for an illustrative 2G/5G antenna, such as for powering onboard LEDs.

FIG. 48 is a close up view 680 of illustrative match, feed and DC bypass structures for a 2G/5G antenna structure 502, e.g., 502*c*, 502*d*, that includes a DC bypass 656, such as for powering onboard LEDs 628. As seen in FIG. 48, an antenna feed region 682 is generally located as the first longitudinal path 508 approaches the antenna feed gap 530.

One or more electrically conductive regions 685 are located within the feed gap 530 which, in conjunction with one or more series capacitors 686, one or more shunt capacitors 687, and one or more bypass capacitors 688, can be used to provide discrete inductive (L) and capacitive (C) matching for the 2G/5G antenna structure 502, e.g., 502*c*, 502*d*.

Figure 49:
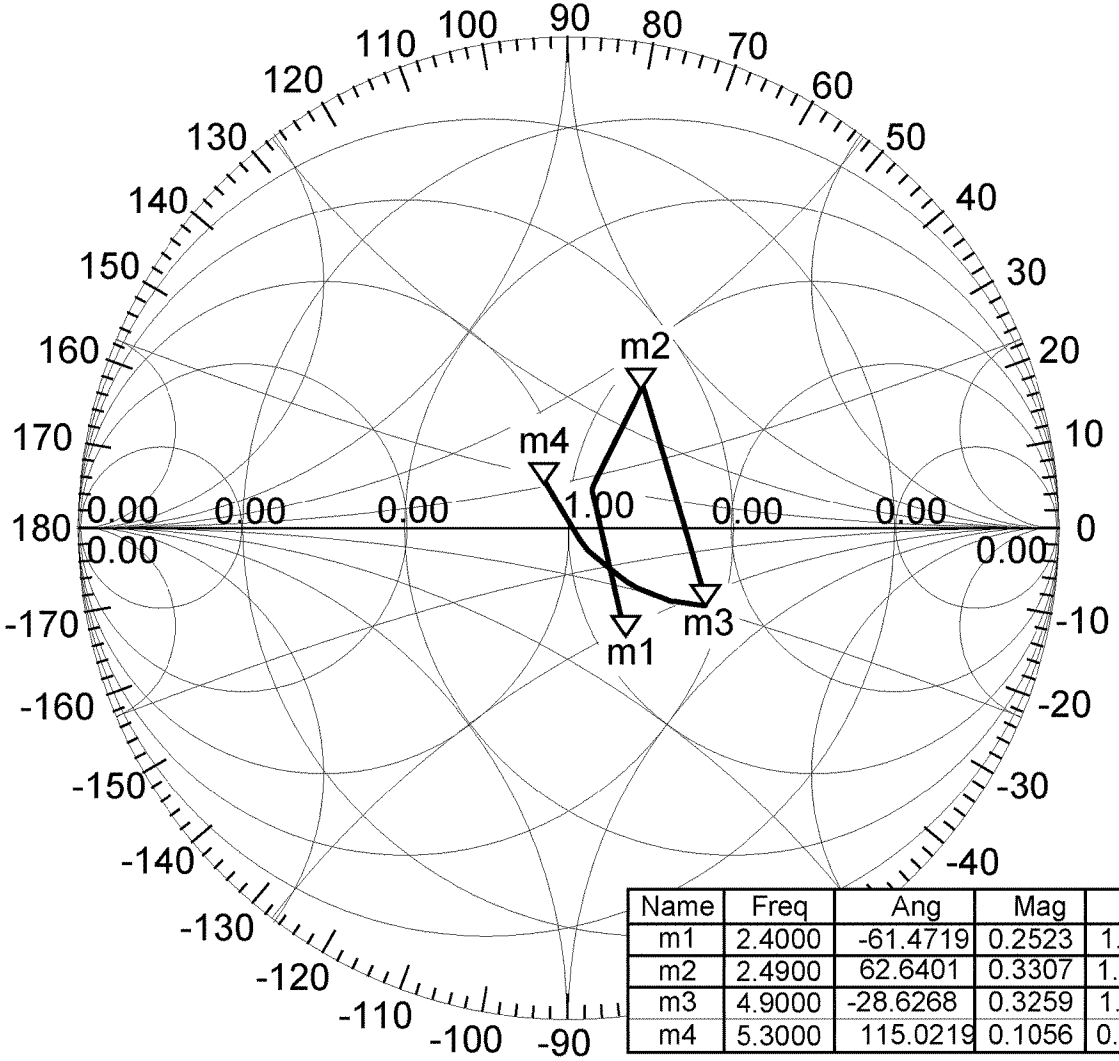
FIG. 49 is a Smith chart for an illustrative DC Path 2G/5G antenna.
Figure 50:
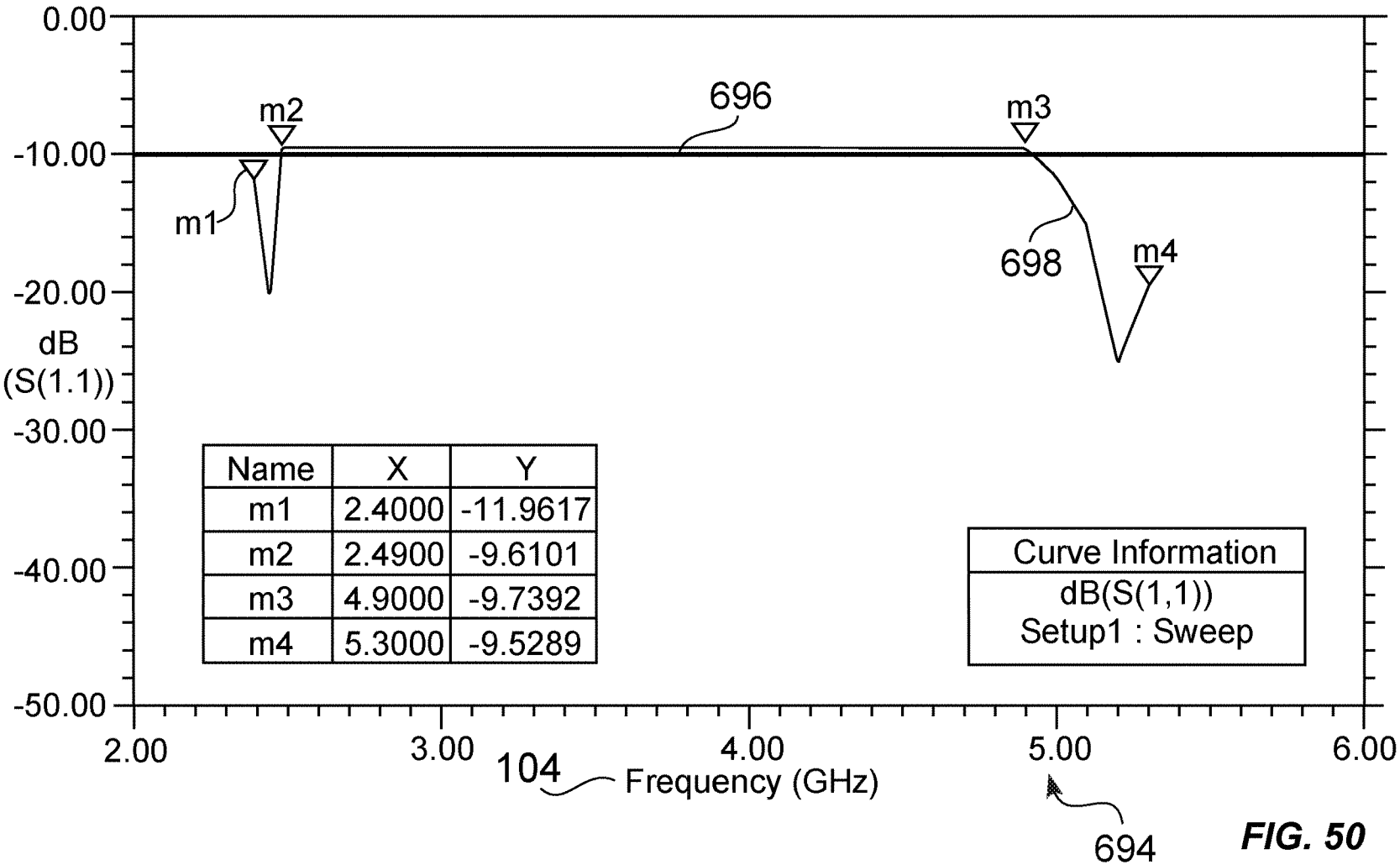
FIG. 50 is a graph that shows return loss as a function of frequency using discrete inductive and capacitive (L & C) matching with an illustrative DC Path 2G/5G antenna.

FIG. 49 is a Smith chart 690 for an illustrative DC Path 2G/5G antenna 502, e.g., 502*c*, 502*d*. FIG. 50 is a graph 694 that shows return loss as a function of frequency using discrete inductive and capacitive (L & C) matching with an illustrative DC Path 2G/5G antenna 502, which includes a plot 698 that is based on measured performance, as compared with a goal return loss 696 of 10 dB.

Figure 51:
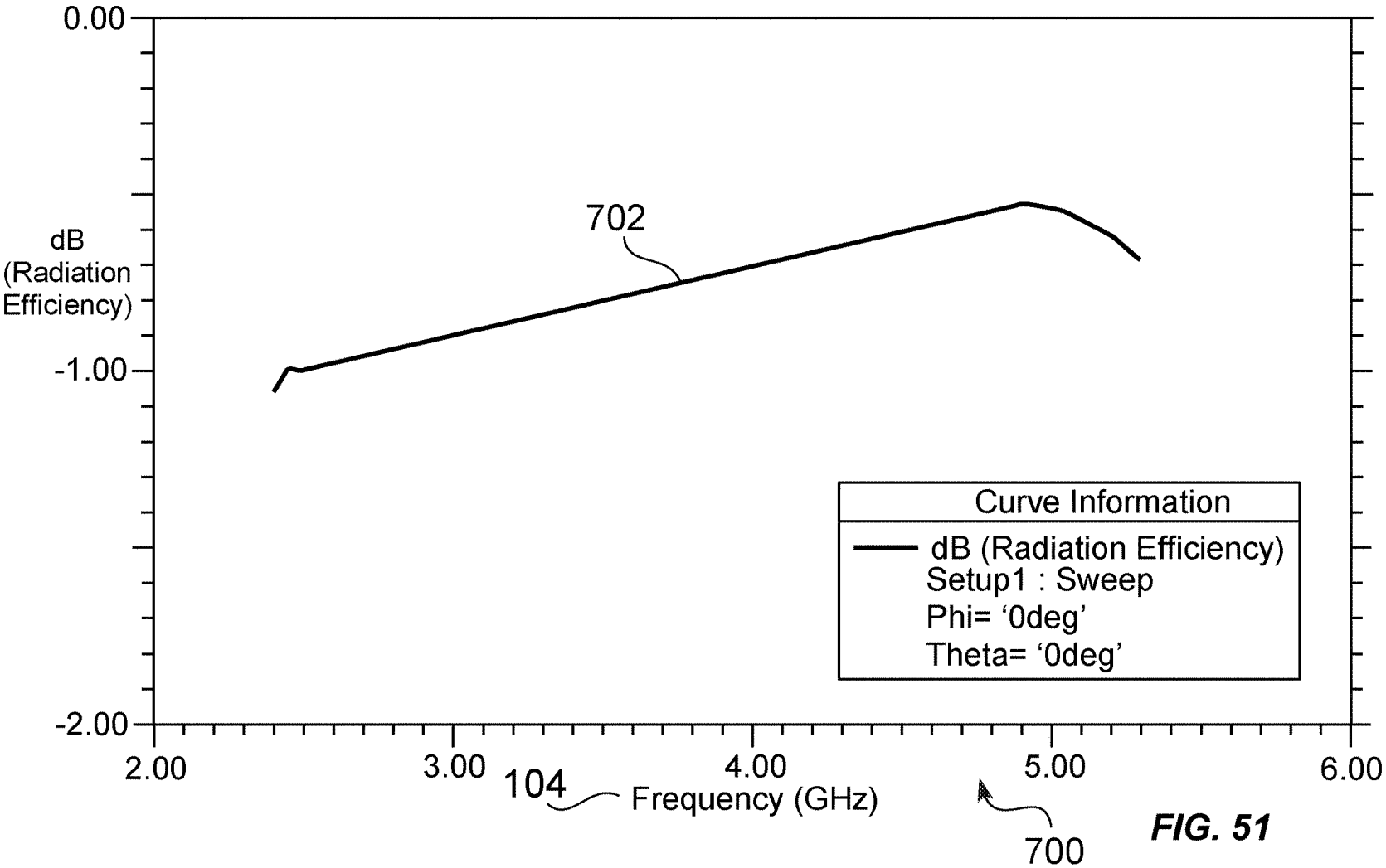
FIG. 51 is a first exemplary graph showing radiation efficiency (dB) as a function of frequency for discrete inductive and capacitive (L & C) matching using an illustrative DC Path 2G/5G antenna as disclosed herein.
Figure 52:
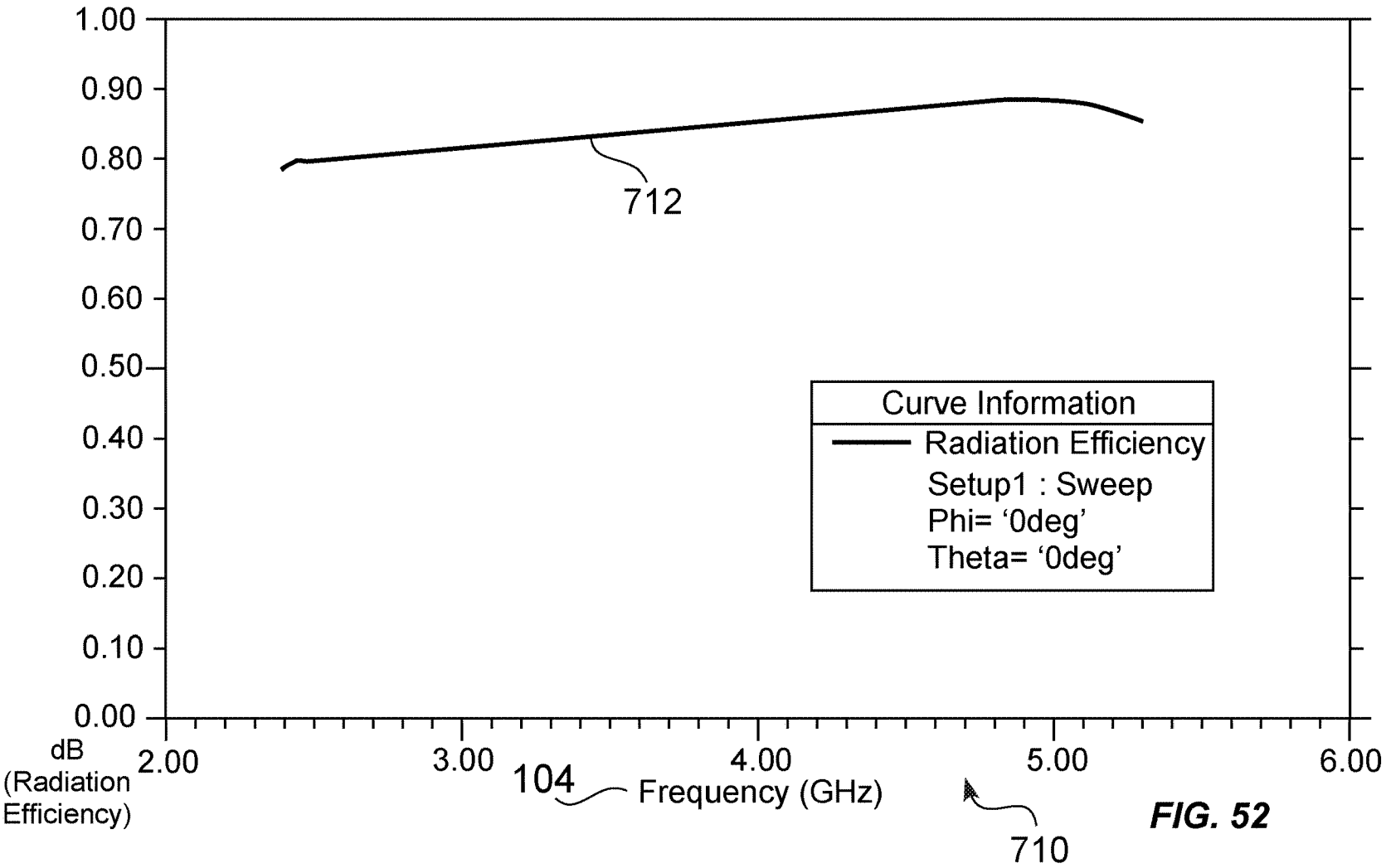
FIG. 52 is a second exemplary graph that shows radiation efficiency as a function of frequency for discrete inductive and capacitive (L & C) matching using an illustrative DC Path 2G/5G antenna as disclosed herein.

FIG. 51 is a first graph 700 showing radiation efficiency (dB) 702 as a function of frequency for discrete inductive and capacitive (L & C) matching using an illustrative DC Path 2G/5G antenna 502, e.g., 502*c*, 502*d*, as disclosed herein. FIG. 52 is a second graph 710 that shows radiation efficiency 712 as a function of frequency for discrete inductive and capacitive (L & C) matching using an illustrative DC Path 2G/5G antenna 502, e.g., 502*c*, 502*d*, as disclosed herein.

Balanced 2G/5G Internal Flat Metal Antennas.

Figure 53:
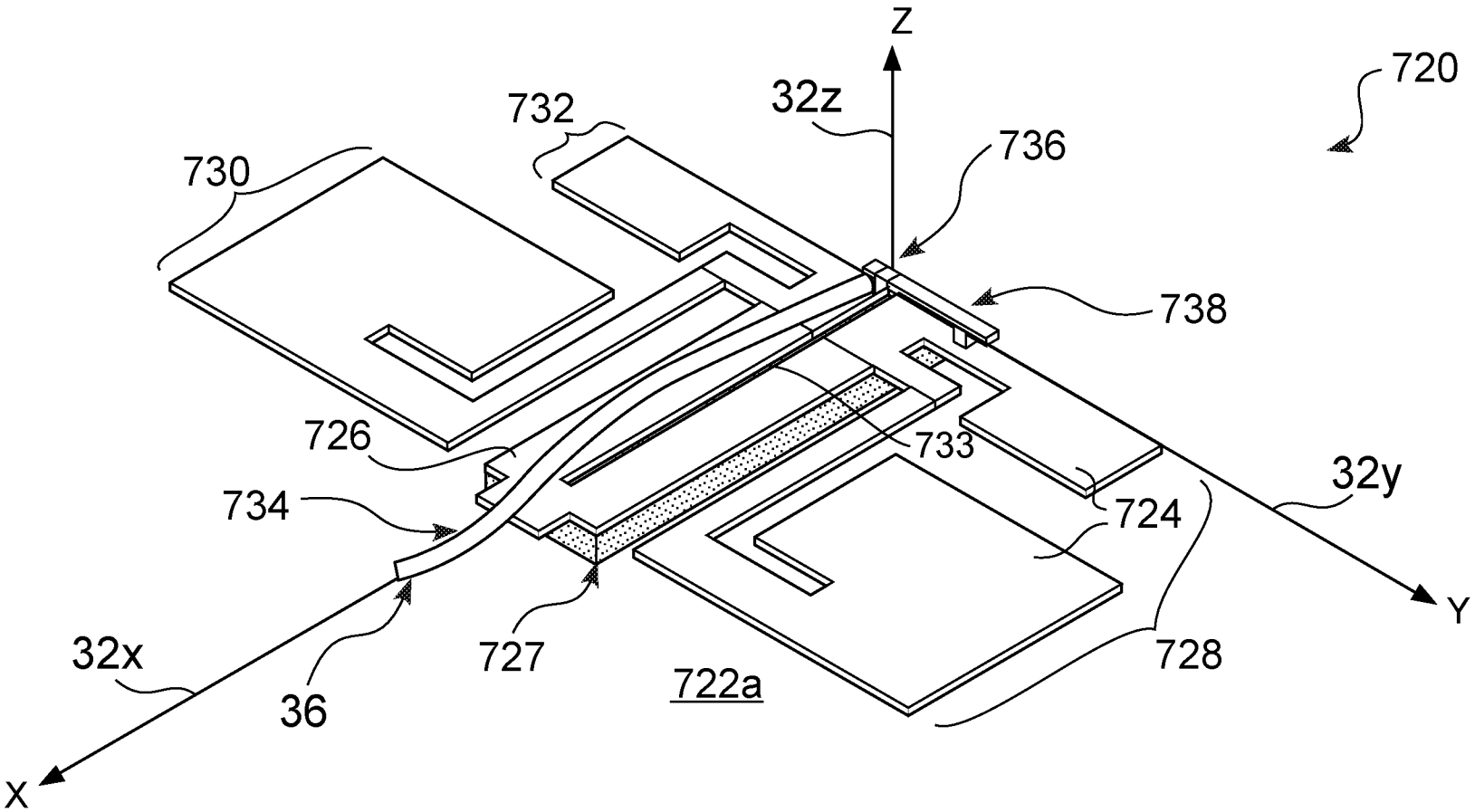
FIG. 53 is a schematic view of an illustrative embodiment of a balanced dual-band internal flat metal antenna, such for a 2G/5G device.

FIG. 53 is a schematic view 720 of an illustrative embodiment of a balanced dual-band flat metal antenna 722, e.g., 722*a*, such as to be mounted internally within a 2G/5G device. The dual-band antenna structure 722*a* can be balanced to minimize leakage currents.

Figure 54:
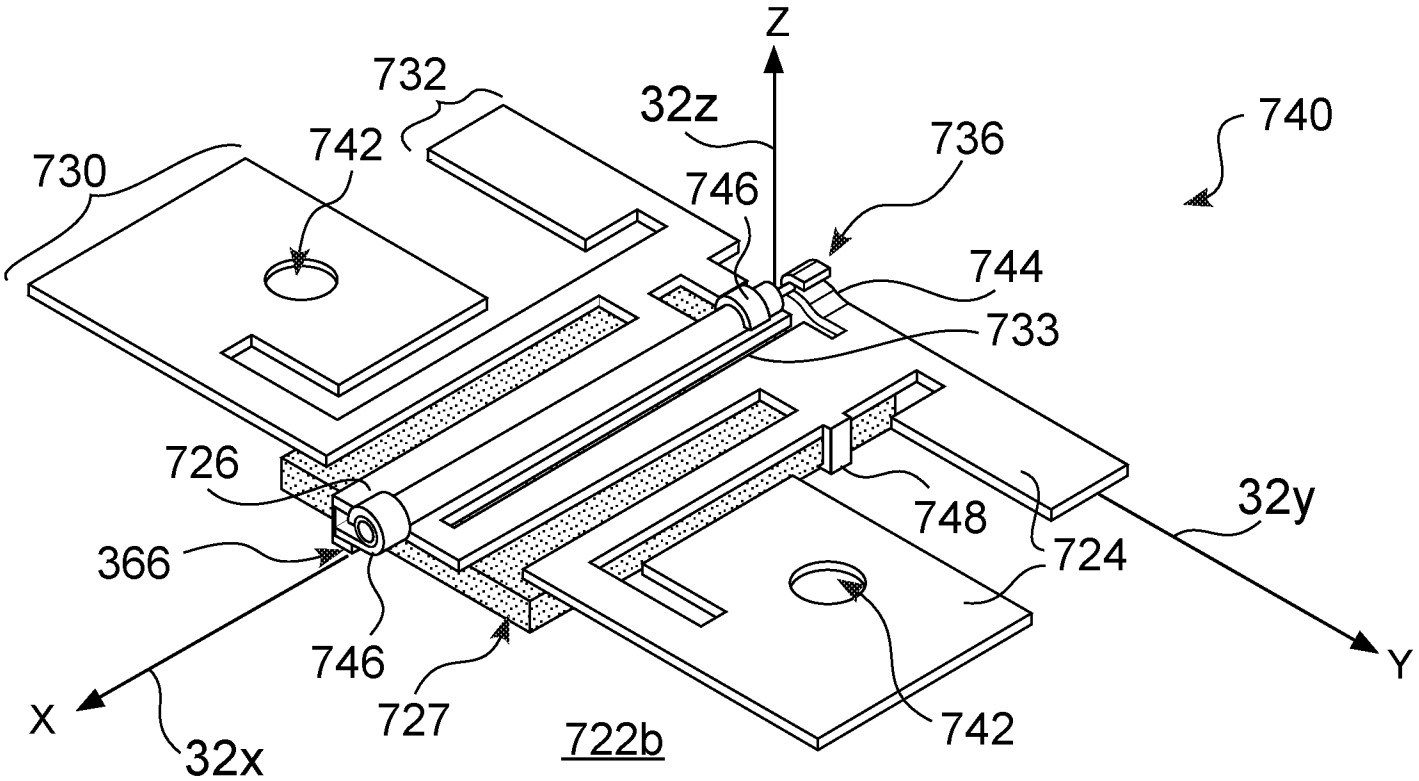
FIG. 54 is a schematic view of an alternate illustrative embodiment of a balanced dual-band internal flat metal antenna, such as for 2G/5G service.

FIG. 54 is a schematic view 740 of an alternate illustrative embodiment of a balanced dual-band internal flat metal antenna 722*b*, such as for 2G/5G service. The alternate dual-band antenna structure 722*b* can similarly be balanced to minimize leakage currents.

The disclosed illustrative embodiments of flat dual band, e.g., 2G/5G, metal dipole antenna structures 722, e.g., 722*a*,722*b*, such as shown in FIG. 53 and FIG. 54, can be fabricated from metal plate, such as stamped tin plated steel, or brass, and can be fabricated at a very low cost.

The metal dipole antenna structures 722 can be balanced to minimize leakage currents. In some embodiments, the overall size of the antennas 722 is 30 mm by 15 mm. In some embodiments, the antennas 722 are configured to secure the coax shield and center conductor by crimped connections only. In some embodiments, a central dielectric stiffener 727 is used, such as comprising polycarbonate, to support and tune the structure. In some embodiments, the stiffener 727 can be secured to the metal antenna by integrated tabs, e.g., 748 (FIG. 54).

The illustrative antenna structure 722*a* seen in FIG. 53 includes a flat metal plate 724, such as brass or tin plated steel. An illustrative embodiment of the metal plate 724 shown in FIG. 53 has a length of 30 mm, a depth of 14.5 mm, and a thickness of 0.25 mm. The illustrative metal plate 724 seen in FIG. 53 extends from a central region 726, such as with respect to the Y-Axis 32*y*, to define a balanced 2G/5G set 728 of antennas, including a 2G antenna 730 and a 5G antenna 732, which are separated by a feed slot 733. The central region 726 extends transversely, such as with respect to the X-Axis 32*x*, from a coax feed entry point 734 to a coax feed point 736, wherein a coaxial cable 36 can be attached. As also seen in FIG. 53, matching can be provided via a coax center conductor 738. In some embodiments, the coax shield 40 and the center conductor 44 are secured by crimps only, such as without the need of separate fasteners or soldered connections.

The illustrative balanced dual-band internal flat metal antenna 722*a* seen in FIG. 53 also includes a dielectric stiffener 727 that is affixed to the central region 726, such as to support and tune the metal plate 724, such as through the central region 726. In some embodiments, the dielectric stiffener 727 is secured to the metal plate 724 by metal tabs 748 (FIG. 54).

The illustrative flat metal plate 724 seen in FIG. 54 can similarly be fabricated, such as by stamping, out of electrically conductive metal sheet 724, such as brass or tin plated steel. An illustrative embodiment of the plate 724 has a length of 30 mm, a depth of 15 mm, and a thickness of 0.25 mm. The illustrative metal plate 724 seen in FIG. 54 extends from a central region 726, such as with respect to the Y-Axis 32*y*, to define a balanced 2G/5G set of antennas, including a 2G antenna 730 and a 5G antenna 732.

The illustrative metal plate 724, such as seen in FIG. 54, can include one or more mounting holes 742 defined therethough, such as for internal mounting of the flat metal antenna 722*b* within a corresponding device, e.g., a 2G/5G device.

The central region 726 extends transversely, such as with respect to the X-Axis 32*x*, from a first crimp or other fastening mechanism 746, to a second crimp or other fastening mechanism 746 proximate to the coax feed point 736, wherein the center conductor of the coaxial cable 36 is electrically and mechanically attached at a matching stub 744. In some embodiments, the coax shield 40 and the center conductor 44 are secured by crimps only.

The illustrative balanced dual-band internal flat metal antenna 722*b* also includes a dielectric stiffener 727 that is affixed to the central region, such as to support and tune the metal plate 724, such as through the central region 726. In some embodiments, the dielectric stiffener 727 is secured to the metal plate 724 by metal tabs 748.

Some embodiments of the dual-band internal flat metal antennas 722 can provide features such as the use of 0.25 mm brass stock metal plates 724, and/or 1.13 mm low loss coax 36, U.FL miniature connectors. In some embodiments of the dual-band internal flat metal antennas 722, mechanical support for the antenna 722 is provided by the plate 724 itself, such as depending on the metal thickness and type, and the geometry of the structure. In embodiments in which a stiffener 727 is used, polycarbonate, such as having a thickness 1.0 mm, can help to ensure the structural integrity of the antenna 722.

An illustrative embodiment of the antenna structure 722 comprises a metal plate 724 having a first surface and a second surface opposite the second surface, the metal plate 724 including a planar antenna structure including a central region 726 that extends from an feed entry side 734 to a feed point side 736, wherein a slot 733 extends from the feed point side 736 toward the feed entry side 734 to define a feed gap, a first dipole antenna structure 730 extending from the central region 726 for operation on a first frequency band, and a second dipole antenna structure 732 extending from the central region 726 for operation in a second frequency band, wherein the second frequency band is higher than the first frequency band, the first dipole antenna structure 730 including a first dipole half that extends outward in a first direction from the central region 726, and a second dipole half that extends outward in a second direction opposite the first direction from the central region 726, the second dipole antenna structure 732 including a first dipole half that extends outward in a first direction from the central region 726, and a second dipole half that extends outward in a second direction opposite the first direction from the central region 726, an attachment 744 for a center conductor 44 extending from a lead end of a coaxial feed cable 36 at an antenna feed point located at the feed point side 736, and an attachment, e.g., 746 (FIG. 54), to secure an outer shield 40 of the coaxial feed cable 36 at the feed entry side 734 of the central region 726.

Figure 55:
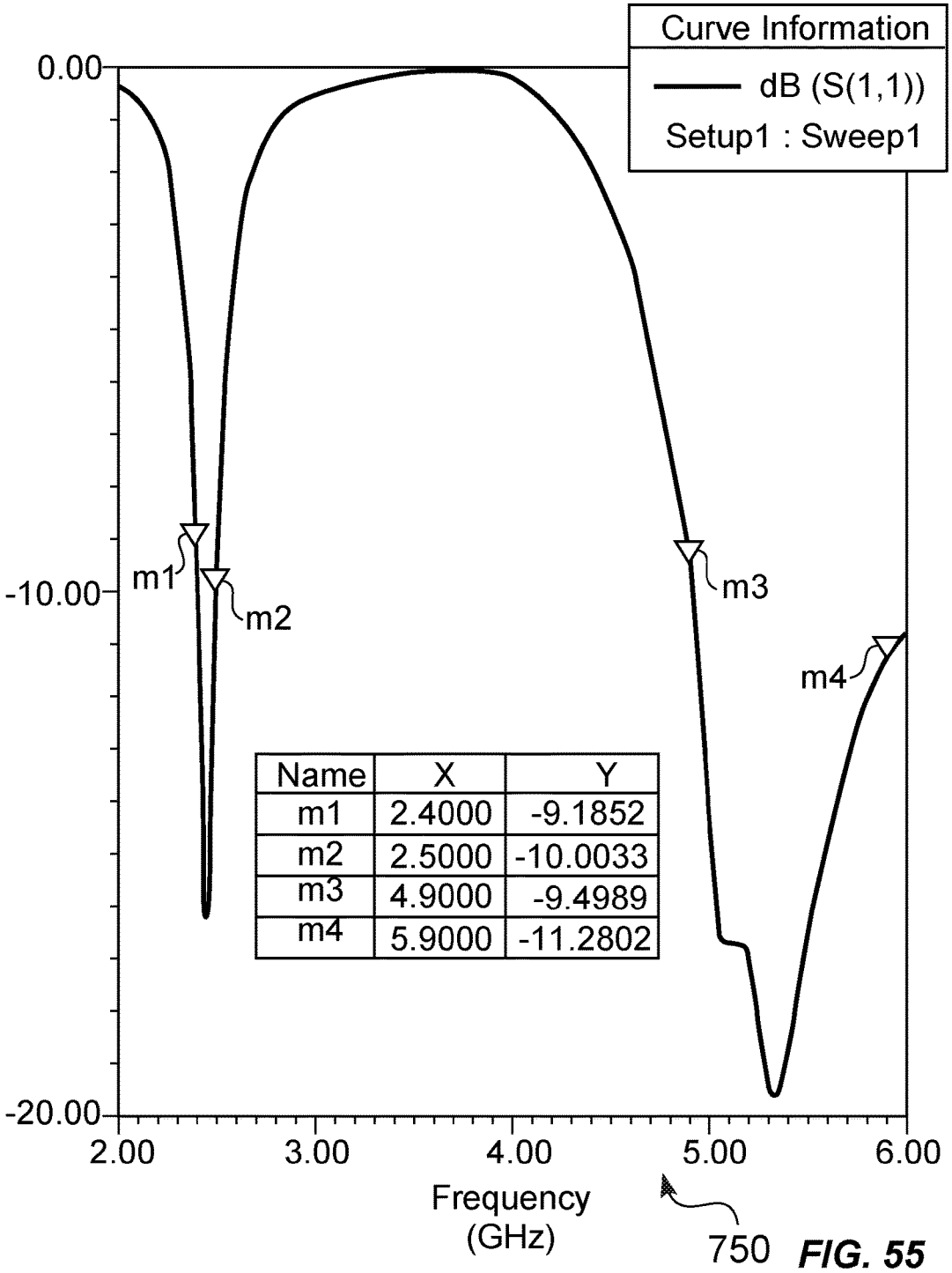
FIG. 55 is a chart showing reflection performance as a function of frequency for an illustrative embodiment of a balanced 2G/5G internal flat metal antenna.
Figure 56:
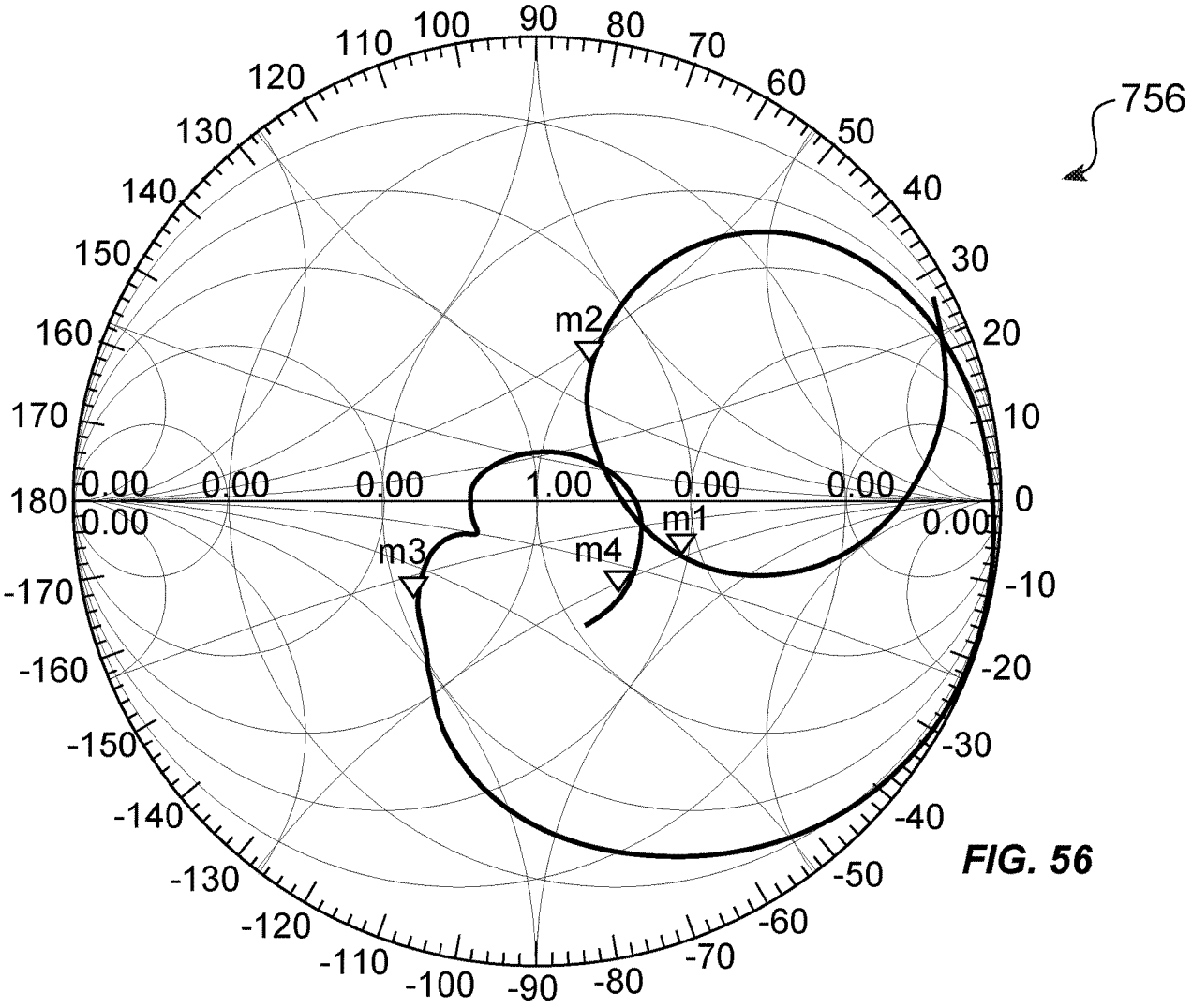
FIG. 56 is a Smith chart for an illustrative embodiment of a balanced 2G/5G internal flat metal antenna.

FIG. 55 is a graph 750 showing reflection coefficient performance as a function of frequency 104 for an illustrative embodiment of a balanced 2G/5G internal flat metal antenna 722. FIG. 56 is a Smith chart 756 for an illustrative embodiment of a balanced 2G/5G internal flat metal antenna 722.

Flat Dual Band End Fed Dipole Antennas.

Figure 57:
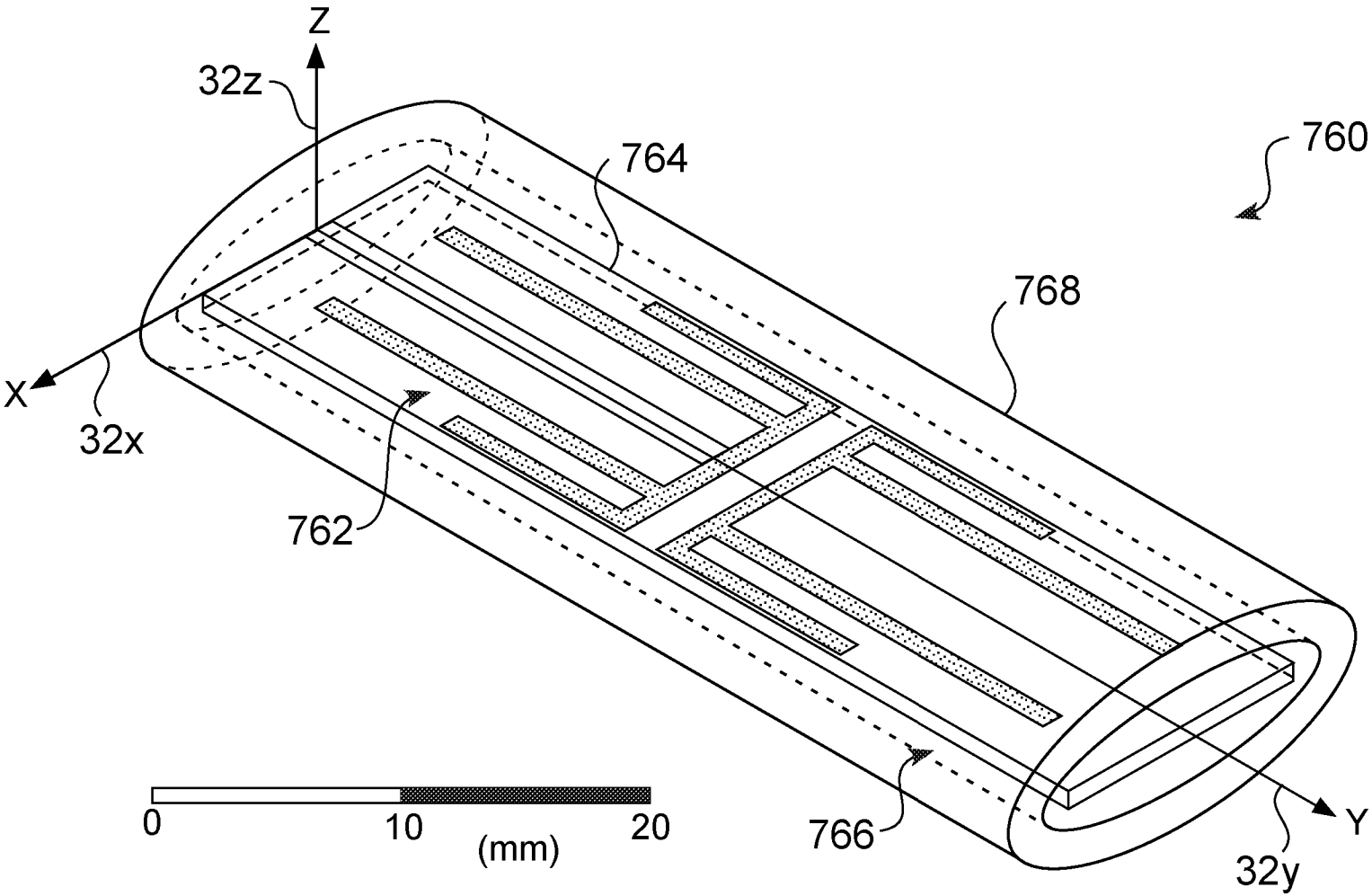
FIG. 57 is a schematic view of an illustrative embodiment of a flat dual band end fed dipole antenna.

FIG. 57 is a schematic view of an illustrative embodiment of a flat dual band end fed dipole antenna 760, in which the antenna structure 762 is formed on a PCB 764, and is mounted within an interior region 766 of a plastic housing 768, and in which the PCB antenna structure 762 and the plastic housing 768 are longitudinally aligned with respect to the Y axis 32*y*. In some embodiments, the antenna structure 762 is similar in structure and function to the end fed dipole antenna 440 seen in FIG. 32.

An illustrative embodiment of the dual-band dipole antenna 760 can be configured for operation in a first frequency band and a second frequency band, wherein the second frequency band has a higher frequency than the lower frequency band, wherein the dual-band dipole antenna 760 extends from a first end to a second end opposite the first end, in which the dual-band dipole antenna 760 comprises a first antenna structure 442 and a second antenna structure 444, wherein a feed gap 446 is defined between the first antenna structure 442 and the second antenna structure 444, wherein the first antenna structure 442 extends from the first end of the dual-band antenna 760 to the feed gap 446, wherein the second antenna structure 444 extends from the feed gap 446 to the second end of the dual-band antenna 760, wherein the first antenna structure 442 includes a corresponding inner low band trap 448 and a corresponding outer high band trap 450, wherein the second antenna structure 444 includes a corresponding inner low band trap 456, and a corresponding outer high band trap 458, and a coaxial cable 452 extending from a remote end to a lead end, the coaxial cable 452 including an electrically conductive center conductor 324 and an electrically conductive outer shield 325 surrounding and electrically insulated from the center conductor 324, wherein the lead end of the coaxial cable 452 extends through the first end 442 of the dual-band antenna 760, through the inner low band trap 448 corresponding to the first antenna structure 442, wherein the outer shield 325 at the lead end of the coax cable 452 is electrically connected to the first antenna structure 442 proximal to the feed gap 446, and wherein the center conductor 324 extends from the lead end of the coaxial cable 452 across the feed gap 446 and is electrically connected to the second antenna structure 444 proximal to the feed gap 446, wherein the resultant end-fed dipole antenna 760 is configured to send and receive wireless signals in the first frequency band and the second frequency band.

Figure 58:
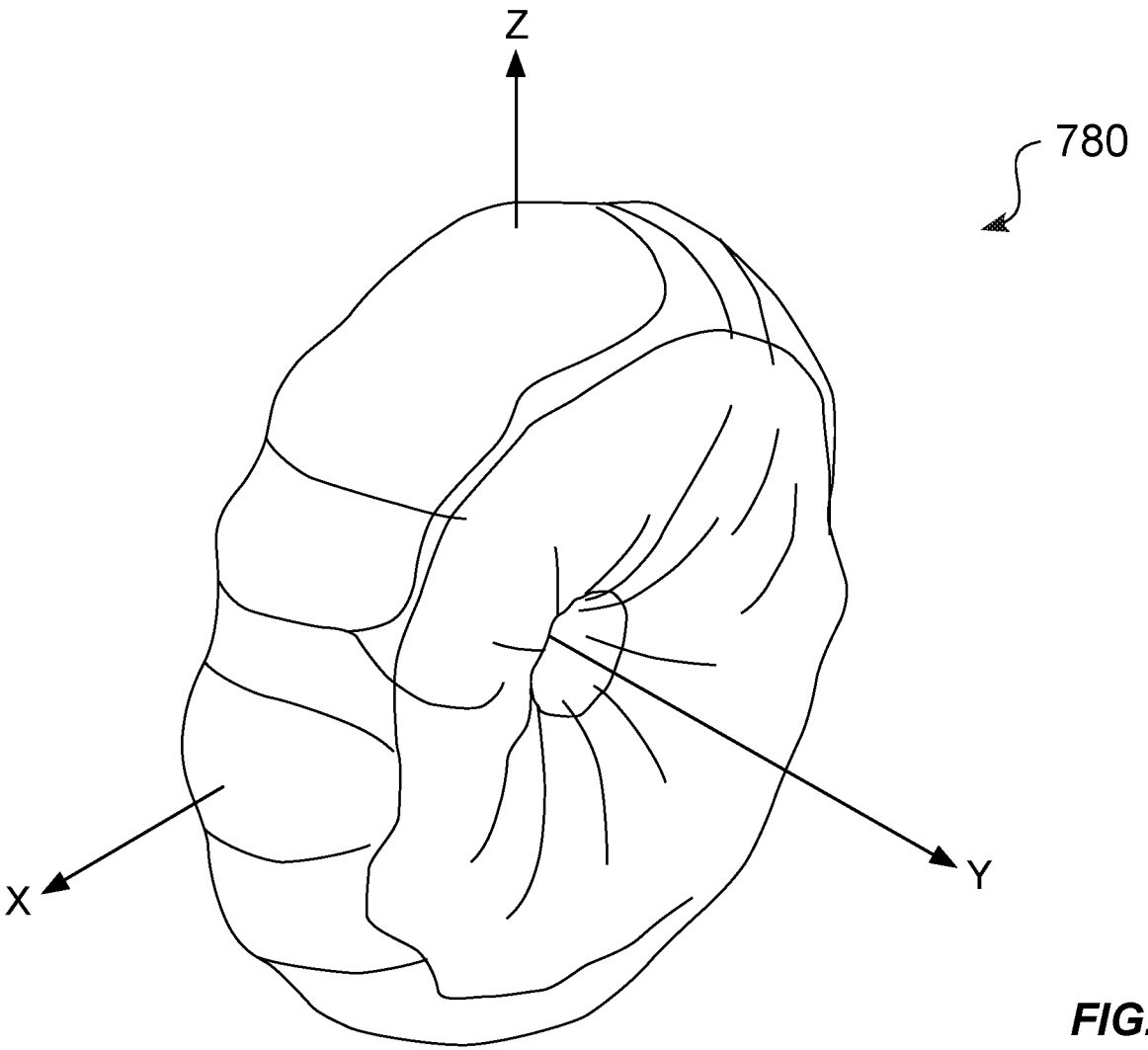
FIG. 58 shows a three-dimensional beam pattern for the illustrative flat dual band end fed dipole antenna seen in FIG. 57.
Figure 59:
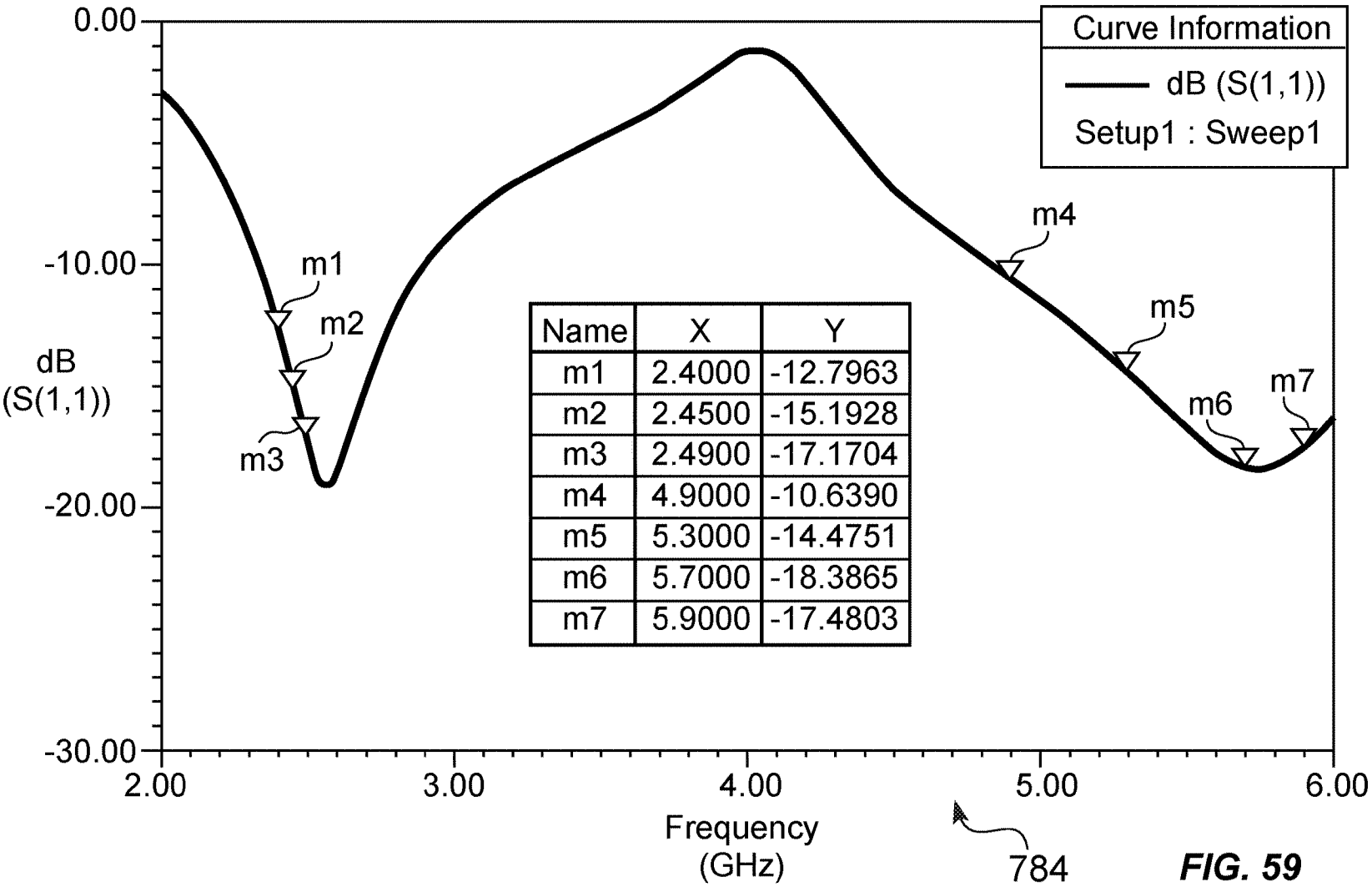
FIG. 59 is a chart that shows return Loss (db) as a function of frequency (GHz)) for the illustrative flat dual band end fed dipole antenna seen in FIG. 57.
Figure 60:
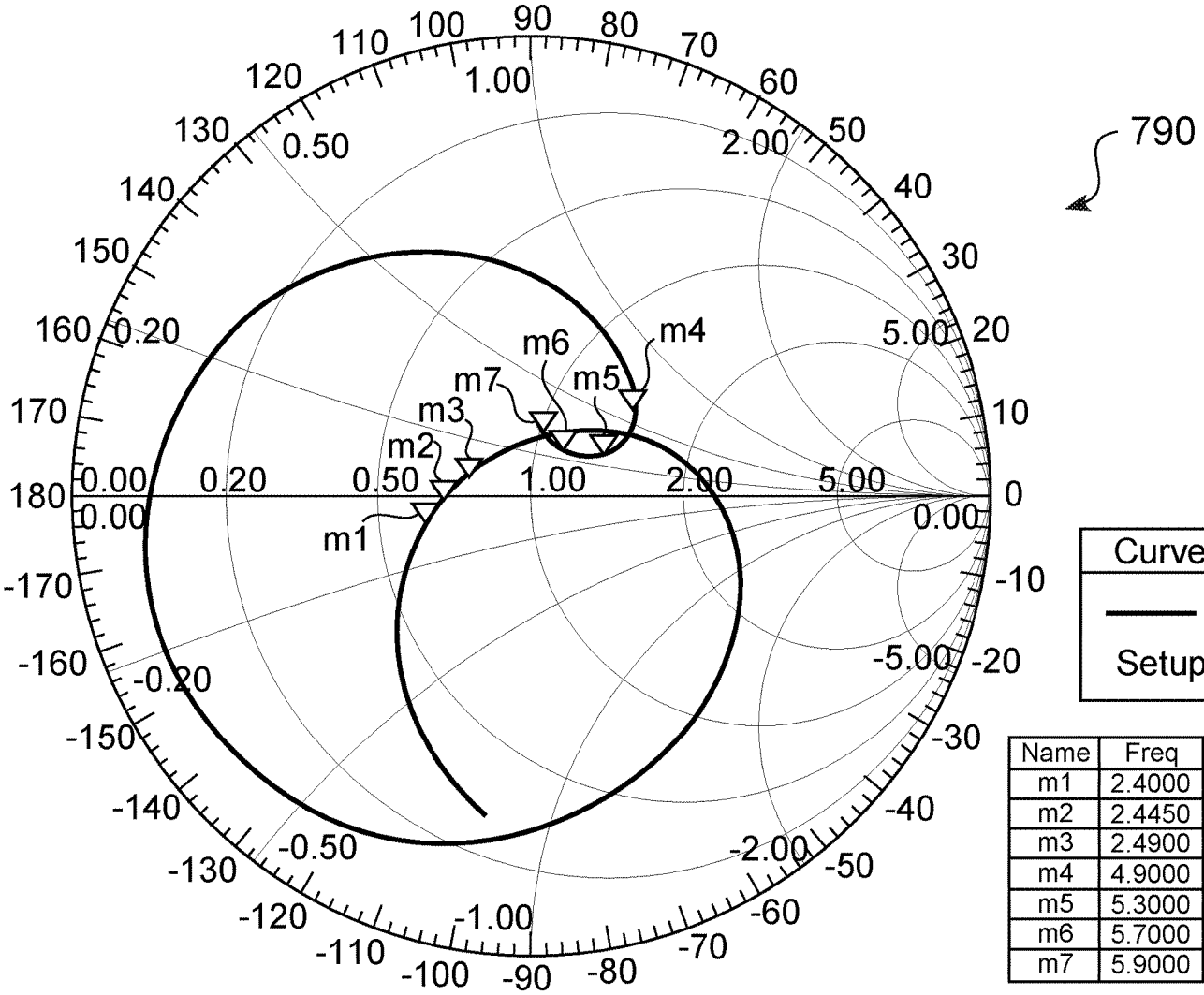
FIG. 60 is a Smith chart for the illustrative flat dual band end fed dipole antenna seen in FIG. 57.

FIG. 58 shows a three-dimensional beam pattern 780 for the illustrative flat dual band end fed dipole antenna 760 seen in FIG. 57. FIG. 59 is a chart 784 that shows return Loss (db) as a function of frequency (GHz)) for the illustrative flat dual band end fed dipole antenna 760 seen in FIG. 57, in which the results include the loading of the plastic housing 768. FIG. 60 is a Smith chart 790 for the illustrative flat dual band end fed dipole antenna 760 seen in FIG. 57.

In the testing of the illustrative flat dual band end fed dipole antenna 760, the plastic housing 768 accounted for a 100 MHz reduction in frequency for 2 GHz operation, and for 5 GHz operation, the reduction in frequency was about 300 Mhz.

Polarized Low Profile Antenna Structures.

Figure 61:
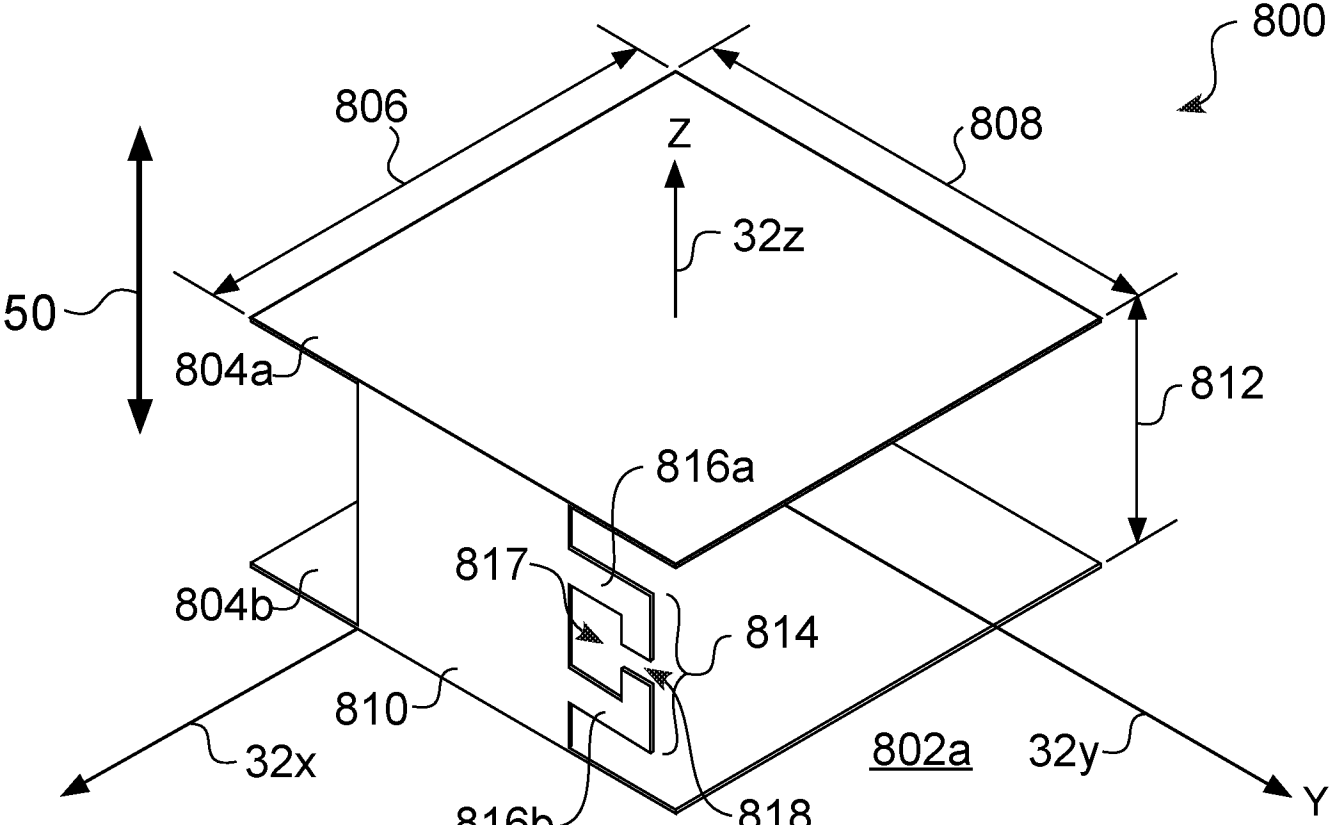
FIG. 61 is a schematic view of an illustrative low profile 915 MHz antenna system having a feed gap defined on a formed metal antenna structure.
Figure 62:
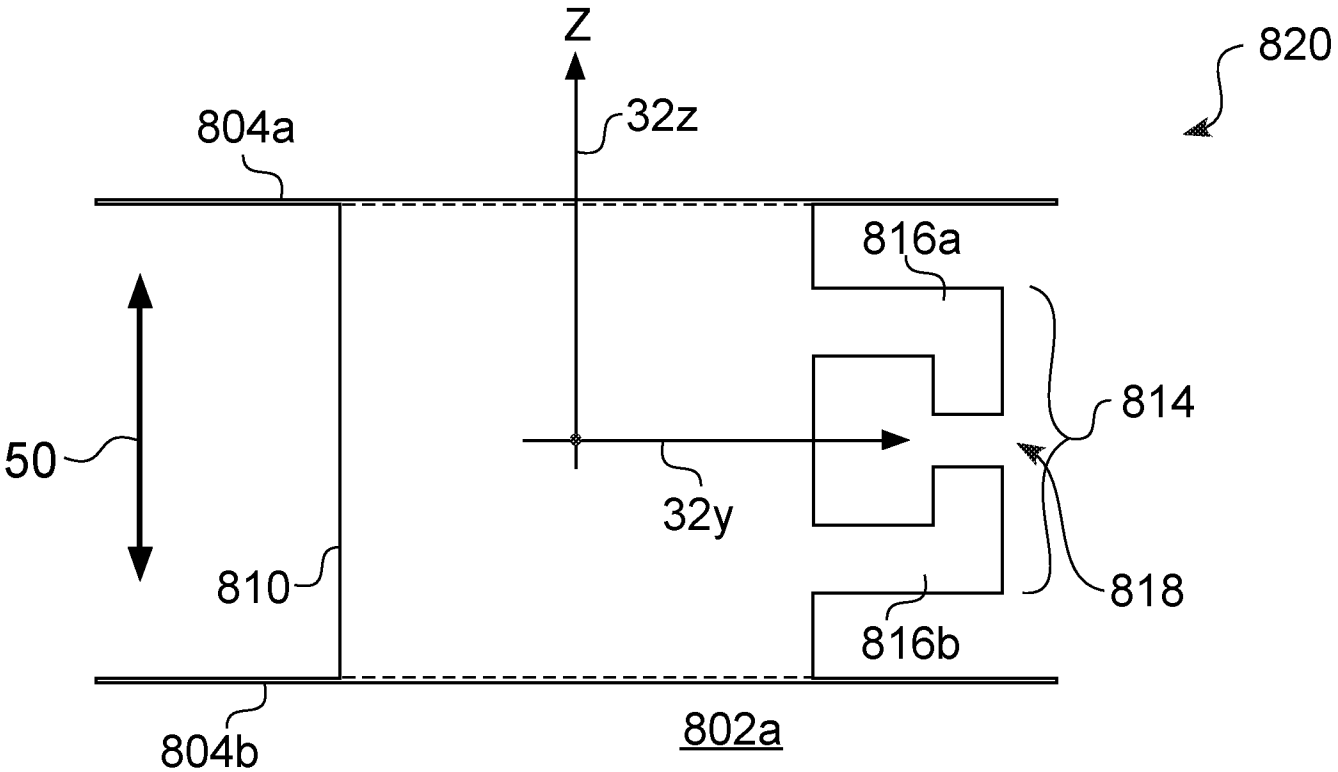
FIG. 62 is a side view of an illustrative low profile 915 MHz antenna system having a feed gap defined on a formed metal antenna structure.
Figure 63:
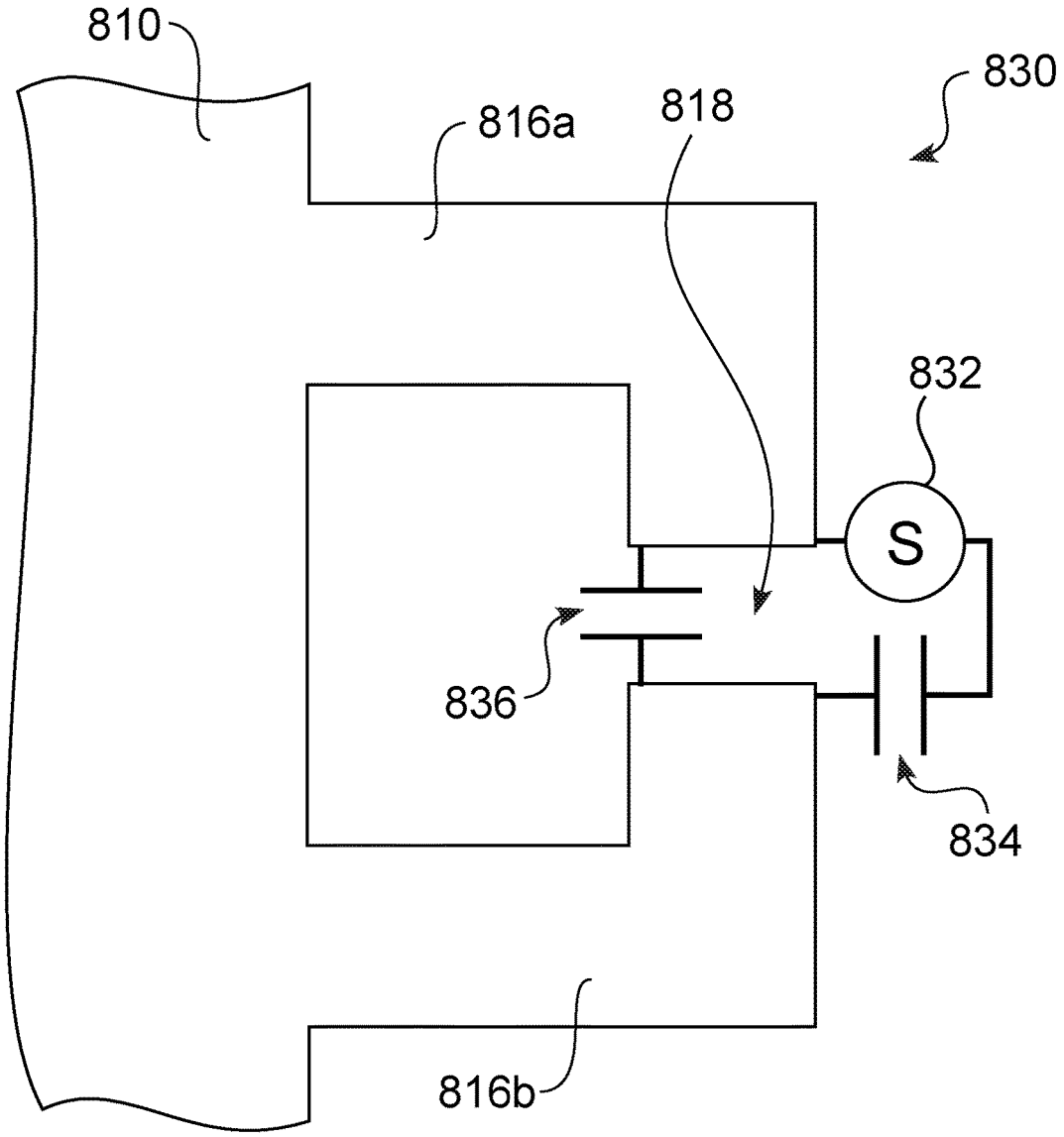
FIG. 63 is a detailed partial view of an illustrative feed gap low profile 915 MHz antenna system, which is configured for a coax feed point and a matching capacitor.

FIG. 61 is a schematic view 800 of an illustrative low profile, vertically polarized antenna structure 802, e.g., 802*a*, having a feed gap 818 defined on a central region 810 of the formed metal antenna structure. FIG. 62 is a side view 820 of an illustrative low profile antenna system 802*a*. FIG. 63 is a detailed partial view 830 of an illustrative low profile antenna system 802*a*, which is configured for a coax feed point 832 and a matching capacitor 834. In an illustrative embodiment, the structure 802 is configured to transmit and receive wireless signals at a frequency of 915 MHz.

The illustrative antenna structure 802*a* seen in FIG. 61 includes opposing, substantially rectangular plates 804*a* and 804*b*, each having a depth 806 and a width 808, which are formed to extend orthogonally, such as along the X-axis 32*x*, from the vertical central region 810, in which the upper plate 804*a* and the lower plate 804*b* are separated by a height 812.

In an illustrative embodiment of the low profile, vertically polarized antenna structure 802*a* seen in FIG. 61, the opposing plates 804*a* and 804*b* have a depth 806 of less than 60 mm, and a width 808 of less than 60 mm, and are separated by a height 812 of less than 28 mm.

The illustrative antenna structure 802*a* seen in FIG. 61 also includes a feed gap structure 814 that includes opposing feed elements 816*a* and 816*b*, which extend from the central region 810, and together define an open slot driven cavity 817 having a feed gap 818 therebetween.

Figure 65:
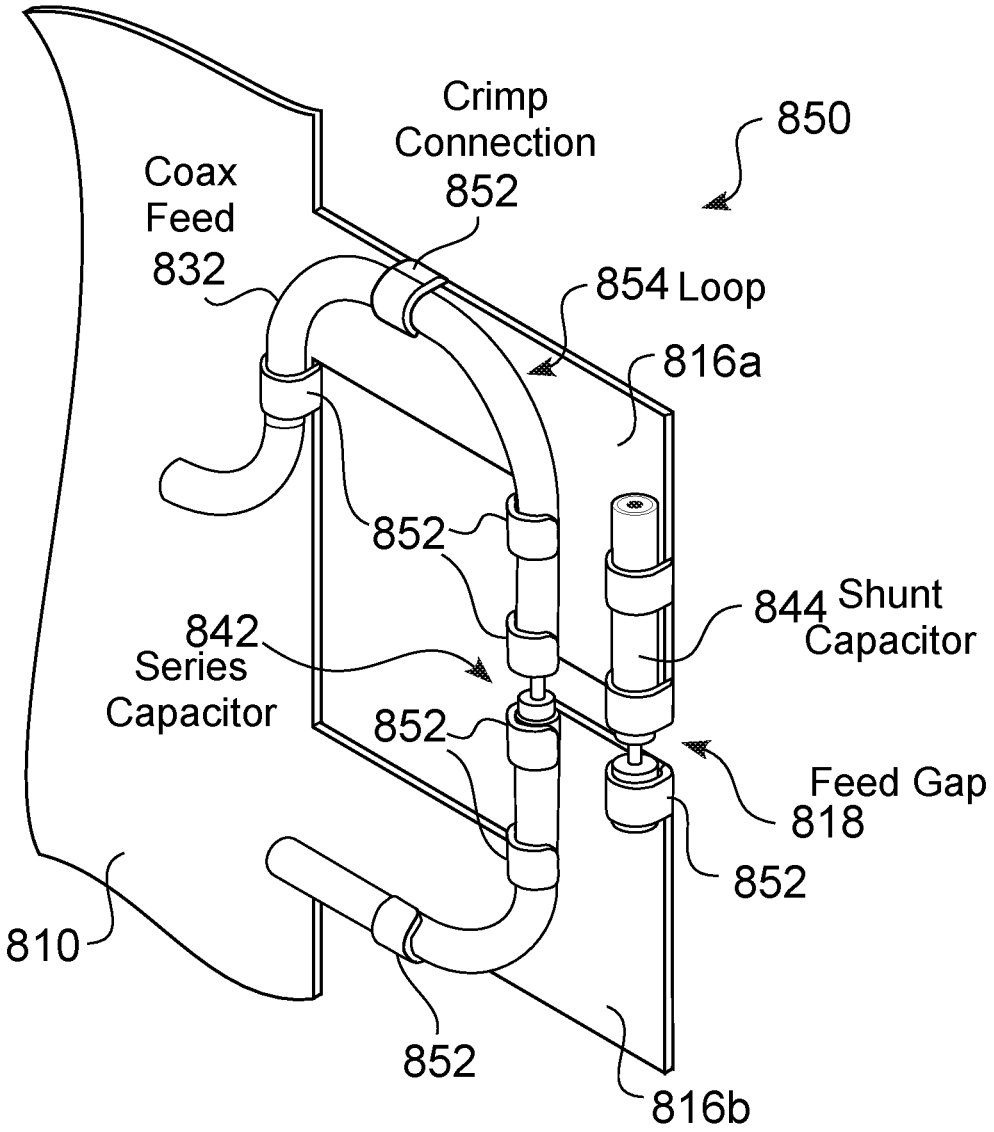
FIG. 65 is a detailed schematic view of a coax match structure in relation to a feed gap for a low profile 915 MHz antenna system, including a series capacitor and shunt capacitor.

The antenna structure 802*a* can be configured as a balanced low-profile omnidirectional structure, such as for embodiments that require vertical polarization 50. As well, the antenna structure 802, e.g., 802*a*, can be configured at a very low cost, and in some embodiments includes crimp-only connections 852 (FIG. 65).

In an illustrative embodiment of the antenna structure 802, the feed gap 818 is configured as one sixth of a wavelength of the wireless signal, such that the antenna structure 802 behaves omni-directionally.

As well, the short between the top and bottom plates 804*a* and 804*b* permits the antenna 802 to act like a fat top loaded dipole, in which the top and bottom plates 804*a* and 804*b* act as a capacitor, while the short between the top and bottom plates 804*a* and 804*b* functions as a shunt inductor across the plates 804*a*,804*b*. At and close to resonance, the voltage maximum occurs at the remote ends of the plates 804*a* and 804*b*, away from the short. The narrowing of the short between the plates 804*a* and 804*b* concentrates the RF current, which produces a high concentric magnetic field around the short, in this region.

An illustrative embodiment of the low profile, vertically polarized antenna structure 802, e.g., 802*a*, comprises a planar central region 810 extending vertically from a first end to a second end, a first planar dipole plate 804*b* extending orthogonally from the first end of the central region 810, and a second planar dipole plate 804*a* extending orthogonally from the second end of the central region 810, wherein the first dipole planar plate 804*b* and the second planar dipole plate 804*a* are coplanar to each other and separated by a height 812, wherein the planar central region 810 includes a feed gap structure 817 located between the first planar dipole plate 804*b* and the second planar dipole plate 804*a*, wherein the feed gap structure includes a pair of opposing feed elements 816*a*,816*b* that are coplanar to the central region 810 that extend from the central region 810 and define an open slot driven cavity having a feed gap 818 defined there between, wherein when a coaxial feed 832 is connected across the feed gap 818, the antenna structure 802 forms a vertically polarized antenna for a wireless signal, and wherein the antenna structure 802 is formed from a single electrically conductive metallic sheet.

Figure 64:
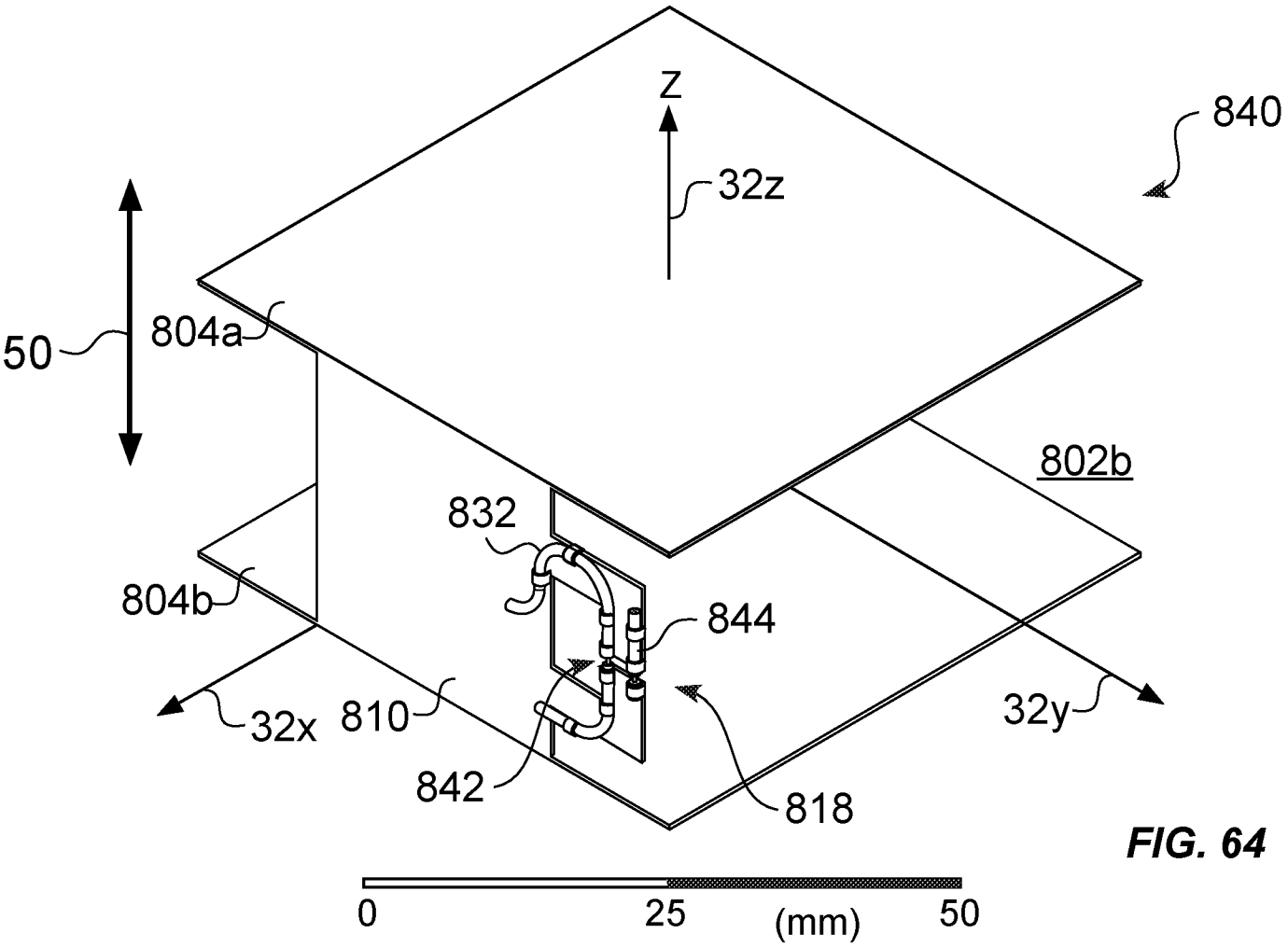
FIG. 64 is a schematic view of an illustrative low profile 915 MHz antenna system with a coax match.

As seen in FIG. 63, a coax feed 832 and a matching capacitor 834 can be balanced, e.g., at 50-75 ohms. FIG. 64 is a schematic view 840 of an illustrative low profile antenna system 802*b* with a coax match, such as for operation at 915 MHz. FIG. 65 is a detailed schematic view 850 of a coax match structure in relation to a feed gap 818 for a low profile antenna system 802*b*, including a series capacitor 842 and a shunt capacitor 844.

As seen in FIG. 64 and FIG. 65, the feed coax 832 can be attached as a loop 854, which in some embodiments is attached with crimped connections 852. Attaching the loop 854 at this point allows the magnetic field in the "short" to couple into the loop 854, thus expressing an electric field across the gap 818, such that the gap 818 becomes the feed point for the antenna 802*b*.

In some embodiments, the gap 818 and the coax 832 can be tuned, such as by adjusting one or both of the feed elements 816*a*,816*b* and/or the short. This enables the coax 832 to be connected across the gap 818, with the shield 40 (FIG. 1) on one side and the center conductor 44 (FIG. 1) on the other. To maintain the symmetry, the shield 40 follows the metal path 44 of the loop 854 to the center of the short, where the coax 832 is trained away to be central and normal to the short.

As seen in FIG. 64 and FIG. 65, the coax shield 40 can then be crimped around the loop 854. In some embodiments, the coax center conductor 44 includes an attached ferrule, which is crimped 852 to the other side of the gap 818, in the same fashion as the shield 40.

The illustrative antenna structure 802*a* seen in FIG. 64 and FIG. 65 also includes a shunt capacitor 844 and a series capacitor 842 to connect the coax 832 to the feed. In some embodiments, the shunt capacitor 844 and/or the series capacitor 842 can be formed in a distributed fashion, such as by using short lengths of coaxial cable 36 (e.g., FIG. 1). As further seen in FIG. 65, the various coax shields 40 and/or ferrules that are crimped to the inner conductors 44, can readily be attached to the structure 802, such as by crimp connections 852.

Figure 66:
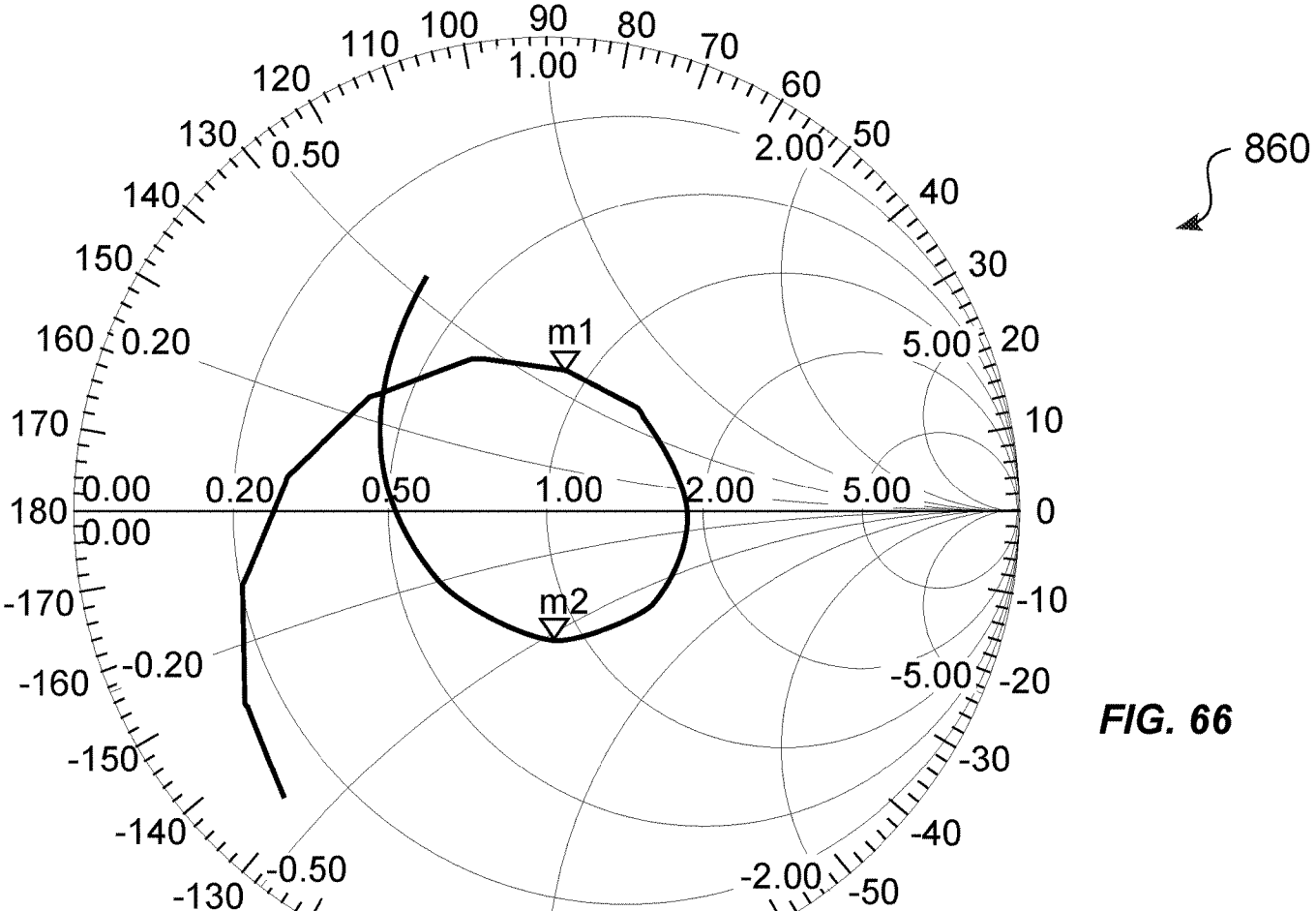
FIG. 66 is a Smith chart showing antenna system matching for a low profile 915 MHz antenna system.
Figure 67:
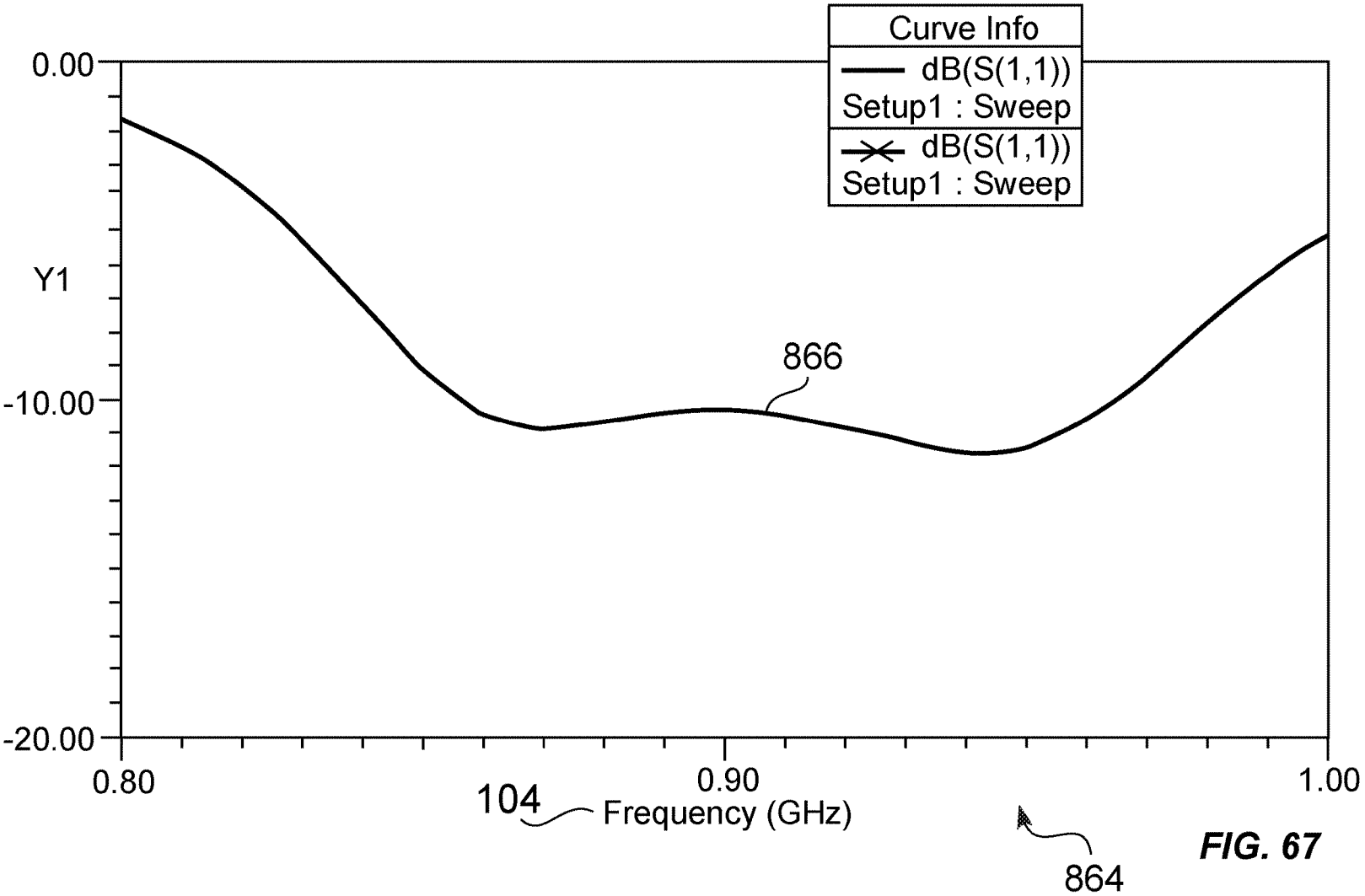
FIG. 67 is a chart showing match return loss for a low profile 915 MHz antenna system.

FIG. 66 is a Smith chart 860 showing antenna matching for a low profile antenna system 802, e.g., 802*b*, operating at 915 MHz. FIG. 67 is a graph 864 showing match return loss 866 for a low profile antenna system 802*b* operating at 915 MHz.

Figure 68:
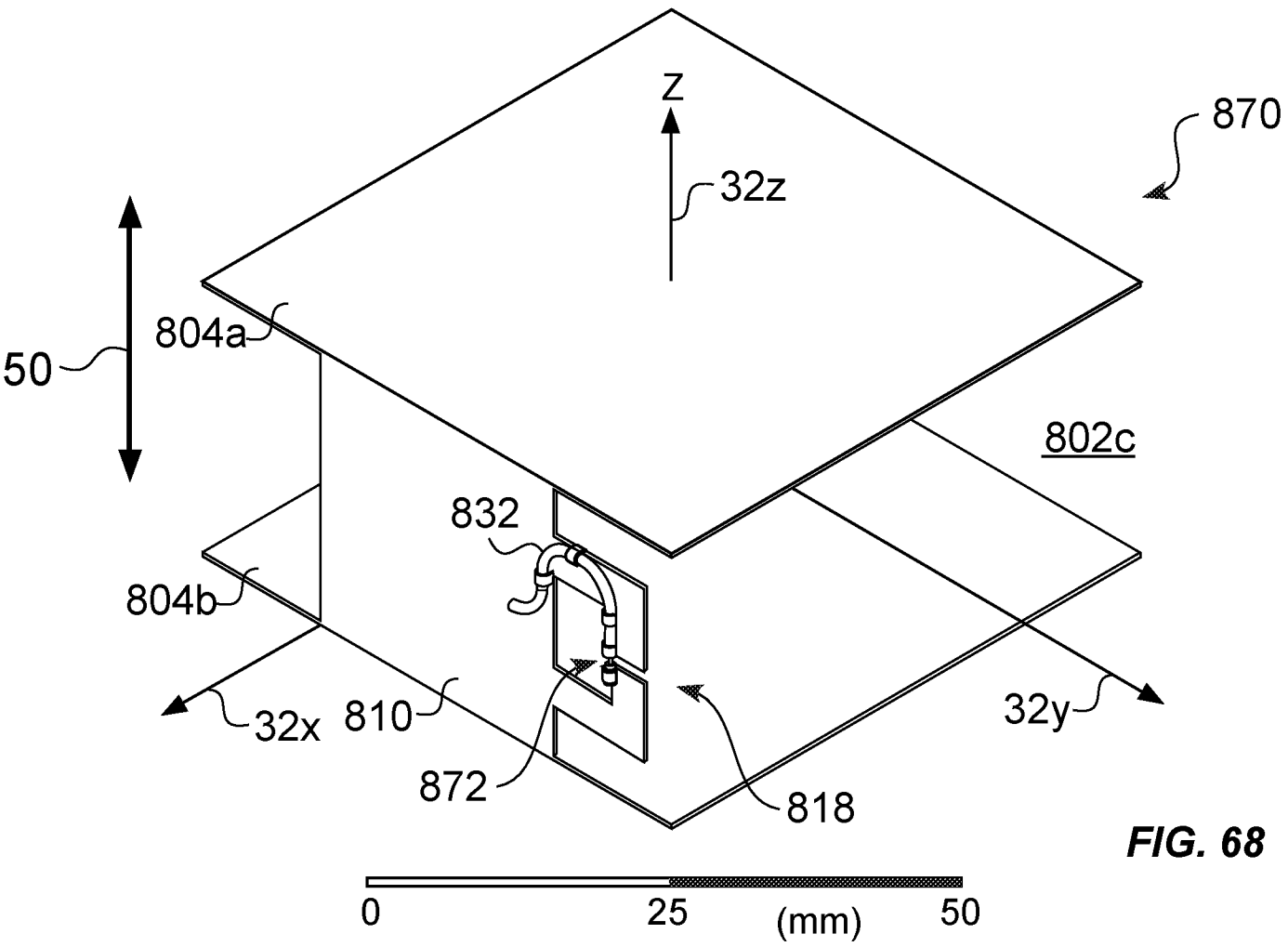
FIG. 68 is a schematic view of an illustrative low profile 915 MHz antenna system with a simple coax connection structure.
Figure 69:
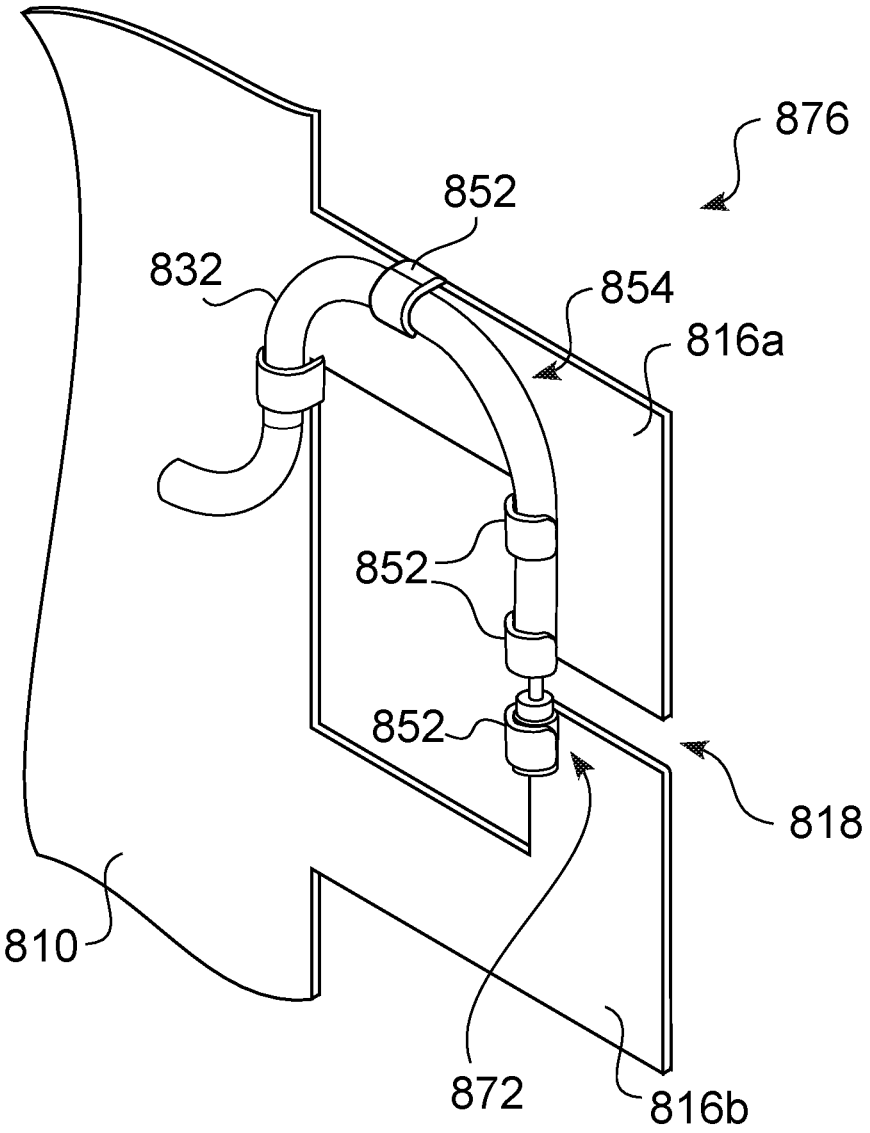
FIG. 69 is a detailed schematic view of a simplifies coax connection structure in relation to a feed gap for a low profile 915 MHz antenna system.

FIG. 68 is a schematic view 870 of an illustrative low profile antenna system 802*c*, such as for operation at 915 MHz, that includes a simplified coax connection structure 872. FIG. 69 is a detailed schematic view 876 of a simplified coax connection structure 872 in relation to a feed gap for a low profile antenna system 802*c*. While the simplified coax connection structure 872 seen in FIG. 68 and FIG. 69 includes a coax loop structure 854 such as implemented for the illustrative low profile antenna system 802*b* seen in FIG. 64 and FIG. 65, the simplified coax connection structure 872 does not include a shunt capacitor 844.

Figure 70:
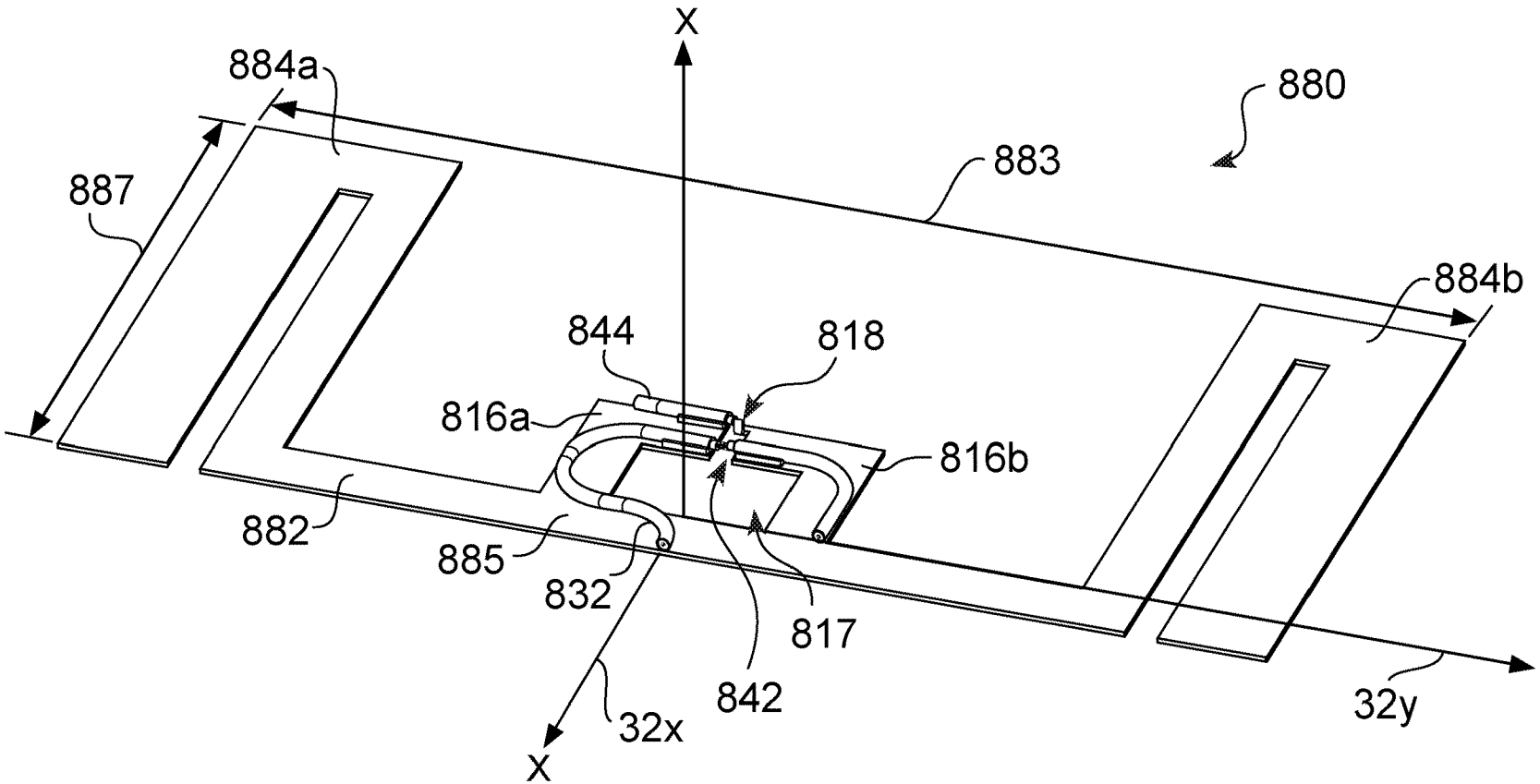
FIG. 70 is a schematic view of an illustrative flat dipole MHz antenna structure that includes coax capacitors.

FIG. 70 is a schematic view of an illustrative flat dipole antenna system 880 that includes coax capacitor structures 832, 842 and 844, such as implemented for the illustrative low profile antenna systems 802. In an illustrative embodiment, the flat dipole antenna system 880 can operate at 900 MHz.

The illustrative flat dipole antenna system 880 seen in FIG. 70 can be formed from a metal plate 882 having a width 883 and a depth 887, which includes dipole structures 884*a* and 884*b* at opposing ends of the plate 882, and a central region 885 that extends between the dipoles 884*a* and 884*b*. The illustrative antenna structure 880 seen in FIG. 70 also includes a feed gap structure 817 that includes opposing feed elements 816*a* and 816*b*, which extend from the central region 885, and together define an open slot driven cavity structure 842 having a feed gap 818 therebetween.

An illustrative embodiment of the flat dipole antenna structure 880 comprises a planar central region 885 extending horizontally from a first end to a second end, a first planar dipole region 884*a* extending horizontally from the first end of the central region 885, and a second planar dipole region 884*b* extending horizontally from the second end of the central region 885, wherein the planar central region 885 includes a feed gap structure 842 located between the first planar dipole region 884*a* and the second planar dipole region 884*b*, wherein the feed gap structure 842 includes a pair of opposing feed elements 816*a*,816*b* that are coplanar to the central region 885, which extend from the central region 885 and define an open slot driven cavity 817 having a feed gap 818 defined there between, wherein when a coaxial feed 832 is connected across the feed gap 818, the feed gap 818 becomes a feed point for the flat dipole antenna structure 880, and wherein the flat dipole antenna structure 880 is formed from a single electrically conductive metallic sheet.

As described above, the feed coax 832 can be attached as a loop 854, which in some embodiments is attached with crimped connections 852. Attaching a loop 854 at this point allows the magnetic field in the "short" to couple into the loop 854, thus expressing an electric field across the gap 818, such as the gap 818 becomes the feed point for the antenna 880.

Figure 71:
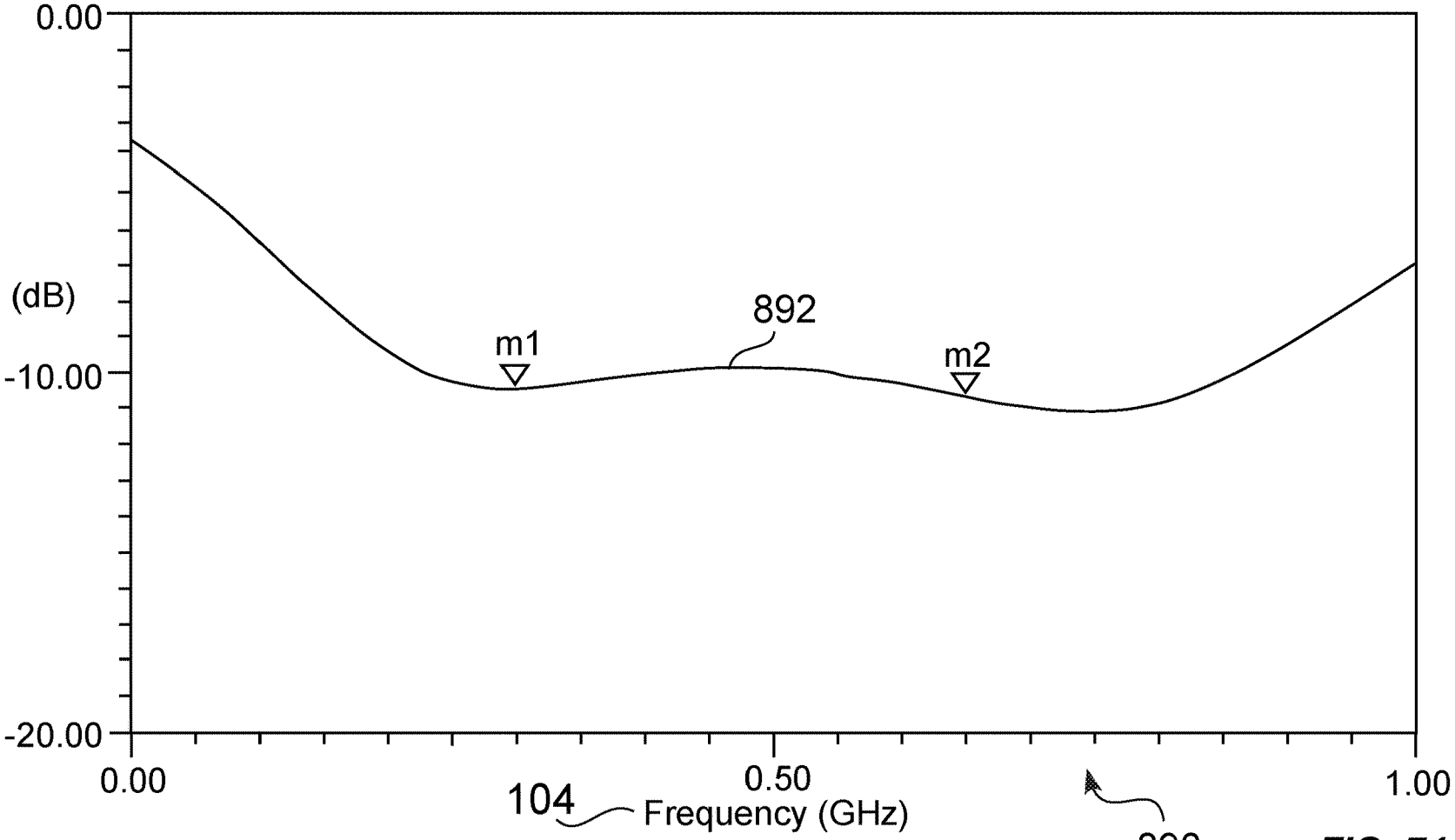
FIG. 71 is a chart that shows return loss as a function of frequency for the illustrative flat dipole MHz antenna structure seen in FIG. 70.

The flat dipole antenna system 880 can further include a coax match structure in relation to a feed gap 818, such as including a series capacitor and a shunt capacitor 844, which in some embodiments are attached with crimped connections 852. FIG. 71 is a chart 890 that shows return loss 892 as a function of frequency 104 for the illustrative flat dipole MHz antenna structure 880 seen in FIG. 70.

Figure 72:
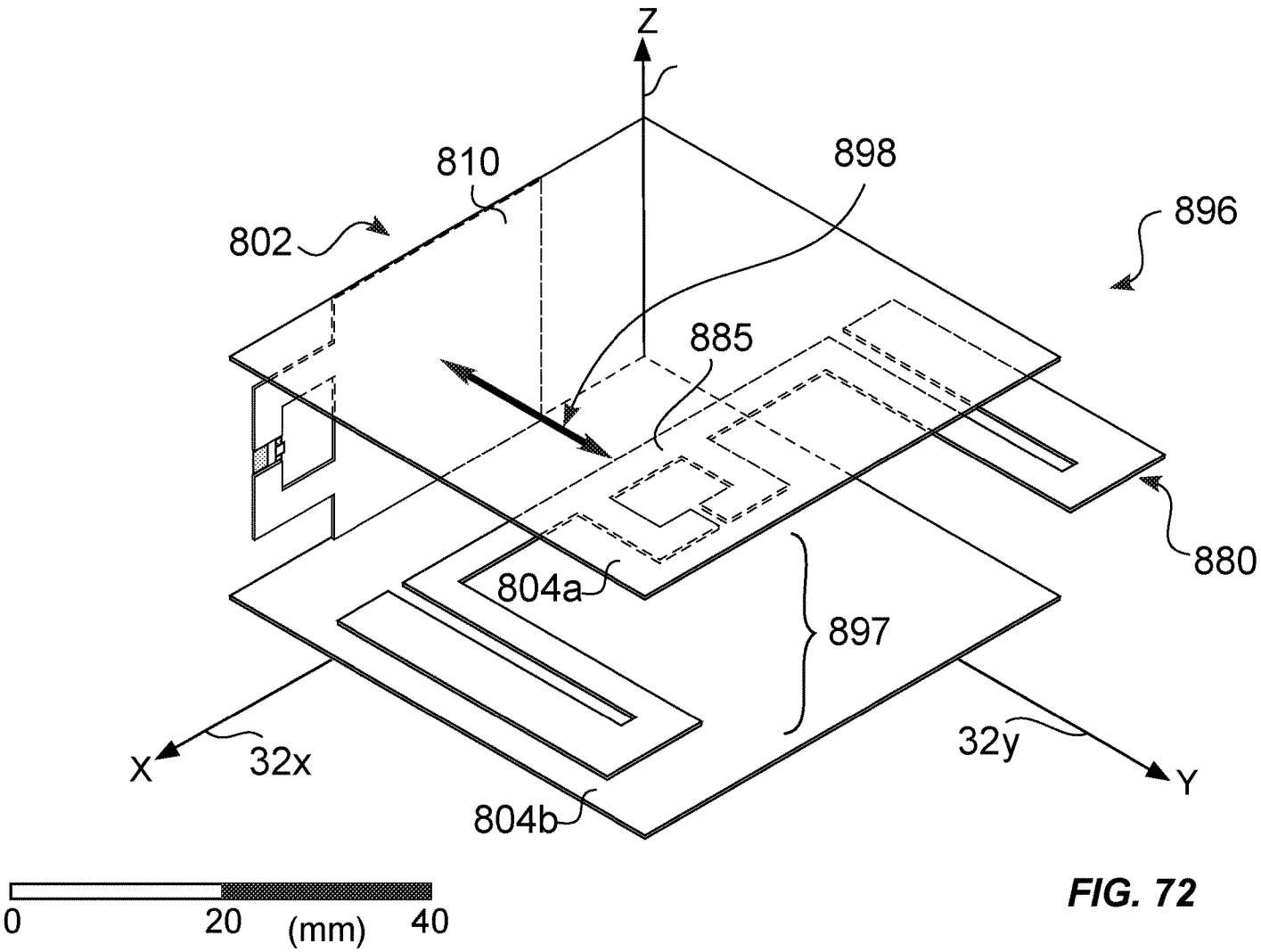
FIG. 72 is a schematic view of an antenna structure that includes a low profile slot antenna, in combination with a flat dipole antenna.

FIG. 72 is a schematic view of an illustrative combined antenna structure 896 that includes a low profile slot antenna 802, e.g., 802*a*, 802*b*, 802*c*, in combination with a flat dipole antenna 880. In the illustrative combined antenna structure 896 seen in FIG. 72, the flat dipole antenna 880 is contained in the region 897 located between the upper plate 804*a* and the lower plate 804*b*.

While the illustrative low profile slot antenna 802 and the flat dipole antenna 880 seen in FIG. 72 are shown schematically as simplified antenna structures, one or both of the antenna structures 802,880 can include different capacitor and shunt mechanisms, as disclosed above., and can include crimped connections 852, as desired.

In some embodiments 896, the low profile slot antenna 802 can be electrically interconnected 898 to the flat dipole antenna 880, such as between central regions 810 and 885 respectively, without impact to either antenna 802,880.

In some embodiments of the combined antenna structure 896, some minor tuning can be beneficial, such as for any of matching, isolation and/or orthogonality of their polarizations.

Figure 73:
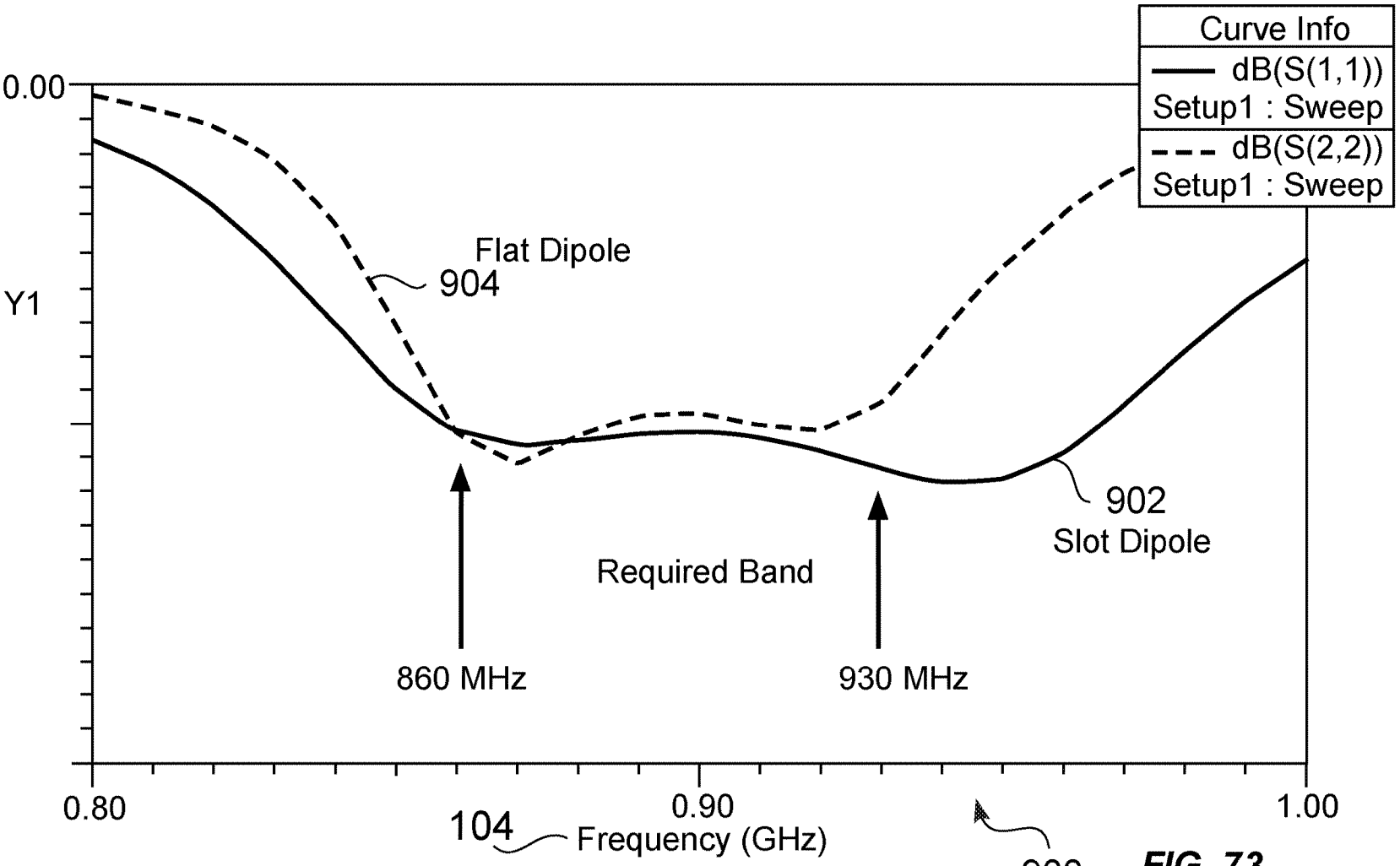
FIG. 73 is a graph that shows illustrative return loss for a slot dipole antenna, and ground loss for a flat dipole antenna.
Figure 74:
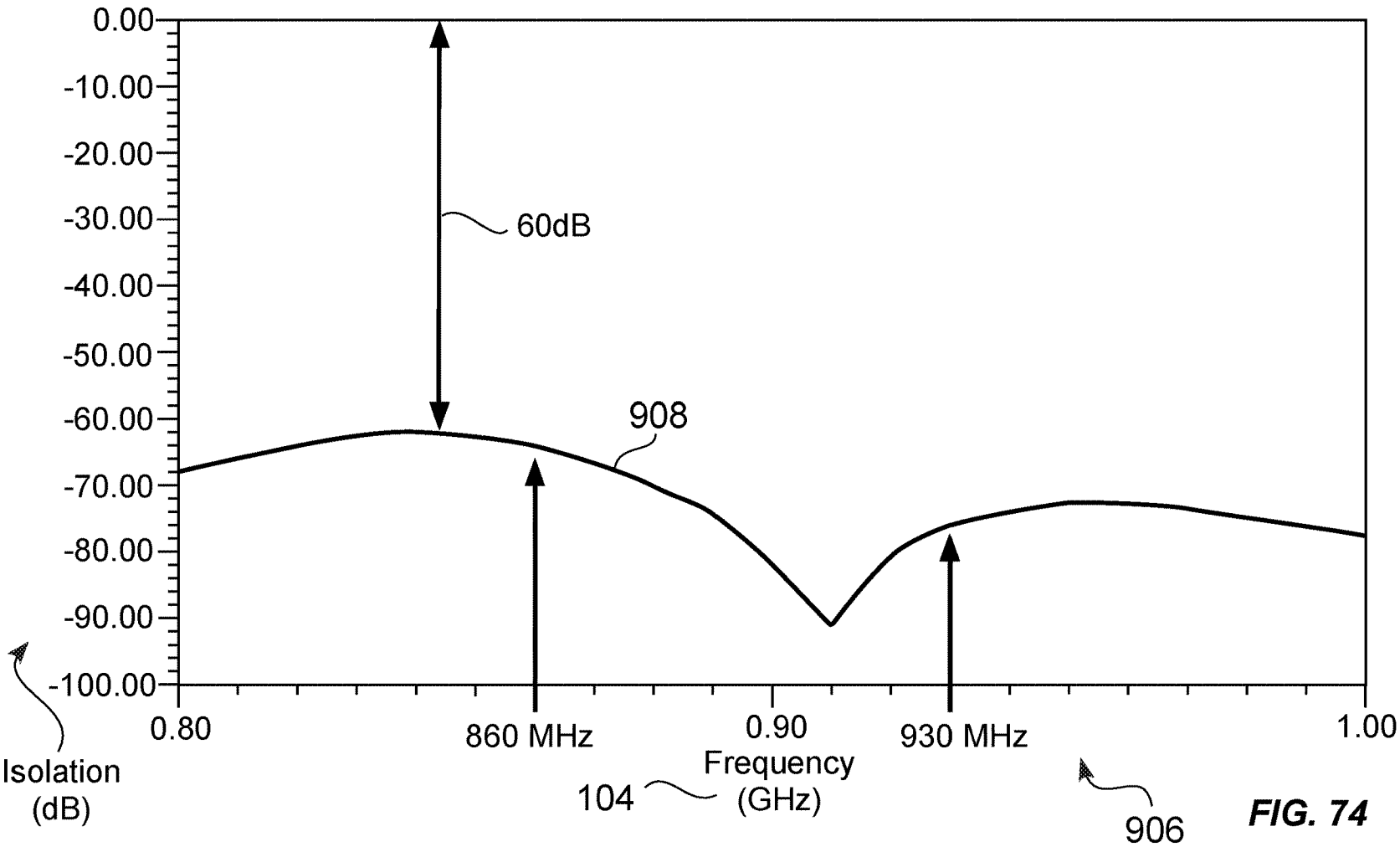
FIG. 74 is a graph that shows isolation for an illustrative embodiment of an antenna structure that includes a low profile slot antenna, in combination with a flat dipole antenna.

FIG. 73 is a graph 900 that shows both illustrative return loss 902 for a slot dipole antenna 802, and return loss 904 for a flat dipole antenna 880. FIG. 74 is a graph 906 that shows isolation for an illustrative embodiment of an antenna structure 896 that includes a low profile slot antenna 802, in combination with a flat dipole antenna 880. As seen, the operational data indicates the match and isolation for the combined structure 896, in which the flat dipole 880 acts as a sleeve dipole in conjunction with the slot dipole antenna 802, while the sleeve dipole/antenna 880 is not effected by the slot antenna 802.

In the combined antenna structure 896 seen in FIG. 72. both of the antennas 802,880 are orthogonal, and both antennas 802,880 match at or better than 10 dB over the required band. The bandwidth of the flat dipole antenna 880 can be increased by increasing its length 883 (FIG. 70). As discussed above, both of the antennas 802,880 can be electrically interconnected to their central regions 810,885 respectively, without impact to either antenna.

Stacked Antenna Systems.

Figure 75:
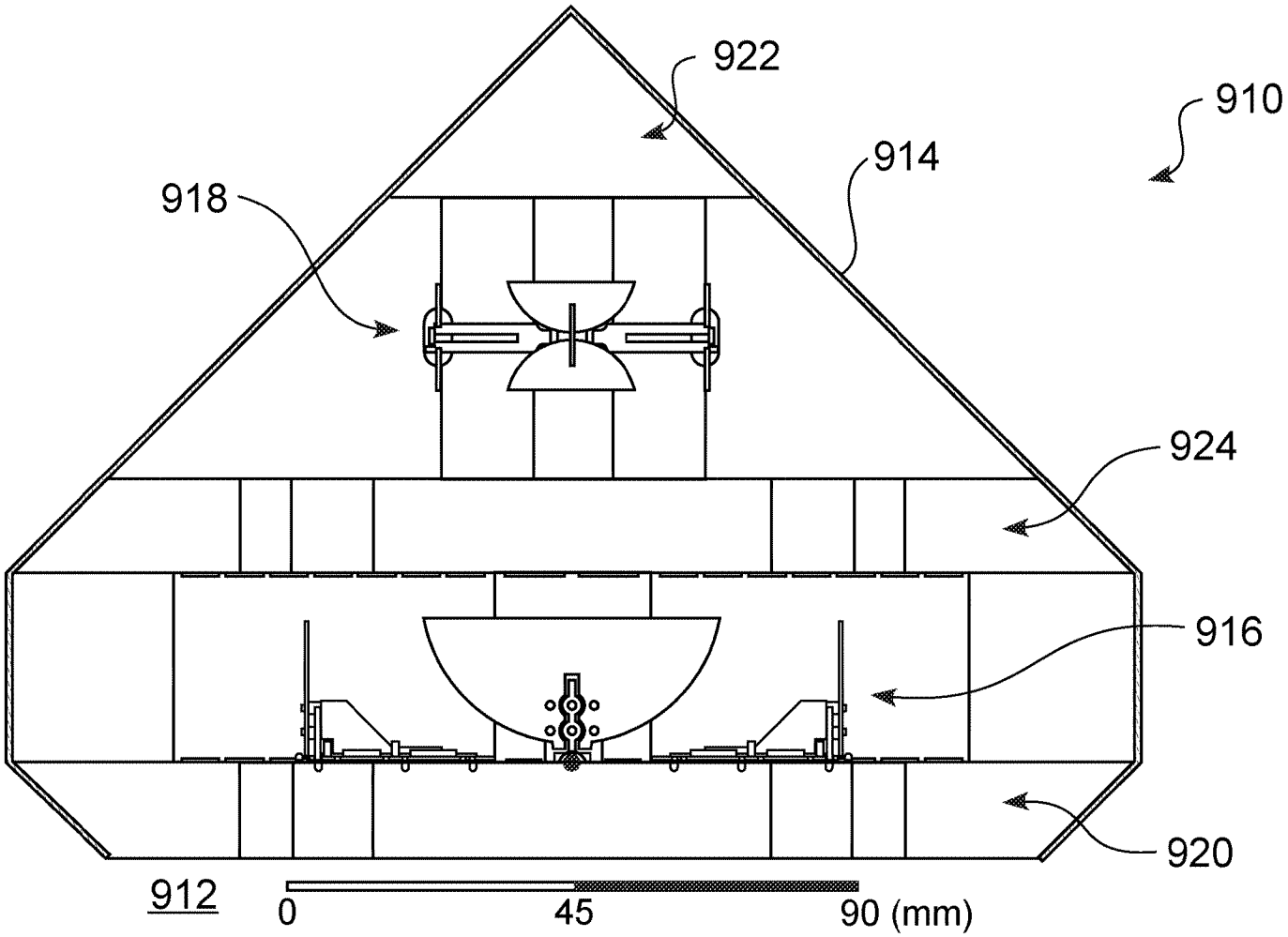
FIG. 75 is a partial cutaway view of an illustrative vertically stacked conical 2G/5G antenna system having four radial quadrants.
Figure 76:
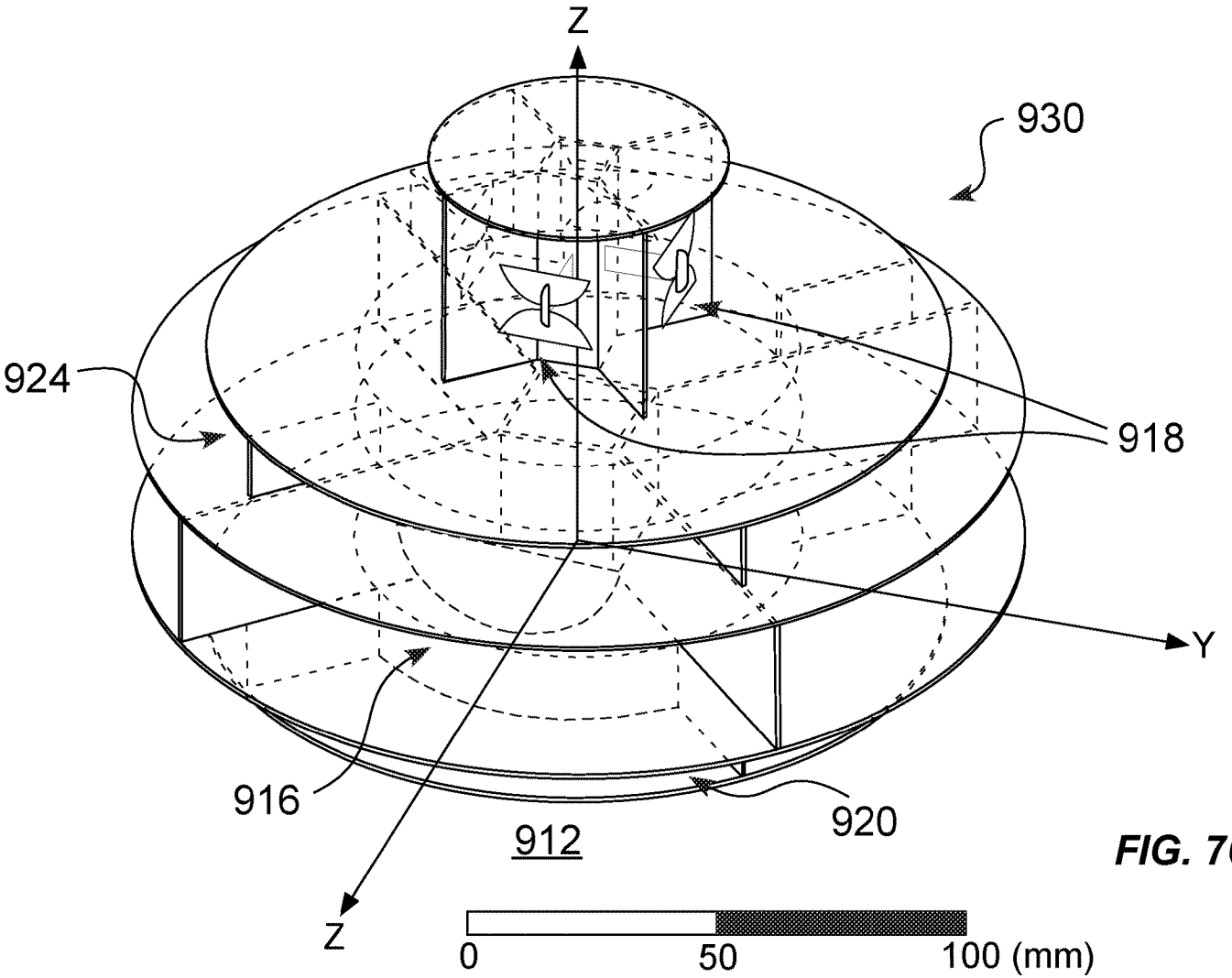
FIG. 76 is a perspective view of an illustrative vertically stacked conical 2G/5G antenna system having four radial quadrants.
Figure 77:
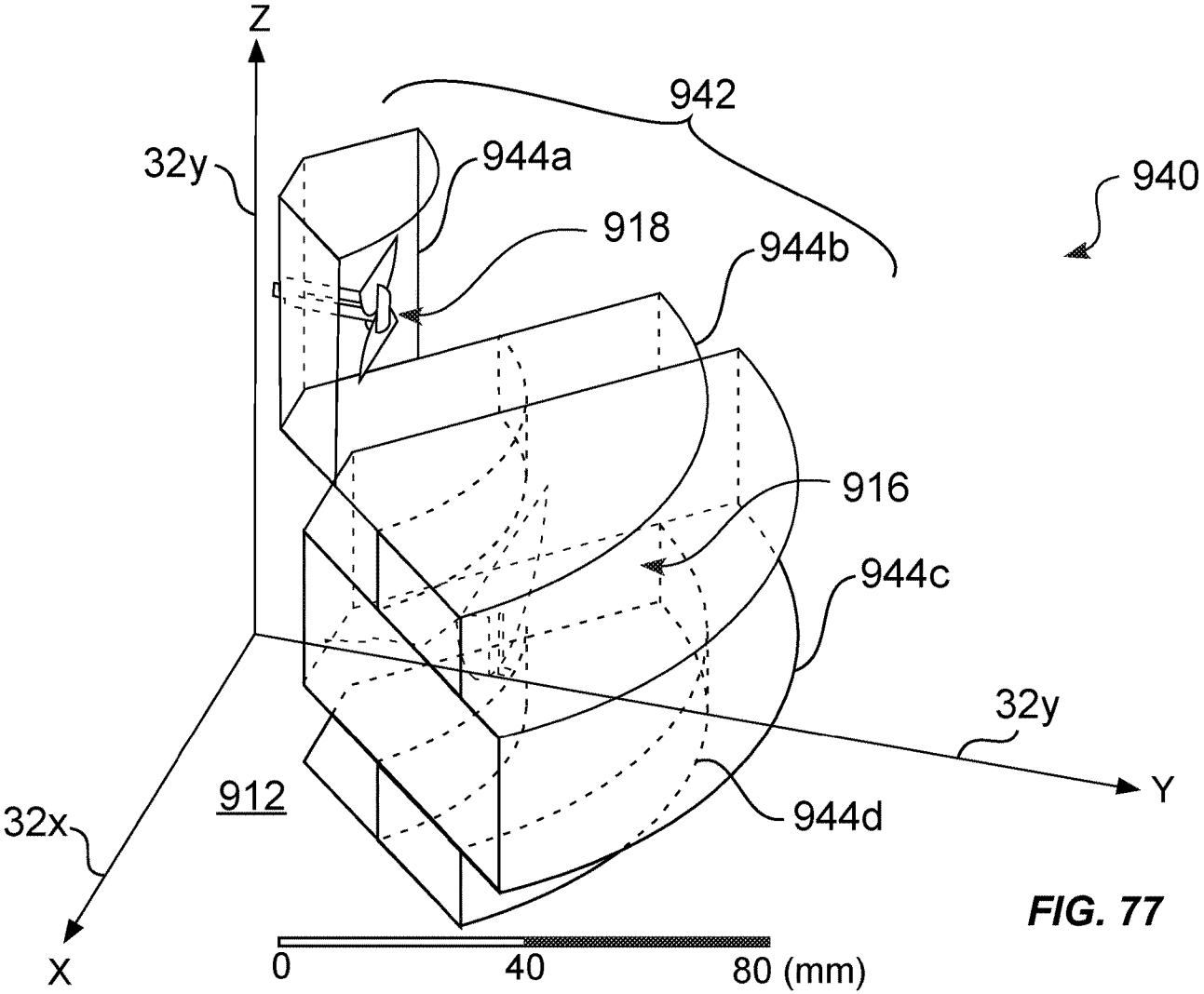
FIG. 77 is a trimetric view that shows stack up of for a single quadrant of an illustrative vertically stacked conical 2G/5G antenna system having four radial quadrants.
Figure 78:
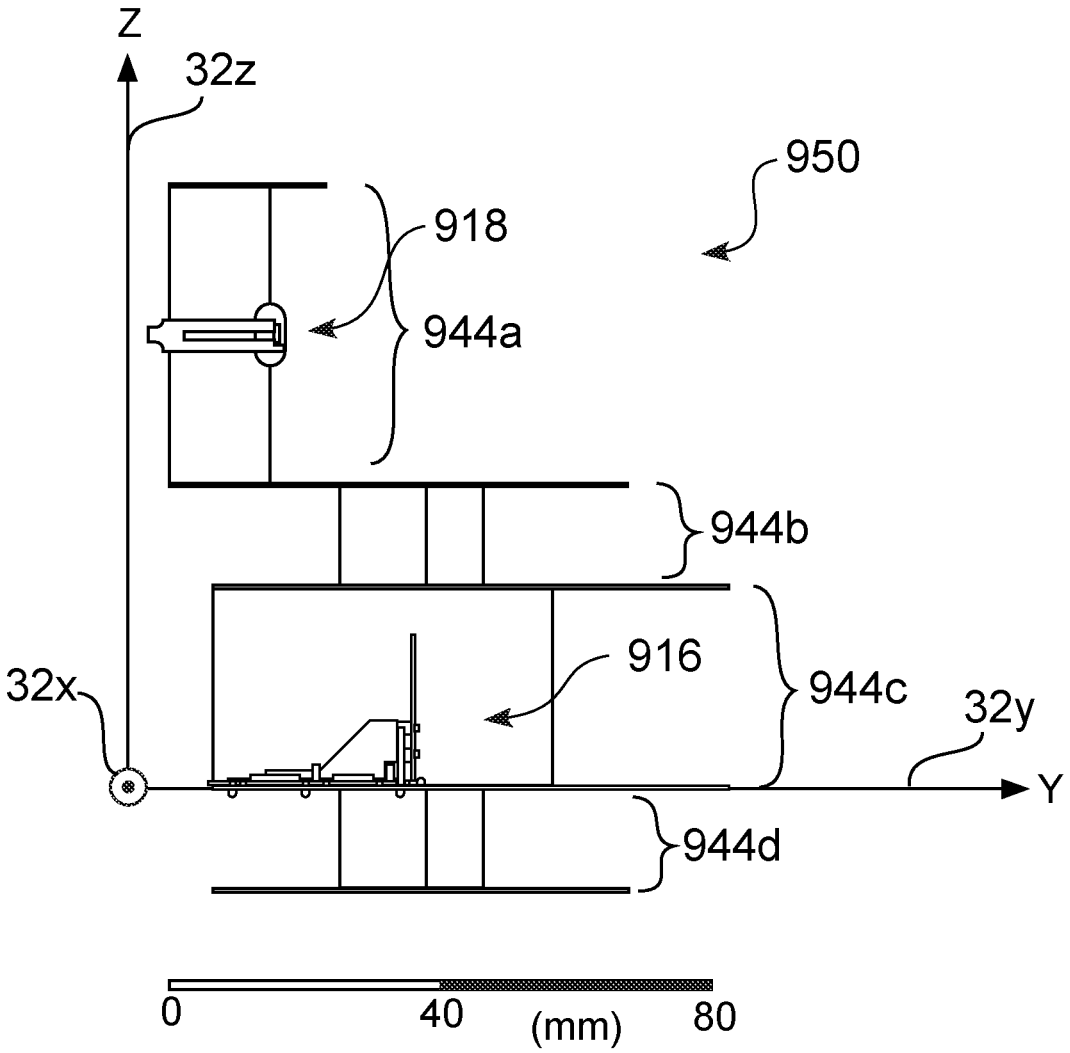
FIG. 78 is a side view that shows stack up of for a single quadrant of an illustrative vertically stacked conical 2G/5G antenna system having four radial quadrants.
Figure 79:
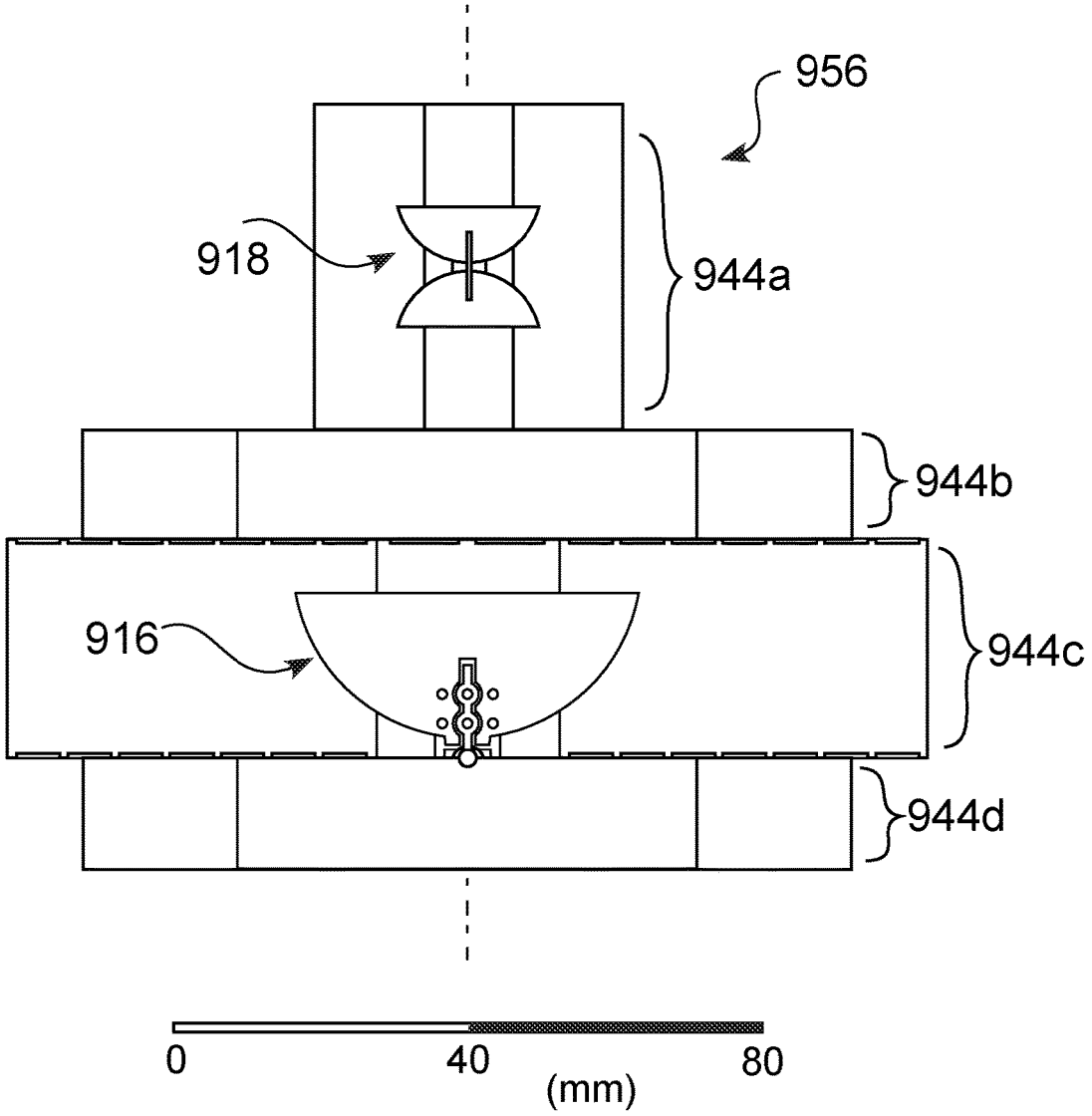
FIG. 79 is a front view that shows stack up of for a single quadrant of an illustrative vertically stacked conical 2G/5G antenna system having four radial quadrants.

FIG. 75 is a side cutaway view of an illustrative stacked antenna system 910, such as to provide a vertically polarized broadband structure for multiple-in multiple-out (MIMO) operation on multiple frequencies, e.g., a 2 GHz band and one or more 5 GHz bands. FIG. 76 is a perspective view 930 of an illustrative an antenna structure 912 for a stacked antenna system 910. FIG. 77 is a trimetric view 940 that shows stack up of for a single quadrant 942 of an illustrative antenna structure for stacked antenna system 910. FIG. 78 is a side view 950 that shows stack up of for a single quadrant 942 of an illustrative antenna structure for a stacked antenna system 910. FIG. 79 is a front view 956 that shows stack up of for a single quadrant 942 of an illustrative antenna structure for a stacked antenna system 910.

The illustrative stacked antenna system 910 seen in FIGS. 75-79 includes a multiple tiered structure or body 912 that is axially symmetrical with respect to the Z-axis 32*z*, and includes a four quadrants 942 (FIG. 77) arranged about the perimeter, to provide wireless transmission and reception.

As seen in FIG. 78, the illustrative multiple tiered antenna structure 912 includes an upper antenna tier 944*a* for 5G antennas 918, a lower antenna tier 944*c* for 2G antennas 916, an upper RF trap 944*b* (FIG. 78) located between the upper antenna tier 944*a* and the lower antenna tier 944*c*, and a lower RF trap 944*d* below the lower antenna tier 944*c*, in which the bottom of the lower RF trap forms the base of the structure 912, such as for placement or mounting of the stacked antenna system 910.

The illustrative stacked antenna system 910 seen in FIG. 75 can include an outer cover 914, which defines an interior region 922 within which the antenna structure 912 can be mounted. In some embodiments, the illustrative outer cover 914 can be axially symmetric. For instance, the illustrative outer cover seen in FIG. 75 includes a conical profile extending from above the upper antenna tier 944*a* to the top of the lower antenna tier 944*c*, and a cylindrical profile that extends from the top to the bottom of the lower antenna tier 944*c*.

As noted above, illustrative stacked antenna system 910 seen in FIGS. 75-79 can be configured as a multiple-in multiple-out (MIMO) antenna, and can be implemented for a wide variety of applications. For instance, some embodiments of the stacked antenna system 910 can be configured for any of free-standing application, and/or can be mounted on a horizontal surface, e.g., a ceiling, or a vertical surfaces, e.g., a wall. In some embodiments, the illustrative stacked antenna system 910 is configured to operate as a router.

The lower antenna region 944*c* seen in FIG. 78 is configured to house the 2G antenna assemblies 918, while the upper region 944*a* seen in FIG. 78 is configured to house the 5G antenna assemblies 918. The lowest tier 944*d* seen in FIG. 75 is configured as an RF trap 920. As well, the third region 944*b* is configured to provide an RF trap 924 between the 2G antenna assemblies 916 and the 5G antenna assemblies 918.

The illustrative 2G antenna assemblies 916 and the illustrative 5G antenna assemblies 918 seen in FIGS. 75-79 each provide an array of antenna elements, to provide transmission and reception for each of the quadrants 942. As seen in FIG. 76 and FIG. 77, the four quadrants 942 provide signal reception and transmission in multiple directions, e.g., radially outward with respect to the X-axis 30*x* and the y-axis 30*y*.

For instance, the illustrative 2G antenna assembly 916 seen in FIG. 78 and FIG. 79 can include a monopole antenna element 916 facing outward for each of the quadrants 942, such as to provide a reflector for each corner of the structure 910. As well, each of the monopole antenna elements 916 can generate necessary vertical components for the corresponding wireless signals.

Furthermore, each of the illustrative 5G antenna assemblies 918 seen in FIG. 78 and FIG. 79 includes a dipole antenna sub-assembly facing outward for each of the quadrants 942. The illustrative 5G antenna assembly 918 seen in FIG. 75 typically includes a balun that feeds to each of the antenna reflectors.

The illustrative stacked antenna system 910 seen in FIGS. 75-79 can provide vertically polarized broadband operation, such as by using four orthogonal signal paths for outgoing and/or incoming wireless signals, and can be configured to provide beamforming.

An illustrative embodiment of the stacked antenna system 910 seen in FIGS. 75-79 can be configured as a vertically polarized broadband antenna structure for multiple-in multiple-out (MIMO) operation on multiple frequencies, wherein the antenna system 910 comprises four monopole antenna sub-assemblies 916 for operation in a first wireless band having a corresponding frequency, e.g., 2 GHz, four dipole antenna sub-assemblies 918 for operation is a second wireless band having a corresponding frequency, e.g., 5 GHz, wherein the second wireless band has a higher frequency than the frequency corresponding to the first wireless band, an antenna body 912 including a plurality of tiers 944, wherein the tiers 944 are axially symmetric with respect to a vertical axis, e.g., 32*z*, wherein the tiers 944 are separated into four orthogonal quadrants 942, and wherein the tiers include an upper antenna tier 944*a*, in which a corresponding dipole antenna sub-assembly 918 for operation is the second wireless band is mounted in each of the four quadrants 942, a first RF trap tier 944*b* located below the upper antenna tier 944*a*, a lower antenna tier 944*c* located below the first RF trap 944*b*, in which a corresponding monopole antenna sub-assembly 916 for operation is the first wireless band is mounted in each of the four quadrants 942, and a lower RF trap tier 944*d* located below the lower antenna tier 944*c*.

Figure 80:
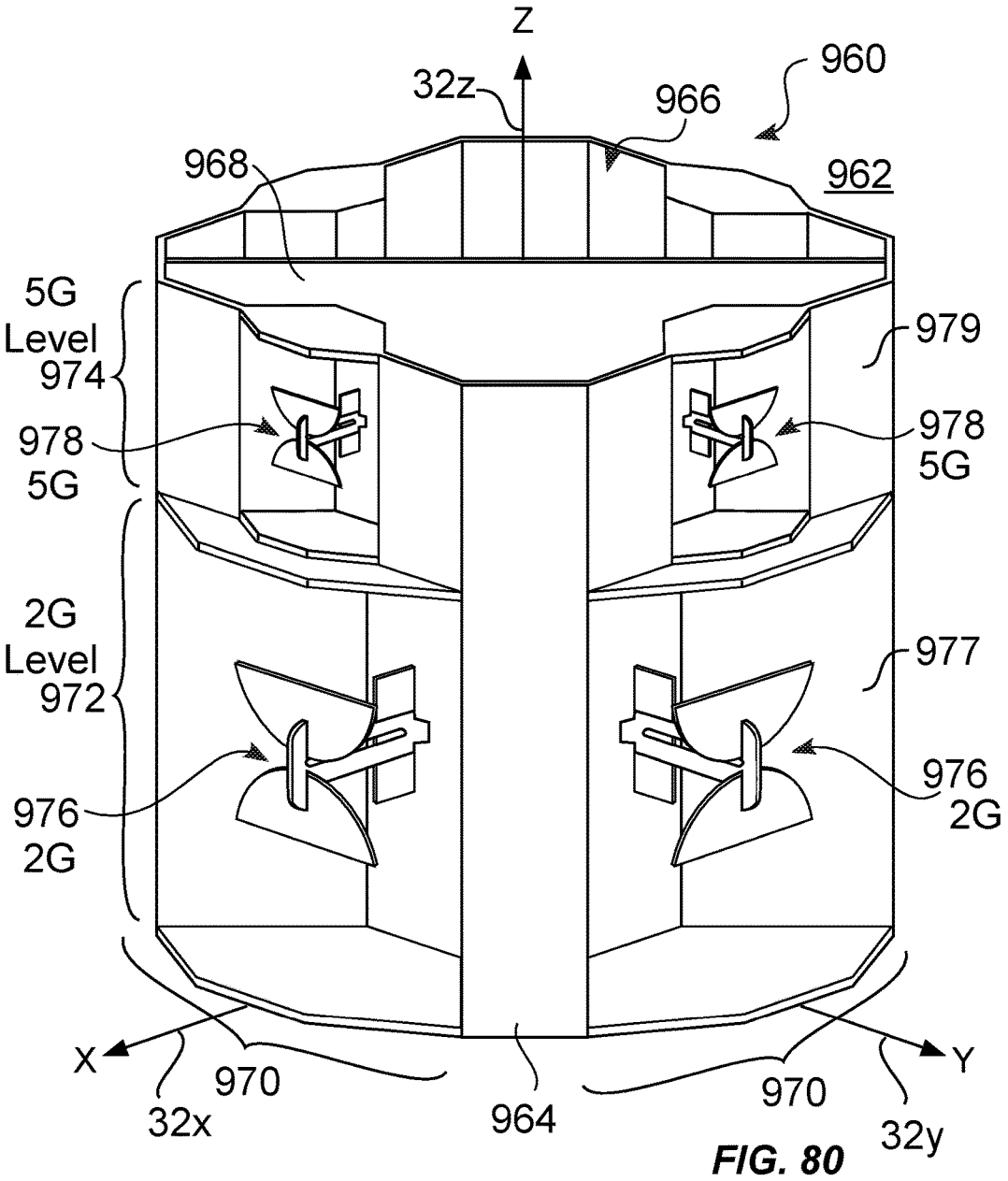
FIG. 80 is a diametric view of an illustrative vertically stacked quad tri band antenna system having four radial quadrants and an internally mounted PCB.
Figure 81:
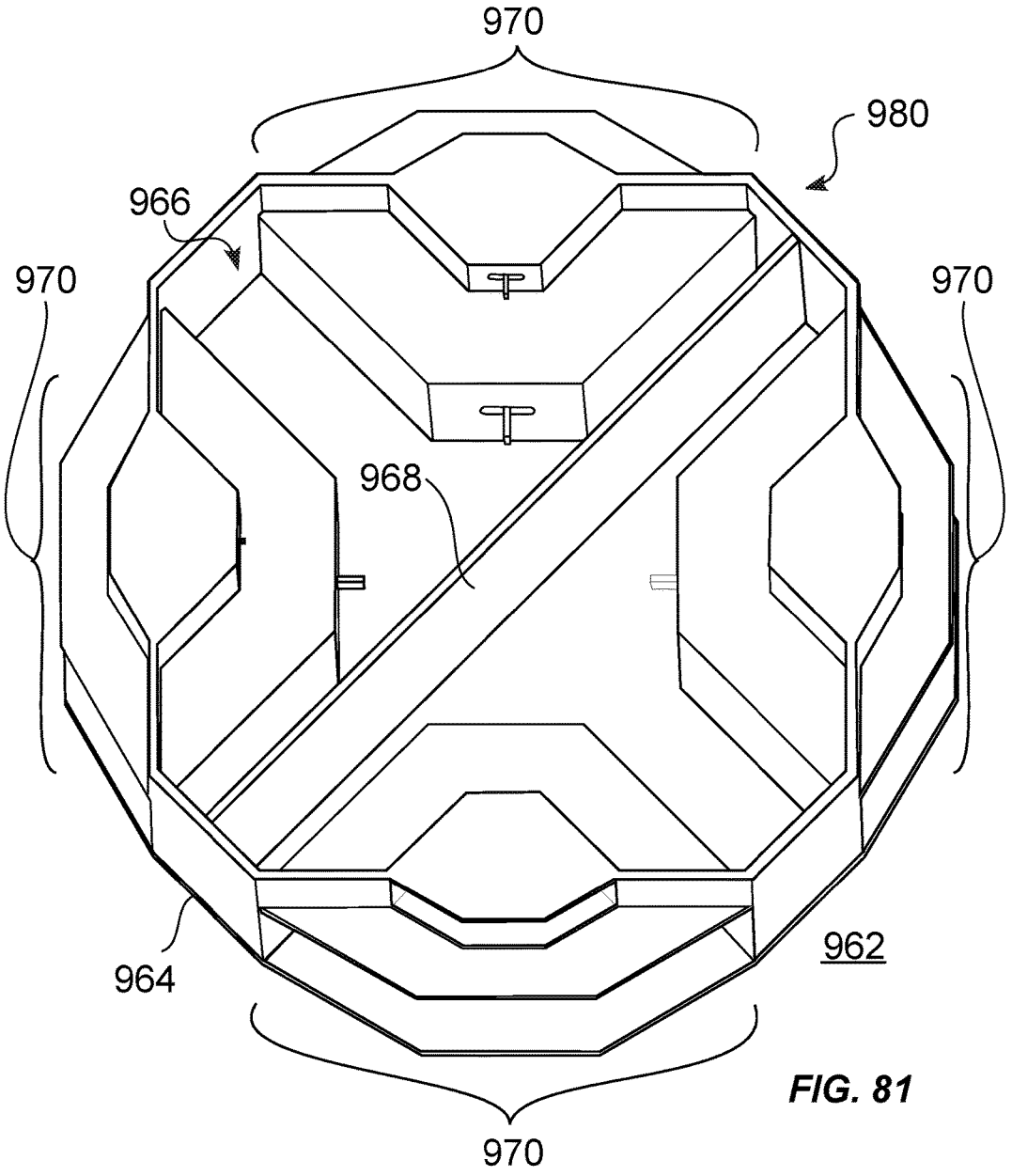
FIG. 81 is a an off top view of an illustrative vertically stacked quad tri band antenna system having four radial quadrants and an internally mounted PCB.

FIG. 80 is a diametric view of an illustrative vertically stacked quad tri band antenna system 960 having four radial quadrants 970 and an internally mounted printed circuit board (PCB) 968, such as including active electronics for the antenna system 960. FIG. 81 is an off top view 980 of an illustrative vertically stacked quad tri band antenna system 960 having four radial quadrants 970 and an internally mounted PCB 968.

The illustrative vertically stacked quad tri band antenna system 960 seen in FIG. 80 and FIG. 81 includes four 2G assemblies 976 arranged around the periphery of a 2G tier 972, to provide operation within a 2G band, and four dual 5G assemblies 978 arranged around the periphery of a 5G tier 974, to provide two 5G bands, with no 60 GHz.

The illustrative vertically stacked quad tri band antenna system 960 seen in FIG. 80 and FIG. 81 also includes four quadrants 970 arranged around the periphery of the antenna 910, to provide transmission and reception in four orthogonal directions, such as in relation to the X-axis 32*y* and the Y-Axis 32*y*. As further seen in FIG. 80, the quad tri band antenna system 960 typically includes reflector surfaces 977 and 979 for each of the antenna assemblies 976,978.

An illustrative embodiment of the vertically stacked quad tri band antenna system 960 comprises a first antenna assembly 976 including four antenna sub-assemblies for operation in a first wireless band having a corresponding first frequency, e.g., 2 GHz, a second antenna assembly 978 including four dipole antenna sub-assemblies for operation in two second wireless bands having a corresponding second frequency, e.g., 5 GHz, wherein the corresponding second frequency is higher than the first frequency, an antenna body 964 extending vertically from a lower end to an upper end opposite the lower end, the antenna body 964 having an interior region 966 defined within, and an exterior that includes four radial quadrants 970 for transmission and reception of wireless signals in four orthogonal directions, wherein each of the quadrants 970 includes a lower antenna region 972 that extends vertically upward from the lower end of the antenna body, and an upper region 974 that extends vertically upward from the lower antenna region 976 toward the upper end of the antenna body 964, wherein each of the four antenna sub-assemblies for operation in the first wireless band is mounted in a corresponding one of the quadrants 970 in the lower antenna region 972, wherein each of the four dipole antenna sub-assemblies for operation in the second wireless band is mounted in a corresponding one of the quadrants 970 in the upper antenna region 974, and a printed circuit board (PCB) 968 including active electronics for the antenna system 960, wherein the PCB 968 is mounted within the interior 966 of the antenna body 964, and is connected to the first antenna assembly 976 and to the second antenna assembly 978, wherein the vertically stacked quad tri-band antenna system 960 is configured to provide transmission and reception of wireless signals in four orthogonal directions for the first wireless band having the first frequency, and the two second wireless bands having the second frequency.

An illustrative embodiment of the vertically stacked quad tri band antenna system 960 seen in FIG. 80 and FIG. 81 has an overall height of 152 mm, and an overall diameter of 172 mm. In an embodiment, an illustrative PCB 968 is 156 mm wide and 161 mm high, and can protrude about 12 mm further below, such as to provide for external connectors, such as for power and wired network connectors.

Note that any and all of the embodiments described above can be combined with each other, except to the extent that it may be stated otherwise above or to the extent that any such embodiments might be mutually exclusive in function and/or structure.

For instance, the crimp assembly 462, such as seen in FIG. 33, can readily be used to provide robust and low cost connections for embodiments of antenna structures discloses herein. As well, one or more of the PCB antenna structures disclosed herein can readily be packaged within the disclosed enclosures. Furthermore, the enhanced balun structures can readily be implemented for a wide variety of the disclosed PCB antenna structures.

Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense.

What is claimed is:

1. An antenna structure, comprising:

an electrically conductive, metallic dipole antenna for operation in a corresponding frequency band, the dipole antenna including:

a first dipole half that extends outward in a first direction from a first half of a feed point, and a second dipole half that extends outward in a second direction opposite the first direction from a second half of the feed point;

wherein a feed gap is defined between the first and second halves of the feed point; and wherein the first dipole half and the second dipole half define a first center-fed dipole antenna;

an electrically conductive, metallic first balun path extending from the first half of the feed point to a coax solder point;

an electrically conductive, metallic second balun path extending from the second half of the feed point to the coax solder point;

a coax shield connection point located on the first balun path proximate to the first half of the feed point; and a coax conductor connection point located on the second balun path proximate to the second half of the feed point;

wherein a portion of an electrically conductive coaxial shield of a coaxial cable extends between and is electrically connected to the coax solder point and to the coax shield connection point;

wherein a balun feed path structure includes the first balun path, the second balun path, and the portion of the coaxial shield of a coaxial cable.

2. The antenna structure of claim 1, wherein the antenna structure is any of:

a metal-only structure; or a metal layer on a printed circuit board (PCB).

3. The antenna structure of claim 1:

wherein the coaxial cable includes a center conductor, the coaxial shield surrounding the center conductor, and a coaxial insulator between the center conductor and the coaxial shield;

wherein the coaxial cable extends from a lead end to a remote end opposite the lead end;

wherein at the lead end, the center conductor is connected to the coax conductor connection point, and the coaxial shield is connected to the coax shield connection point;

wherein the remote end of the coaxial cable extends beyond the coax solder point for connection to antenna electronics.

4. The antenna structure of claim 1, further comprising:

a second electrically conductive, metallic center-fed dipole antenna for operation in a second frequency band, the second frequency band lower than the frequency band corresponding to the first center-fed dipole antenna, the second center-fed dipole antenna including:

a first dipole half of the second center-fed dipole antenna that extends outward in the first direction from the first half of the feed point, and a second dipole half of the second center-fed dipole antenna that extends outward in the second direction from the second half of the feed point;

wherein the frequency corresponding to the frequency band is an even multiple of the second frequency band.

5. An antenna structure, comprising:

an electrically conductive, center-fed dipole antenna, including:

a first dipole half that extends outward in a first direction from a first half of a feed point, and a second dipole half that extends outward in a second direction opposite the first direction from a second half of the feed point;

wherein a feed gap is defined between the first and second halves of the feed point;

an electrically conductive, metallic balun path extending from the first half of the feed point to a coax solder point;

a coax shield connection point located proximate to the second half of the feed point;

a coax conductor connection point located proximate to the first half of the feed point; and a coaxial cable including a center conductor, a coaxial shield surrounding the center conductor, and coaxial insulator between the center conductor and the coaxial shield;

wherein the coaxial cable extends from a lead end, beyond the coax solder point, to a remote end opposite the lead end;

wherein at the lead end, the center conductor is connected to the coax conductor connection point, and the coaxial shield is connected to the coax shield connection point;

wherein the coaxial shield is also connected to the coax solder point;

wherein the remote end of the coaxial cable extends beyond the coax solder point for connection to antenna electronics;

wherein a balun structure for the antenna structure includes the balun path and the coaxial shield between the coax shield connection point and the coax solder point.

6. The antenna structure of claim 5, further comprising:

a second electrically conductive dipole antenna for operation in a second frequency band, wherein the second frequency band is lower than the frequency band corresponding to the first center-fed dipole antenna, the second dipole antenna including:

a first portion that extends outward in the first direction from the first half of the feed point, and a second portion that extends outward in the second direction from the second half of the feed point;

wherein the frequency corresponding to the first frequency band corresponding to the center-fed dipole antenna is an even multiple of the frequency corresponding to the second frequency band.

7. A dual-band antenna structure for operation in a first frequency band and a second frequency band, wherein the second frequency band is higher in frequency than the first frequency band, the dual-band antenna structure formed on a printed circuit board (PCB) having a first end and a second end opposite the first end, and first surface and a second surface opposite the first surface, the dual-band antenna structure comprising:

a first path structure; and a second path structure;

wherein an antenna feed region is defined between the first path structure and the second path structure;

wherein the first path structure extends longitudinally from the antenna feed region toward the first end of the PCB for connection to an active antenna section;

wherein the second path structure extends longitudinally from the antenna feed region toward the second end of the PCB;

wherein the dual-band antenna structure includes a first antenna for operation in the first frequency band, and a second antenna for operation in the second frequency band, wherein the first antenna and the second antenna are defined by the first path structure and the second path structure, and include:

a first high band path structure including a first transverse path that extends outward from both sides of the first longitudinal path, and a pair of paths that extend from the first transverse path away from the antenna feed toward the first end of the PCB, wherein a pair of traps for the second frequency band are defined between the first longitudinal path and the pair of paths that extend from the first transverse path;

a second high band path structure including a second transverse path that extends outward from both sides of the second longitudinal path, and a pair of paths that extend from the second transverse path away from the antenna feed toward the second end of the PCB, wherein a pair of traps for the second frequency band are defined between the second longitudinal path and the pair of paths that extend from the second transverse path; and a third path structure located between the first end of the PCB and the first high band path structure, the third path structure including a third transverse path that extends outward from both sides of the first longitudinal path, a pair of outer paths that extend longitudinally from the third transverse path, and a pair of inner paths that extend longitudinally from the third transverse path, wherein each of the inner paths are located between a corresponding one of the outer paths and the first longitudinal path, wherein pair of traps for the second frequency band are defined between the corresponding outer paths and inner paths, and wherein a pair of traps for the first frequency band are defined between the corresponding inner paths and the first longitudinal path.

8. The dual-band antenna structure of claim 7, wherein a third path structure further includes:

a pair of capacitors connected between the corresponding inner paths and the first longitudinal path.

9. The dual-band antenna structure of claim 8, wherein the pair of capacitors are configured for beam correction for operation in the second frequency band.

10. The dual-band antenna structure of claim 7, further comprising:

a distribution matching structure established across the antenna feed region between the first path structure and the second path structure.

11. The dual-band antenna structure of claim 10, wherein the distribution matching structure includes any of a capacitor, an inductor, a shunt, or any combination thereof.

12. The dual-band antenna structure of claim 10, wherein the distribution matching structure is configured to provide the desired matching characteristics between the first antenna for operation in the first frequency band, and the second antenna for operation in the second frequency band.

13. A dual-band antenna structure for operation in a first frequency band and a second frequency band, wherein the second frequency band is higher in frequency than the first frequency band, the dual-band antenna structure formed on a printed circuit board (PCB) having a first end and a second end opposite the first end, and a first surface and a second surface opposite the first surface, the dual-band antenna structure comprising:

a first path structure on the first surface of the PCB;

a second path structure on the first surface of the PCB, wherein an antenna feed path is defined between the first path structure and the second path structure;

a central trap structure on the first surface of the PCB connecting the first path structure and the second path structure across the feed path, the central trap structure providing a trap for both the first band and the second band; and a DC feed path structure on the second surface of the PCB;

wherein the first path structure extends longitudinally from the antenna feed path toward the first end of the PCB for connection to an active antenna section;

wherein the second path structure extends longitudinally from the antenna feed path toward the second end of the PCB;

wherein the dual-band antenna structure includes a first antenna for operation in the first frequency band, and a second antenna for operation in the second frequency band, wherein the first antenna and the second antenna are defined by the first path structure and the second path structure, and include:

a first high band path structure including a first transverse path that extends outward from both sides of the first longitudinal path, and a pair of paths that extend from the first transverse path away from the antenna feed toward the first end of the PCB, wherein a pair of traps for the second frequency band are defined between the first longitudinal path and the pair of paths that extend from the first transverse path;

a second high band path structure including a second transverse path that extends outward from both sides of the second longitudinal path, and a pair of paths that extend from the second transverse path away from the antenna feed toward the second end of the PCB, wherein a pair of traps for the second frequency band are defined between the second longitudinal path and the pair of paths that extend from the second transverse path;

a first low band path structure including a third transverse path that extends outward from both sides of the first longitudinal path, a pair of paths that extend from the third transverse path away toward the first end of the PCB, and a pair of capacitors, wherein each of the pair of capacitors is connected between a corresponding one of the pair of paths and the first longitudinal path, wherein a pair of traps is defined between the first longitudinal path and a corresponding one of the pair of paths that extend from the third transverse path; and a second low band path structure including a fourth transverse path that extends outward from both sides of the second longitudinal path, a pair of paths that extend from the fourth transverse path toward the second end of the PCB, and a pair of capacitors, wherein each of the pair of capacitors is connected between a corresponding one of the pair of paths and the second longitudinal path, wherein a pair of traps is defined between the second longitudinal path and a corresponding one of the pair of paths that extend from the fourth transverse path;

wherein the DC feed path structure extends longitudinally on the second surface of the PCB.

14. The dual-band antenna structure of claim 13, wherein the central trap is set to provide for both the first frequency band is and the second frequency band.

15. The dual-band antenna structure of claim 13, wherein the second path structure extends longitudinally from the antenna feed region for connection to one or more light emitting diodes (LEDs).

16. The dual-band antenna structure of claim 13, further comprising:

a distribution matching structure established across the antenna feed path, between the first path structure and the second path structure.

17. The dual-band antenna structure of claim 16, wherein the distribution matching structure includes any of a capacitor, an inductor, a shunt, or any combination thereof.

18. The dual-band antenna structure of claim 16, wherein the distribution matching structure is configured to provide the desired matching characteristics between the first antenna for operation in the first frequency band, and the second antenna for operation in the first frequency band.

19. The dual-band antenna structure of claim 13, wherein the DC feed path structure extends longitudinally below the first longitudinal path, the central trap structure and the second longitudinal path.

20. A dual-band dipole antenna for operation in a first frequency band and a second frequency band, wherein the second frequency band has a higher frequency than the first frequency band, the dual-band dipole antenna comprising:

a first antenna structure; and a second antenna structure;

wherein the first antenna structure and the second antenna structure are formed on a single side of a printed circuit board (PCB) having a first end and a second end opposite the first end;

wherein a feed gap is defined between the first antenna structure and the second antenna structure;

wherein the first antenna structure extends longitudinally from the feed gap toward the first end of the PCB;

wherein the second antenna structure extends longitudinally from the feed gap toward the second end of the PCB;

wherein the first antenna structure includes a first transverse path that extends transversely outward, a first pair of paths that extend longitudinally from the first transverse path away from the antenna feed toward the first end of the PCB, and a second pair of paths that extend longitudinally from the first transverse path away from the antenna feed toward the first end of the PCB, wherein the first pair of paths and the second pair of paths of the first antenna structure define a corresponding inner low band trap and a corresponding outer high band trap;

wherein the second antenna structure includes a second transverse path that extends transversely outward, a first pair of paths that extend longitudinally from the second transverse path away from the antenna feed toward the second end of the PCB, and a second pair of paths that extend longitudinally from the second transverse path away from the antenna feed toward the second end of the PCB, wherein the first pair of paths and the second pair of paths of the second antenna structure define a corresponding inner low band trap, and a corresponding outer high band trap; and a coaxial cable extending from a remote end to a lead end, the coaxial cable including an electrically conductive center conductor and an electrically conductive outer shield surrounding and electrically insulated from the center conductor;

wherein the lead end of the coaxial cable extends through the inner low band trap corresponding to the first antenna structure;

wherein the outer shield at the lead end of the coax cable is electrically connected to the first antenna structure proximal to the feed gap; and wherein the center conductor extends from the lead end of the coaxial cable across the feed gap and is electrically connected to the second antenna structure proximal to the feed gap;

wherein the dual-band dipole antenna is configured to send and receive wireless signals in the first frequency band and the second frequency band.

21. The dual-band dipole antenna of claim 20, further comprising:

a plastic housing having a longitudinal interior region defined therein;

wherein the PCB is located within the longitudinal interior region of the plastic housing.

22. The dual-band dipole antenna of claim 21, wherein return loss for the dual-band dipole antenna within the plastic housing is configured to be less than 10 dB for both the low frequency band and the second frequency band.

* * * * *